United States Patent [19]

Kobayashi et al.

[11] Patent Number: 5,019,490

[45] Date of Patent: May 28, 1991

[54] SILVER HALIDE PHOTOGRAPHIC MATERIALS

[75] Inventors: Hidetoshi Kobayashi; Osamu Takahashi, both of Kanagawa, Japan

[73] Assignee: Fuji Photo Film Co., Ltd., Kanagawa, Japan

[21] Appl. No.: 258,537

[22] Filed: Oct. 17, 1988

[30] Foreign Application Priority Data

Oct. 15, 1987 [JP] Japan ..... 62-260356

[51] Int. Cl.[5] ..... G03C 1/46

[52] U.S. Cl. ..... 430/503; 430/545; 430/546; 430/553; 430/555; 430/557; 430/631

[58] Field of Search ..... 430/503, 545, 546, 553, 430/554, 557, 631

[56] References Cited

U.S. PATENT DOCUMENTS 4,618,571 10/1986 Ichijima et al. ..... 430/505
4,622,268 11/1986 Yokoyama et al. ..... 430/527

FOREIGN PATENT DOCUMENTS 63-106557 5/1988 Japan .
88/00723 1/1988 World Int. Prop. O. .

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

Silver halide photographic materials are disclosed, comprising a support carrying at elast one hydrophilic organic colloid layer in which at least one photographically useful reagent is dispersed with at least one of ethylenic addition polymerized polymer which contains at least 50% by weight of trifluorochloroethylene units.

20 Claims, No Drawings

SILVER HALIDE PHOTOGRAPHIC MATERIALS

FIELD OF THE INVENTION

This invention concerns silver halide photographic materials, and more precisely it concerns silver halide photographic materials in which photographically useful reagents which are sparingly soluble in water are dispersed using a trifluorochloroethylene copolymer or homopolymer and are included in a hydrophilic colloid layer.

BACKGROUND OF THE INVENTION

Conventionally, photographically useful reagents which are sparingly soluble in water, [for example oil soluble couplers, anti-color fading agents or anti-color mixing agents which are used to prevent the occurrence of color fading, color fogging or color mixing (for example alkylhydroquinones, alkylphenols, sulfonamidophenols, dye diffusion type couplers, chromans, coumarones etc.), film hardening agents, oil soluble filter dyes, oil soluble ultraviolet absorbers, brightening agents, DIR compounds (for example DIR hydroquinones, colorless DIR couplers etc.), developing agents, dye developing agents, DDR redox compounds, DDR couplers, etc.] have been dissolved in a suitable high boiling point solvent and then dispersed in the presence of a surfactant in a solution of a hydrophilic organic colloid, especially gelatin, and they have been used in this state by inclusion in hydrophilic organic colloid layers (for example in photosensitive emulsion layers, filter layers, backing layers, antihalation layers, intermediate layers, protective layers etc.). Special use has been made of phthalate ester based compounds and phosphate ester based compounds as high boiling point organic solvents.

The phthalate ester based compounds and phosphate ester based compounds which are used as high boiling point organic solvents are excellent in respect of the dispersibility of the coupler, their affinity with colloid layers such as gelatin layers, their effect on the stability of the color image, their effect on the hue of the color image, their chemical stability in photosensitive materials, and in respect of the fact that they can be acquired cheaply, and they have been widely used in the past.

However, the known high boiling point organic solvents (for example the phthalate ester based compounds and the phosphate ester based compounds) are inadequate in respect of preventing the occurrence of stain and fading of the colored image due to light, heat and moisture in the latest photosensitive materials where high performance is required. Furthermore, there are cases where these high boiling point organic solvents are not satisfactory for achieving the preferred hue in the colored image, and there is a need for novel high boiling point organic solvents.

Furthermore, attention has focused on the problem of post processing stain (stain on the background) in view of the marked progress which has been made with the simplification and speeding up of the development process, as typified by the use of two bath processing which consists of a color development process and a bleach-fix process, and reduction in the amount of washing water, etc.

It is thought that some stain (so-called process stain) occurs as a result of aerial oxidation or oxidation during the bleach or bleach-fixing process of developing agents (p-phenylenediamine derivatives) which remain in the photosensitive material after color development with the formation of oxidized forms which react with the residual couplers, and some means of countering this effect is required.

On the other hand, the high boiling point organic solvents must themselves be sufficiently stable in respect of heat, light and moisture in order to prevent color fading of the colored image and stain on the background (stain) due to heat, light and moisture, and, in general, hydrocarbons of low polarity have been suggested for realizing these objectives.

For example, aromatic hydrocarbons such as t-butylbenzene have been proposed in JP-A-49-90523 (the term "JP-A" as used herein signifies "unexamined published Japanese patent application"), paraffins have been proposed in JP-A-54-99432, and unsaturated hydrocarbons such as 1-dodecene and t-butylbenzene have been proposed in JP-A-59-133545 and JP-A-59-137952. However, the solubility of photographically useful additives, such as couplers etc., which generally have polar structures within the molecule in these high boiling point organic solvents of low polarity is poor, and sometimes the solubility is inadequate, while on other occasions problems arise with poor dispersion stability and precipitation, etc.

The chlorinated paraffins disclosed in JP-A-61-84641 provide improved solubility and dispersion stability, but even so they still have an inadequate effect in respect of preventing the occurrence of staining and fading of a color image.

Further, the carboxylic acid esters and amides which contain fluorine substituted alkyl groups disclosed in JP-A-53-146622 (for example 2,2,3,3,4,4,5,5,6,6,7,7-dodecafluoroheptyl hexanoate and N,N-diethyloctafluoropentanamide) have an inadequate effect in respect of the occurrence of staining and fading of a color image and, moreover, there are problems with solubility and low dispersion stability which are thought to be due to the oil repelling properties which are a distinguishing feature of fluorocarbons.

SUMMARY OF THE INVENTION

Hence, the first object of the invention is to provide silver halide photographic materials where process stain which occurs during development processing is inhibited.

The second object of the invention is to provide silver halide photographic materials in which the occurrence of stain and fading of a color image due to heat, light or moisture, etc., is inhibited.

The third object of the invention is to provide silver halide photographic materials in which high boiling point organic solvents in which photographically useful additives have excellent solubility and dispersibility are used.

The fourth object of the invention is to provide silver halide photographic materials in which the photographically useful additives are dispersed in a high boiling point organic solvent which has a low refractive index.

These objects are realized by means of silver halide photographic materials where the distinguishing features are that they have, on a support, at least one hydrophilic organic colloid layer in which at least one type of photographically useful reagent is dispersed in a form in which it is present along with at least one type of ethylenic addition polymerized polymer which contains at least 50% by weight of a trifluorochloroethylene unit.

Fluorine substituted alkyl compounds, especially long chain alkyl compounds, have a weak interaction with nonpolar molecules, such as hydrocarbons, and they are known, in general, to exhibit oil repellent properties. In other words, this means that the solubility of lipophilic organic compounds (many of the photographically useful reagents such as couplers fall within this category) in these materials is low. Surprisingly, poly(trifluorochloroethylene)'s in which one of the fluorine atoms of the tetrafluoroethylene units of which the oil repelling perfluoroalkyl compounds are formed is simply replaced by a chlorine atom exhibit excellent lipophilicity.

Moreover, according to research carried out by the inventors, a large difference in refractive index between the hydrophilic colloid binder, such as gelatin, and oil soluble components (for example high boiling point organic solvents, couplers, UV absorbers, anti-color fading agents) results in the formation of haze.

Furthermore, it was found that the spectral absorption characteristics of a color image were affected not only by the chemical structures of the couplers but also by the refractive index and dielectric constant of the high boiling point organic solvent.

Thus, the refractive index ($n^{25}_D$, Abbe refractometer) of a poly(trifluorochloroethylene) is within the range from about 1.39 to about 1.42. The values for dibutyl phthalate, tri(dioctyl)phthalate and tricresyl phosphate, high boiling point organic solvents which are generally used in the photographic industry, are 1.493, 1.485 and 1.555 respectively, i.e, the refractive index of the poly(-trifluorochloroethylene)'s is very low when compared with these values. This very low refractive index is an effective device for simply controlling the refractive index of a composition in which photographically useful reagents have been dissolved in a high boiling point organic solvent, and for reducing the level of haze of the film and improving the spectral absorption characteristics of the colored image.

The use of homopolymers or copolymers of trifluorochloroethylene in photographic films and magnetic tapes, etc. is already known. Thus the use of copolymers of trifluorochloroethylene and vinyl chloride as lubricating agents in photographic films and magnetic tapes has been suggested in U.S. Pat. Nos. 3,862,860, 3,954,637 and 3,998,989 and in West German Patent 2,624,350, the use of poly(trifluorochloroethylene) as an antistatic agent in photographic films has been suggested in British Patent 1,111,692, the use of homopolymers or copolymers of trifluorochloroethylene as delustering agents for photographic films has been suggested in U.S. Pat. No. 2,731,347 and the use of poly(trifluorochloroethylene) as a laminating agent for preventing the deterioration of photographic films has been suggested in U.S. Pat. No. 4,378,392. However, in none of these cases is the polymer used for the dispersion of photographically useful reagents and in each case the objective differs from that of the present invention.

The ethylenic addition polymers which contain triflurochloroethylene units which are used in the invention are described in detail below.

The ethylenic addition polymers which contain trifluorochloroethylene units used in the invention are copolymers which contain at least 50% by weight of the trifluorochloroethylene unit represented by the general formula [I] below, or homopolymers of trifluorochloroethylene.

General Formula [I]

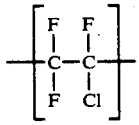

Possible copolymer components include ethylene, propylene, 1-butene, 2-butene, vinyl chloride, vinylidene chloride, trichloroethylene, tetrachloroethylene, vinyl fluoride, vinylidene fluoride, trifluoroethylene, tetrafluoroethylene, hexafluoropropylene, heptafluoropropyl trifluorovinyl ether, styrene, vinyl acetate, acrylonitrile, methacrylonitrile, crotononitrile, acrylic acid esters preferably having up to 8 carbon atoms (for example methyl acrylate, ethyl acrylate, butyl acrylate, methyl methacrylate, octyl acrylate), maleic acid esters preferably having up to 8 carbon atoms (for example dimethyl maleate, diethyl maleate), itaconic acid esters preferably having up to 8 carbon atoms (for example diethyl itaconate), citraconic acid esters preferably having up to 8 carbon atoms (for example diethyl citraconate), butadiene, isoprene, chloroprene, cyclopentadiene, N-vinylpyrrolidone, vinylpyridine, divinylbenzene, and isobutene etc., and two or three component copolymers, consisting of trifluorochloroethylene and ethylene, trifluorochloroethylene and vinyl chloride, trifluorochloroethylene and vinylidene chloride, trifluorochloroethylene, ethylene and vinyl chloride etc., can be used in the invention.

If the trifluorochloroethylene content of the copolymer is low then the low refractive index and high thermal stability which are distinguishing features of fluorocarbons are not fully realized and so an average content (by weight) of at least 50% of trifluorochloroethylene unit is required in the copolymer, and a trifluorochlorethylene unit content of at least 65% is preferred, at least 80% is more desirable, and the use of trifluorochloroethylene homopolymers is most desirable of all.

The average molecular weight of the polymer containing trifluorochloroethylene units which is used in the invention may be from 300 to 5,000, preferably from 400 to 1,500, and most desirably from 500 to 1,100. This is because there is considerable volatalization and diffusion if the average molecular weight is less than 300 and because the dissolving capacity and plasticity are reduced if the average molecular weight exceeds 5,000.

Actual examples of polymers which contain trifluorochloroethylene units which can be used in the invention are indicated below, but the invention is not limited by these examples.

| | | |
|---|---|---|
| S-1 | $-(CF_2CClF)_n-$ | Average molecular weight 300 |
| S-2 | $-(CF_2CClF)_n-$ | Average molecular weight 400 |
| S-3 | $-(CF_2CClF)_n-$ | Average molecular weight 500 |
| S-4 | $-(CF_2CClF)_n-$ | Average molecular weight 600 |
| S-5 | $-(CF_2CClF)_n-$ | Average molecular weight 700 |
| S-6 | $-(CF_2CClF)_n-$ | Average molecular weight 800 |
| S-7 | $-(CF_2CClF)_n-$ | Average molecular weight 900 |

-continued

| | | |
|---|---|---|
| S-8 | $-(CF_2CClF)_n-$ | Average molecular weight 1,000 |
| S-9 | $-(CF_2CClF)_n-$ | Average molecular weight 1,100 |
| S-10 | $-(CF_2CClF)_n-$ | Average molecular weight 1,300 |
| S-11 | $-(CF_2CClF)_n-$ | Average molecular weight 1,500 |
| S-12 | $-(CF_2CClF)_n-$ | Average molecular weight 2,000 |
| S-13 | $-(CF_2CClF)_x-(CH_2CH_2)_y-$ | Average molecular weight 2,500 x/y = 70/30 (by weight) |
| S-14 | $-(CF_2CClF)_x-(CH_2CHCl)_y-$ | Average molecular weight 1,500 x/y = 60/40 (by weight) |
| S-15 | $-(CF_2CClF)_x-(CH_2CCl)_y-$ | Average molecular weight 1,200 x/y = 65/35 (by weight) |
| S-16 | $-(CF_2CClF)_x-(CH_2CH_2)_y-(CH_2CHCl)_z-$ | Average molecular weight 2,000 x/y/z = 60/20/20 (by weight) |

The terminal groups of the polymers are omitted in example (S-1) to (S-16) but each end may be substituted with a hydrogen atom or a fluorine atom, a chlorine atom originating from the chain transfer agent of which actual examples are described hereinafter, a trifluoromethyl group etc., and alkyl group originating from the polymerization initiator, an alkoxy group, an acyloxy group etc., or there may be a terminal double bond produced by the elimination of a fluorine atom or a chlorine atom from the end of the polymer.

Methods for the preparation of the polymers used in the invention, and the trifluorochloroethylene monomeric starting material, are described below.

Trifluorochloroethylene can be prepared by the dechlorination of 1,1,2-trichlorotrifluoroethane, which can be obtained by reacting chlorine and hydrogen fluoride with tetrachloroethylene. The dechlorination reaction can be carried out by reacting the 1,1,2-trichlorotrifluoroethane with zinc or an organometallic material (for example phenyl magnesium bromide, phenyl lithium, butyl lithium), by reaction with hydrogen in the presence of active carbon or a platinum catalyst, or by reaction with ethylene in the presence of a transition metal oxide or chloride (for example $FeCl_3$). These methods for the preparation of trifluorochloroethylene have been described in JP-A-57-5207, JP-A-57-5208, JP-A-57-188529, JP-A-60-185734 and JP-A-61-5032, U.S. Pat. No. 4,155,941, EP-A-53657Al, and in Kogyo Kagaku Zasshi, 72 (7), 1503~7 (1969), etc.

The polymerization of trifluorochloroethylene is carried out using either a polymerization initiator (for example t-butylhydroperoxide, β-hydroxyethyl-t-butyl peroxide, trichloroacetylperoxide, heptafluorobutylperoxide) or γ radiation. Chain transfer agents (for example sulfuryl chloride, chloroform) are normally used to provide a poly(trifluorochloroethylene) which has a low molecular weight. These methods of polymerization have been described in JP-A-54-103495, U.S. Pat. No. 3,640,985, West German Patents 1,034,362 and 2,019,209, British Patent 712,184, and in J. Macromol. Sci., - Chem., 4 (4) 801~13 (1970), etc. Furthermore, the nature of poly(trifluorochloroethylene) has been described in detail in the "Encyclopedia of Polymer Science and Engineering", Volume 3 (1985), p. 463 (Wiley - Interscience).

The ethylenic addition polymers which contain at least 50% by weight of the trifluorochloroethylene unit which are used in the invention are referred to in the description below as "polymers of the invention".

The amount of the polymer of the invention used depends on the type of photographically useful reagent with which it is being used and the physicochemical properties of the reagent, but in most cases the amount used can be varied arbitrarily within the range from 1 to 200 wt. %, preferably the range from 10 to 100 wt. %, based on the amount of the photographically useful reagent. They are preferably used under conditions usch that the polymer of the invention and the photographically useful reagent are dispersed together uniformly in a compatible state. Furthermore, the polymers of this invention can be added to the hydrophilic colloid layers of photographic materials together with photographically useful reagents by means of an oil in water droplet dispersion method as described in WO 88/00723 and JP-A-62-215272. Thus, in this method, a solution of the polymer of the invention and the photographically useful reagent is obtained, using an auxiliary solvent of low boiling point as required, and this is finely dispersed in water, or in an aqueous medium such as an aqueous gelatin solution, etc., in the presence of a surfactant. Dispersion may be accompanied by phase reversal and the mixture may be used for coating after removing or reducing the amount of the auxiliary solvent which is present, as required, by distillation, noodle washing or ultrafiltration, etc.

The polymers of the invention may be used individually or in the form of mixtures of two or more, and they can be used as high boiling point organic solvents for dissolving photographically useful reagents which are sparingly soluble in water and they can also be used jointly with other known conventional high boiling point organic solvents, as required.

The photographically useful reagents which are sparingly soluble in water in this invention include all of the photographically useful reagents which are dispersed in hydrophilic organic colloid layers using known conventional high boiling point organic solvents.

Typical photographically useful reagents which are sparingly soluble in water include photographically useful couplers (for example yellow couplers, magenta couplers, cyan couplers, black couplers, colorless compound forming couplers), anti-fogging agents and anti-color fading agents which prevent the occurrence of color fogging or fading of the colored image (for example alkylhydroquinones and mono- and di-alkyl ethers thereof, alkylphenols, sulfonamidophenols, dye diffusion type couplers, chromans, coumarans, hindered amines, transition metal complexes), film hardening agents, oil soluble filter dyes, oil soluble anti-halation dyes, oil soluble ultraviolet absorbers, brightening agents, DIR compounds (for example DIR couplers, DIR hydroquinones), developing agents, DDR couplers, DRR compounds, dye developing agents, development inhibitors and precursors thereof, development accelerators and precursors thereof, etc.

The polymers of the invention can be used to include these photographically useful reagents which are sparingly soluble in water as fine lipophilic particles in a hydrophilic organic colloid layer, and they are especially useful for including photographically useful couplers in photosensitive silver halide emulsion layers.

The average particle diameter of the fine lipophilic particles obtained in this way is preferably from 0.04 μ to 2 μ, and most desirably from 0.06 μ to 0.4 μ. The average diameter of the fine lipophilic particles can be measured, for example, using a measuring device such as the "Nanosizer" made by the British Coal Tar Co.

The photographically useful couplers to which the invention can be applied are compounds which can undergo a coupling reaction with the oxidation product of a primary aromatic amine developing agent (for example a phenylenediamine derivative or an aminophenol derivative, etc.).

These couplers may have ballast groups or they may be polymerized so that they are rendered fast to diffusion. They are preferably substituted with an elimination group rather than a hydrogen atom at the coupling position. Couplers which provide colored dyes which have an appropriate diffusibility, colored couplers, colorless compound forming couplers, or couplers which release a development inhibitor or a development accelerator as the coupling reaction proceeds can also be used.

The oil protected type acylacetanilide based couplers are typical of the yellow couplers which can be used in the invention. The use of a two equivalent yellow coupler is preferred in this invention, and typical examples include the oxygen atom elimination type yellow couplers disclosed in U.S. Pat. Nos. 3,408,194, 3,447,928, 3,933,501 and 4,401,752, etc., and the nitrogen atom elimination type yellow couplers disclosed in JP-B-58-10739 (the term "JP-B" as used herein signifies "examined published Japanese patent application"), U.S. Pat. Nos. 4,022,620 and 4,326,024, *Research Disclosure* No. 18053 (April 1979), British Patent 1,425,020, and West German Patent Application (OLS) Nos. 2,219,917, 2,261,361, 2,329,587 and 2,433,812, etc. The α-pivaloylacetanilide based couplers are characterized by the fastness of the colored dye, while the α-benzoylacetanilide based couplers are characterized by their good color forming properties Details of the pivaloylacetanilide type yellow couplers have been disclosed in the specification of U.S. Pat. No. 4,622,287 (from line 15 of column 3 to line 39 of column 8) and in the specification of U.S. Pat. No. 4,623,616 (from line 50 of column 14 to line 41 of column 19).

Details of the benzoylacetanilide type yellow couplers have been disclosed in U.S. Pat. Nos. 3,408,194, 3,933,501, 4,046,575, 4,133,958 and 4,401,752, etc.

Typical examples of magenta couplers which can be used in the invention include the oil protected type 5-pyrazolone based couplers and the pyrazoloazole based couplers, such as the pyrazolotriazoles, etc. The 5-pyrazolone based couplers which are substituted with an arylamino group or an acylamino group in the 3-position are preferred from the point of view of the hue of the colored dye and the speed with which the color is formed, and typical examples of these have been disclosed in U.S. Pat. Nos. 2,311,082, 2,343,703, 2,600,788, 2,908,573, 3,062,653, 3,152,896 and 3,936,015, etc. Two equivalent 5-pyrazolone based couplers are preferred and those which have a nitrogen atom elimination group as disclosed in U.S. Pat. No. 4,310,619 and those which have an arylthio group as the elimination group disclosed in U.S. Pat. No. 4,351,897 and WO 88/04795 are preferred. Furthermore, the 5-pyrazolone based couplers which have ballast groups disclosed in European Patent 73,636 have a high color forming reactivity.

The use of the pyrazoloazole based couplers is preferred, and among these the imidazo[1,2-b]pyrazoles disclosed in U.S. Pat. No. 4,500,630 are preferred from the point of view of the light fastness and the small degree of absorbance on the yellow side of the colored dye which is formed, and the use of the pyrazolo[1,5-b][1,2,4]triazole disclosed in U.S. Pat. No. 4,540,654 is most desirable.

The use of the pyrazolotriazole couplers in which a branched alkyl group is bonded directly to the 2-, 3-, or 6-position of the pyrazolotriazole ring as disclosed in JP-A-61-65245, the pyrazoloazole couplers in which a sulfonamido group is included in the molecule as disclosed in JP-A-61-65246, the pyrazoloazole couplers which have alkoxyphenylsulfonamido ballast groups as disclosed in JP-A-61-147254, and the pyrazolotriazole couplers which have alkoxy groups or aryloxy groups in the 6-position as disclosed in EP-A-226,849 is preferred.

The oil protected type naphthol based and phenol based couplers can be used as cyan couplers in this invention.

Examples of naphthol based couplers include those which have an N-alkyl-N-aryl-carbamoyl group in the 2-position of the naphthol nucleus (for example U.S. Pat. No. 2,313,568), those which have an alkylcarbamoyl group in the 2-position (for example, U.S. Pat. Nos. 2,474,293 and 4,282,312), those which have an arylcarbamoyl group in the 2-position (for example JP-B-50-14523), those which have a carbonamido group or a sulfonamido group in the 5-position (for example JP-A-60- 237448, JP-A-61-145557 and JP-A-61-153640), those which have an aryloxy elimination group (for example U.S. Pat. No. 3,476,563), those which have a substituted alkoxy elimination group (for example U.S. Pat. No. 4,296,199), and those which have a glycolic acid elimination group (for example JP-B-60-39217), etc.

Examples of phenol based cyan couplers include those which have an acylamino group in the 2-position of the phenol ring and an alkyl group in the 5-position of the phenol ring, as disclosed in U.S. Pat. Nos. 2,369,929, 4,518,687, 4,511,647 and 3,772,002, etc., the 2,5-diacylaminophenol based couplers disclosed in U.S. Pat. Nos. 2,772,162, 2,895,826, 4,334,011 and 4,500,635 and in JP-A-59-164555, those which have a nitrogen containing heterocyclic ring condensed with the phenyl ring as disclosed in U.S. Pat. Nos. 4,327,173, 4,564,586 and 4,430,423, in JP-A-61-390441 and in Japanese Patent Application No. 10022/86 and, moreover, the ureido based couplers disclosed in U.S. Pat. Nos. 4,333,999, 4,451,559, 4,444,872, 4,427,767 and 4,579,813 and in EP-B-067,689Bl, etc.

Colored couplers can be used jointly in color photosensitive materials for photographic purposes in order to compensate for the unwanted absorptions on the short wavelength side of the colored dyes formed by the magenta and cyan couplers. Typical examples include the yellow colored magenta couplers disclosed in U.S. Pat. No. 4,163,670 and in JP-B-57-39413, etc., and the magenta colored cyan couplers disclosed in U.S. Pat. Nos. 4,004,929 and 4,138,258, and in British Patent 1,146,368, etc.

These couplers may take the form of polymers consisting of dimers or higher units. Typical examples of polymerized couplers have been disclosed in U.S. Pat. Nos. 3,451,820 and 4,080,211. Examples of polymerized magenta couplers have been disclosed in British Patent 2,102,173 and in U.S. Pat. No. 4,367,282.

Furthermore, diffusible colored dye type couplers can be used jointly to improve graininess, and actual examples of magenta couplers of this type have been disclosed in U.S. Pat. No. 4,366,237 and British Patent 2,125,570 and actual examples of yellow, magenta and cyan couplers of this type have been disclosed in European Patent 96,873 and West German Patent Aplicatoin (OLS) No. 3,324,533.

Of course, two or more of these couplers can be used in the same layer, and the same compound can be added to two or more different layers, in order to realize the characteristics required of the photosensitive material.

These couplers may be dispersed using a polymer of this invention but they can be dispersed with the joint use of a polymer of this invention and a known high boiling point organic solvent, as required. Furthermore, a separate emulsion prepared using a known high boiling point organic solvent can be mixed with an emulsion prepared using a polymer of this invention. Organic solvents having a boiling point of at least 140° C. are useful as the high boiling point solvent, and in particular those having a boiling point of at least 160° C. are preferred. The examples of the organic solvents include those which are solid at room temperature. The examples of the organic solvents include compounds represented by the following general formula (0-1), (0-2), (0-3), (0-4), (0-5) or (0-6):

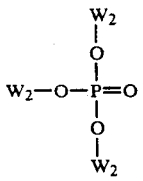
(0-1)

$W_2—COOW_2$ (0-2)

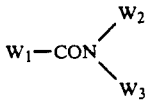
(0-3)

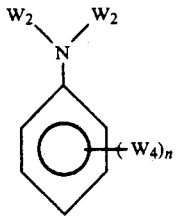
(0-4)

$W_1—O—W_2$ (0-5)
$HO—W_5$ (0-6)

wherein, $W_1$, $W_2$ and $W_3$ each represents a substituted or unsubstituted alkyl group, a substituted or unsubstituted cycloalkyl groups, a substituted or unsubstituted alkenyl group, a substituted or unsubstituted aryl group, or a substituted or unsubstituted heterocyclic group; $W_4$ represents $W_1$, O-$W_1$ or S-$W_1$; n is an integer of from 1 to 5, and when n is at least 2, the $W_4$ groups each may be the same or different; in the general formula (0-4), $W_1$ and $W_2$ may be linked to form a condensed ring; and $W_5$ represents a substituted or unsubstituted alkyl group or a substituted or unsubstituted aryl group, with the total number of carbon atom for constituting the $W_5$ group being at least 12. Actual examples of high boiling point organic solvents which can be used jointly with polymers of this invention include phthalate esters (for example dibutyl phthalate, dicyclohexyl phthalate, di-2-ethylhexyl phthalate, di-dodecyl phthalate), esters of phosphoric acid or phosphonic acid (for example triphenyl phosphate, tricresyl phosphate, 2-ethylhexyl diphenyl phosphate, tricyclohexyl phosphate, tri-2-ethylhexyl phosphate, trinonyl phosphate, tri-dodecyl phosphate, tributoxyethyl phosphate, trichloropropyl phosphate, di-2-ethylhexyl phenyl phosphonate), benzoate esters (for example 2-ethylhexyl benzoate, dodecyl benzoate, 2-ethylbenzyl-p-hydroxy benzoate), amides (for example diethyldodecanamide, N-tetradecylpyrrolidone), alcohols or phenols (for example isostearyl alcohol, 2,4-di-tertamylphenol), aliphatic carboxylic acid esters (for example dioctyl azelate, dioctyl sebacate, glycerol tributyrate, isostearyl lactate, trioctyl citrate), aniline derivatives (for example N,N-dibutyl-2-butoxy-5-tert-octylaniline), hydrocarbons (for example paraffins, chlorinated paraffins, dodecylbenzene, diisopropylnaphthalene), etc. The detailed explanation of the above-described general formulae (0-1) to (0-6) and the useful compounds other than the specific examples of the high boiling point organic solvents as described above are described in WO 88/00723, pp. 77 to 84 and JP-A-62-215272, pp. 137 to 144.

In this invention, it is preferred that the high boiling point solvent is not used but it may be preferred that it is used as the case may be. When it is used, the amount of the high boiling point solvent used varies within the wide range depending on the types of or the amounts of couplers and polymers of this invention. That is, the weight ratio of the high boiling point solvent to coupler is preferably from 0.05 to 20, more preferably from 0.1 to 10, and the weight ratio of the high boiling point solvent to the polymer is preferably from 0.02 to 40, more preferably from 0.05 to 20. Also, the high boiling solvent can be used alone or as a mixture of two or more thereof.

Couplers which are preferably used jointly with a polymer of this invention are described in detail below. The use of polymers of this invention is especially desirable for the dispersion of couplers which can be represented by the general formulae [II], [III], [IV], [VI] and [VII] below.

General Formula [II]

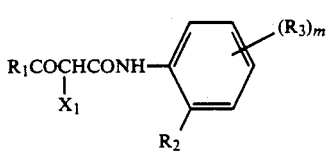

In general formula [II], $R_1$ represents a tertiary alkyl group or an aryl group, $R_2$ represents a hydrogen atom, halogen atom, amino group, alkoxy group or an alkyl group, and $R_3$ represents a halogen atom, alkoxy group, alkyl group carbonamido group, sulfonamido group, alkoxycarbonyl group, carbamoyl group, sulfamoyl group or a cyano group. Moreover, m represents an integer of value from 0 to 4, and when m is 2 or more, the plurality of $R_3$ groups may be the same or different. $X_1$ signifies a hydrogen atom or group which can be eliminated by a coupling reaction with the oxidation product of a primary aromatic amine developing agent (referred to below as an "elimination group", being, for example, a halogen atom, acyloxy group, aryloxy group, heterocyclic-oxy group, arylthio group, heterocyclic-thio group, or a simple or condensed heterocyclic group which is bonded to the active coupling site via a nitrogen atom, etc.).

Examples of $R_1$ include a t-butyl group, 1-ethyl-1-methylpropyl group, 2-chloro-1,1-dimethylethyl group, adamantyl group, phenyl group, 4-methoxyphenyl group, 2-methylphenyl group, etc., examples of $R_2$ include a chlorine atom, bromine atom, fluorine atom, methoxy group, methyl group, dimethylamino group, etc., examples of $R_3$ include a chlorine atom, methoxy group, dodecyloxycarbonyl group, hexadecanesulfonamido group, 2-(2,4-di-tertamylphenoxy)-butanamido group, 4-(2,4-di-tertamylphenoxy)-butanamido group, tetradecyloxy group, etc., and examples of $X_1$ include an acetyloxy group, 4-dodecyloxycarbonylphenoxy group, 4-(4-benzyloxyphenylsulfonyl)phenoxy group, 4-(4-hydroxyphenylsulfonyl)-phenoxy group, pyrazolyl group, imidazolyl group, chlorotriazolyl group, 2-pyridyloxy group, 1-benzyl-3-hydantoinyl group, 1-benzyl-5-ethoxy-3-hydantoinyl group, 1-benzyl-2-phenylurazol-3-yl group, 4,5-dimethoxycarbonylimidazol-1-yl group, 4-carboxyphenoxy group, etc. The couplers represented by the general formula [II] may take the form of oligomeric or polymeric couplers which are linked together by X.

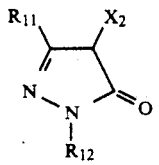

General Formula [III]

In general formula [III], $R_{11}$ represents a carbonylamido group, anilino group or a ureido group, $R_{12}$ represents a phenyl group or a substituted phenyl group and $X_2$ represents a hydrogen atom or an elimination group.

Examples of the elimination group include groups in which an aliphatic group, aromatic group, heterocyclic group, aliphatic, aromatic or heterocyclic sulfonyl group, aliphatic, aromatic or heterocyclic carbonyl group, carbamoyl group, alkoxycarbonyl group or aryloxycarbonyl group is bonded to the coupling active carbon atom via an oxygen atom, nitrogen atom, sulfur atom or a carbon atom, and halogen atoms, aromatic azo groups or heterocyclic groups etc. The aliphatic, aromatic and heterocyclic groups included in $X_2$ and $R_{11}$ may be further substituted, and examples of these substitutent groups and the substituent groups for the substituted phenyl groups of $R_{12}$ include halogen atoms (for example fluorine, chlorine, bromine), alkyl groups (for example methyl, t-octyl, dodecyl, trifluoromethyl), alkenyl groups (for example allyl, octadecenyl), aryl groups (for example phenyl, p-tolyl, naphthyl), alkoxy groups (for example methoxy, benzyloxy, methoxyethoxy), aryloxy groups (for example phenoxy, 2,4-di-tert-amylphenoxy, 3-tert-butyl-4-hydroxyphenoxy), acyl groups (for example acetyl, benzoyl), sulfonyl groups (for example methylsulfonyl, tolylsulfonyl), carboxyl groups, sulfo groups, cyano groups, hydroxyl groups, amino groups (for example amino, dimethylamino), amido groups (for example acetamido, trifluoroacetamido, tetradecanamido, benzamido), sulfonamido groups (for example methanesulfonamido, hexadecanesulfonamido, p-toluenesulfonamido), acyloxy groups (for example acetoxy), sulfonyloxy groups (for example methylsulfonyloxy), alkoxycarbonyl groups (for example dodecyloxycarbonyl), aryloxycarbonyl groups (for example phenoxycarbonyl), carbamoyl groups (for example dimethylcarbamoyl, tetradecylcarbamoyl), sulfamoyl groups (for example methylsulfamoyl, hexadecylsulfamoyl), imido groups (for example succinimido, phthalimido, octadecenylsuccinimido), heterocyclic groups (for example 2-pyridyl, 2-furyl, 2-thienyl), alkylthio groups (for example methylthio) and arylthio groups (for example phenylthio).

Examples of $X_2$ include halogen atoms (for example fluorine, chlorine, bromine), alkoxy groups (for example benzyloxy), aryloxy groups (for example 4-chlorophenoxy, 4-methoxyphenoxy), acyloxy groups (for example acetoxy, tetradecanoyloxy, benzoyloxy), aliphatic or aromatic sulfonyloxy groups (for example methylsulfonyloxy, tolylsulfonyloxy), amido groups (for example dichloroacetamido, trifluoroacetamido), aliphatic or aromatic sulfonamido groups (for example methanesulfonamido, p-toluenesulfonamido), alkoxycarbonyloxy groups (for example ethoxycarbonyloxy, benzyloxycarbonyloxy), aryloxycarbonyloxy groups (for example phenoxycarbonyloxy), aliphatic, aromatic or heterocyclic thio groups (for example ethylthio, hexadecylthio, 2-butyloxyphenylthio, 2-acylaminophenylthio, 4-dodecylphenylthio, pyridylthio), ureido groups (for example methylureido, phenylureido), five or six membered nitrogen containing heterocyclic groups (for example imidazolyl, pyrazolyl, triazolyl, tetrazolyl, 1,2-dihydro-2-oxy-1-pyridyl), imido groups (for example succinimido, phthalimido, hydantoinyl), aromatic azo groups (for example phenylazo), etc. Furthermore, bistype couplers obtained by condensing a four equivalent coupler with an aldehyde or ketone exist as elimination groups which are linked via a carbon atom.

Any of $R_1$, $R_2$ or X may be a divalent group or a group of higher valency, and oligomers such as dimers, etc., can be formed and, moreover, polymeric couplers can be formed by linking between the main chain of a polymer and the coupler mother nuclei.

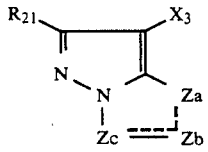

General Formula [IV]

In this formula, $R_{21}$ represents a hydrogen atom or a substituent group, and $X_3$ represents a hydrogen atom or an elimination group the same as for $X_2$. Za, Zb and Zc represent methine groups, substituted methine groups, =N— groups or —NH— groups. Zb can form a condensed ring with Zc.

Those of the couplers represented by the general formula [IV] which can be represented by the general formulae [IVa], [IVb] and [IVc] are the preferred compounds.

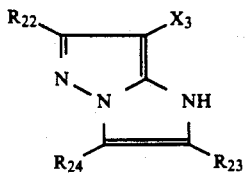

[IVa]

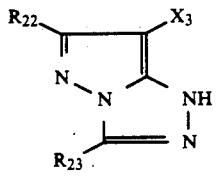

[IVb]

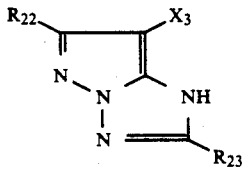

[IVc]

The substituent groups $R_{22}$, $R_{23}$ and $R_{24}$ in the aforementioned general formulae [$IV_a$]~[$IV_c$] are described in detail below; $X_3$ has the same meaning as in general formula (IV).

$R_{22}$, $R_{23}$ and $R_{24}$ represent hydrogen atoms or substituents. Specific examples of the substituents include aliphatic groups, aliphatic oxy groups, aliphatic thio groups, aromatic groups, aromatic oxy groups, aromatic thio groups, heterocyclic groups, heterocyclic oxy groups, heterocyclic thio groups, halogen atoms, acyloxy groups, sulfonyloxy groups, acyl groups, sulfonyl groups, carboxyl groups, sulfo groups, hydroxyl groups, amino groups, amido groups, sulfonamido groups, carbamoyl groups, sulfamoyl groups, alkoxycarbonyl groups, aryloxycarbonyl groups, ureido groups, sulfinyl groups, cyano groups, etc. ,and these may be substituted with the substituent groups which are normally substituted on these groups (for example halogen atoms, alkyl groups, alkinyl groups, aryl groups, heterocyclic groups, alkoxy groups, aryloxy groups, acyloxy groups, sulfonyloxy groups, acyl groups, sulfonyl groups, carboxyl groups, sulfo groups, hydroxyl groups, amino groups, amido groups, sulfonamido groups, carbamoyl groups, sulfamoyl groups, alkoxycarbonyl groups, aryloxycarbonyl groups, ureido groups, sulfinyl groups, alkythio groups, arylthio groups, cyano groups, etc.). $R_{22}$, $R_{23}$ and $R_{24}$ preferably represent aliphatic groups, aliphatic oxy groups, aliphatic thio groups, aromatic groups, aromatic oxy groups, aromatic thio groups, heterocyclic groups, heterocyclic oxy groups, or heterocyclic thio groups.

Any of $R_{22}$, $R_{23}$, $R_{24}$ or $X_3$ may be a divalent group or a group of higher valency and dimers or oligomers may be formed, or they may be linked to the main chain of a polymer and form polymeric couplers.

General Formula [V]

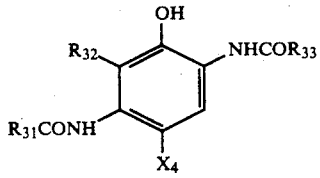

In general formula [V], $R_{31}$ represents an alkyl group, aryl group or a heterocyclic group, $R_{32}$ represents a hydrogen atom, halogen atom or an alkyl group, $R_{33}$ represents an alkyl group, aryl group, anilino group or a heterocyclic group, and $X_4$ represents a hydrogen, atom or an elimination group (for example a halogen atom, alkoxy group, aryloxy group, alkylthio group, arylthio group, carbamoyloxy group, sulfonamido group, heterocyclic oxy group, heterocyclic thio group). Within the groups indicated for $R_{31}$, $R_{32}$, $R_{33}$ and $X_4$, the substitutable groups may be substituted with substituent groups Such as those described already in connection with $R_{11}$. $R_{31}$ and $R_{32}$ may be joined together to form a five to seven membered ring.

Examples of $R_{31}$ include a t-butyl group, 1-(2,4-di-tert-amylphenoxy)propyl group, 1-(2,4-di-tertamylphenoxy)amyl group, 1-(3-tert-butyl-4-hydroxyphenoxy)tridecyl group, 1-(4-tert-amyl-2-chlorophenoxy)pentyl group etc.; examples of $R_{32}$ include a fluorine atom, chlorine atom, methyl group etc.; examples of $R_{33}$ include a trifluoromethyl group, heptafluoropropyl group, 1,1,2,2-tetrafluoroethyl group, phenyl group, 2-chlorophenyl group, 2-methanesulfonamidophenyl group, 2,4-dichlorophenyl group, 4-cyanophenyl group, 2-chloro-4-cyanophenyl group, pentafluorophenyl group, 2-butanesulfonamidophenyl group, 4-cyanoanilino group, 4-methylsulfonylanilino group, 4-butylsulfonylanilino group, 4-N,N-diethyl-sulfamoylphenyl group, 3,4-dichloroanilino group, 3-methanesulfonamidoanilino group, 2-chloro-4-cyanoanilino group etc.; and examples of $X_4$ include a fluorine atom, chlorine atom, bromine atom, methoxy group, methoxyethoxy group, 2-hydroethoxy group, carboxymethoxy group, N-(2-methoxyethyl)carbamoylmethoxy group, 3-carboxypropyloxy group, 2-carboxymethylthioethoxy group, phenoxy group, 4-methoxyphenoxy group, 4-chlorophenoxy group, 4-tert-octylphenoxy group, 3-pentadecylphenoxy group, etc.

Examples of cases in which $R_{31}CONH$— and $R_{32}$ are bonded together include:

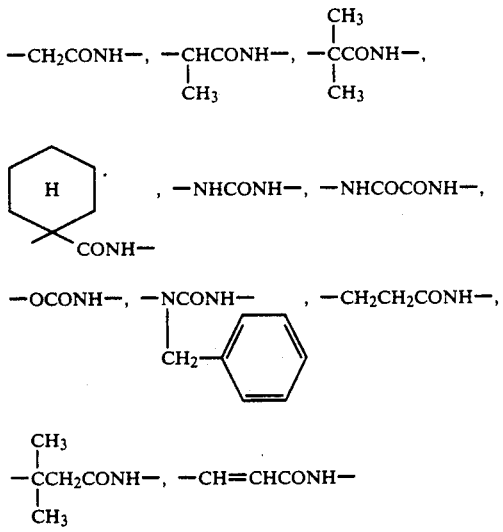

General Formula [VI]

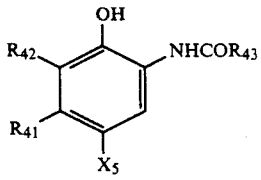

In general formula [VI], $R_{41}$ represents an alkyl group or an alkoxy group, $R_{42}$ represents a halogen atom or an alkyl group, $R_{43}$ represents an alkyl group, aryl group or a heterocyclic group, and $X_5$ represents a hydrogen atom or an elimination group of the same type as for $X_4$.

Examples of $R_{41}$ include a methyl group, ethyl group, propyl group, isopropyl group, n-butyl group, t-butyl group, pentadecyl group, methoxy group, ethoxy group and butoxy group; examples of $R_{42}$ include a fluorine atom, chlorine atom, methyl group and ethyl group; and examples of $R_{43}$ include 1-(2,4-di-tert-amylphenoxy)propyl group, 1-(2,4-di-tert-amylphenoxy)amyl group, 1-(2,4-di-tertamylphenoxy)heptyl group, 1-(4-tert-amyl-2-chlorophenoxy)pentyl group and 1-(2-tert-amyl-4-chlorophenoxy)heptyl group.

The couplers of general formulae [V] and [VI] can be used jointly.

General Formula [VII]

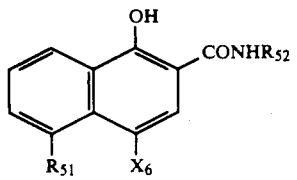

In general formula [VII], $R_{51}$ represents a hydrogen atom, hydroxyl group, amino group, amido group, sulfonamido group, ureido group, sulfamoylamino group, alkoxycarbonylamino group or an alkoxysulfonylamino group, $R_{52}$ represents an alkyl group, aryl group or a heterocyclic group, and $X_6$ represents a hydrogen atom or an elimination group of the same type as for $X_4$.

Examples of $R_{51}$ include a hydroxyl group, amino group, ethylamino group, anilino group, acetamido group, trifluoracetamido group, methanesulfonamido group, toluenesulfonamido group and 3-phenylureido group, and examples of $R_{52}$ include n-dodecyl group, n-hexadecyl group, n-dodecyloxypropyl group, 3-(2,4-di-tert-amylphenoxy)propyl group, 4-(2,4-di-tert-amylphenoxy)butyl group, 2-tetradecyloxyphenyl group and 2-chloro-5-dodecyloxycarbonylphenoxy group.

The couplers represented by the general formulae [V], [VI] and [VII] may take the form of dimers or higher units with any of $R_{31}$, $R_{32}$, $R_{33}$ or $X_4$ in general formula [V], any of $R_{41}$, $R_{42}$, $R_{43}$ or $X_5$ in general formula [VI], or any of $R_{51}$, $R_{52}$ or $X_6$ in general formula [VII] being a divalent group or a group of a valency greater than 2 and, furthermore, they may take the form of polymeric couplers with a link between the main polymer chain and the coupler nucleus.

Examples of preferred couplers for use in the invention are indicated below.

The use of a polymer of this invention is preferred for the dispersion of the couplers represented by the aforementioned general formulae [II]~[VI], and the use of a polymer of this invention is especially desirable for the dispersion of those of these couplers which can be represented by the general formula [IV] (especially in the case of the couplers which can be represented by the general formula [IVc]).

(Y-1)

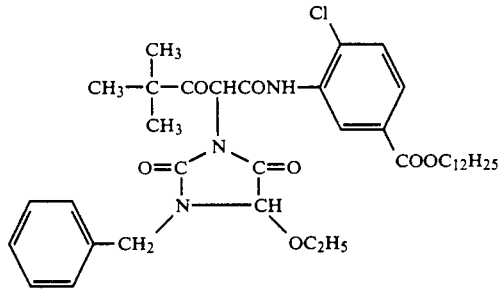

(Y-2)

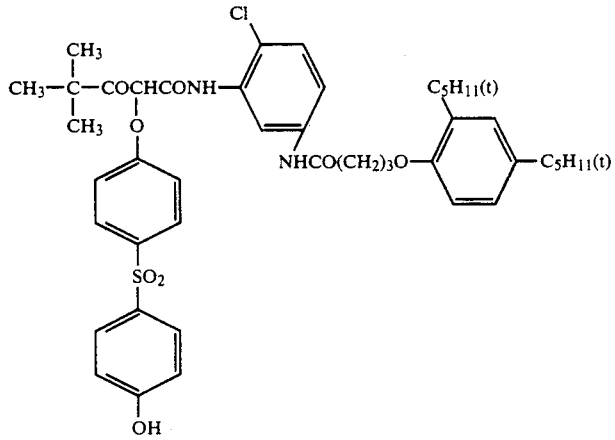

-continued
(Y-3)
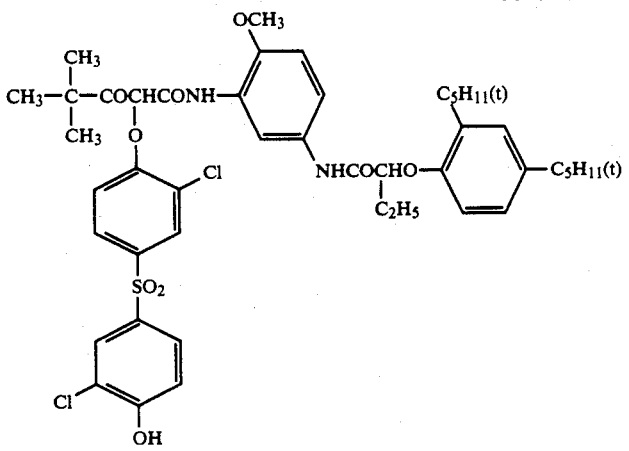
(Y-4)
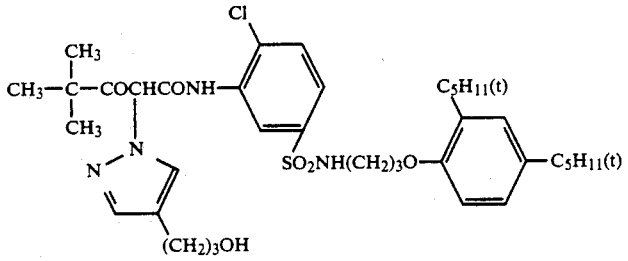
(Y-5)
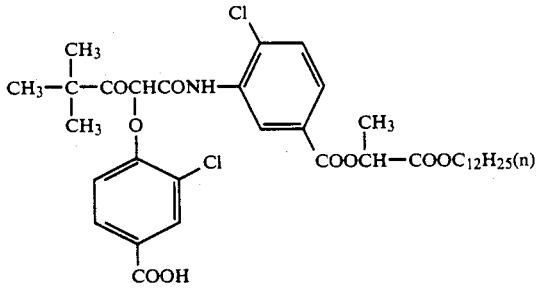
(Y-6)
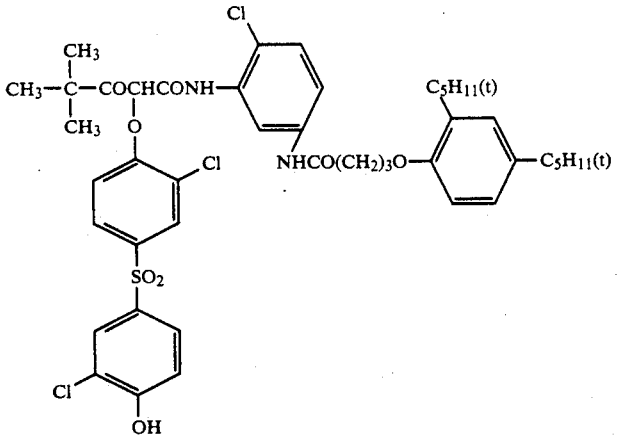
(Y-7)
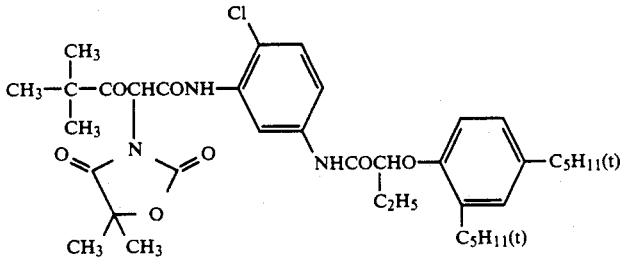

-continued
(Y-8)
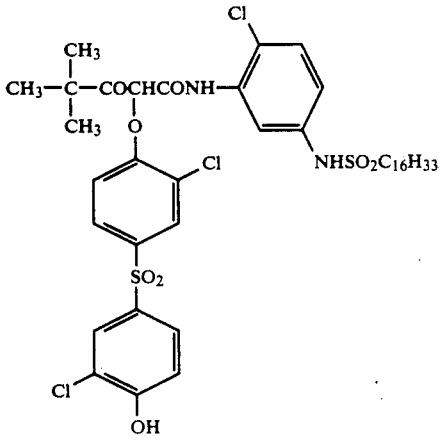
(Y-9)
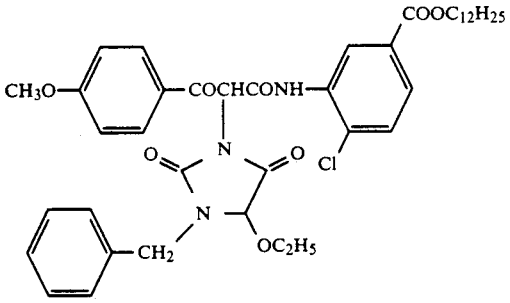
(Y-10)
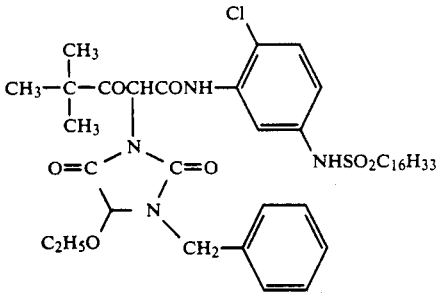
(Y-11)
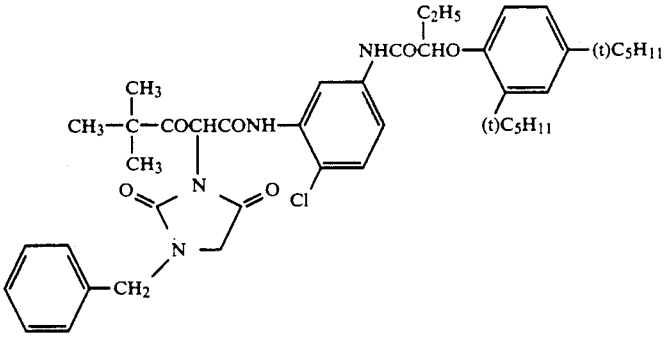

-continued
(Y-12)
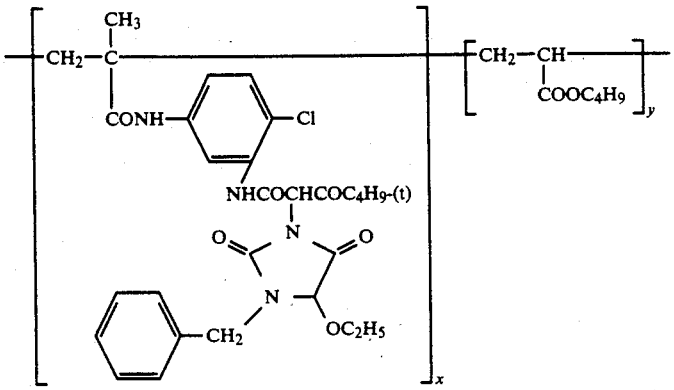
x:y = 50/50 (wt)
(Y-13)
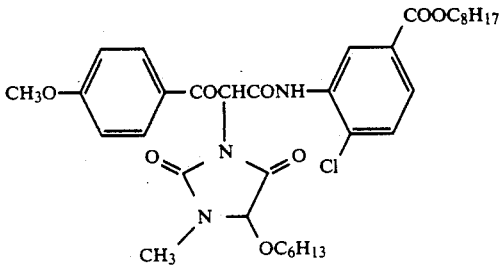
(Y-14)
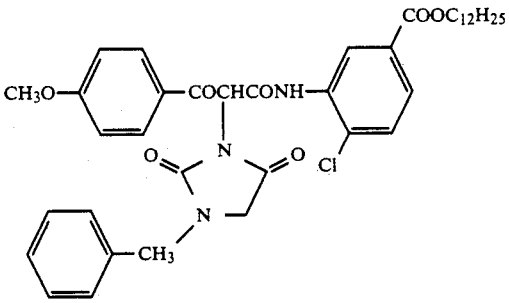
(Y-15)
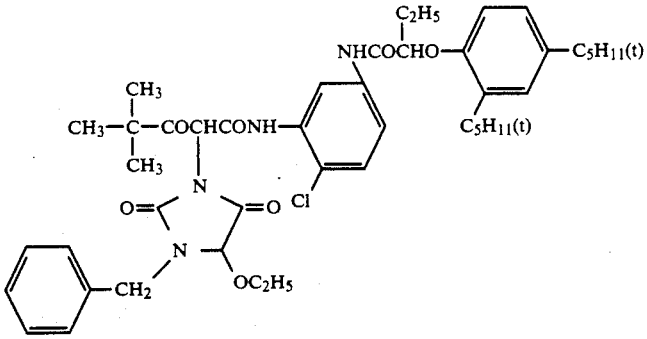
(Y-16)
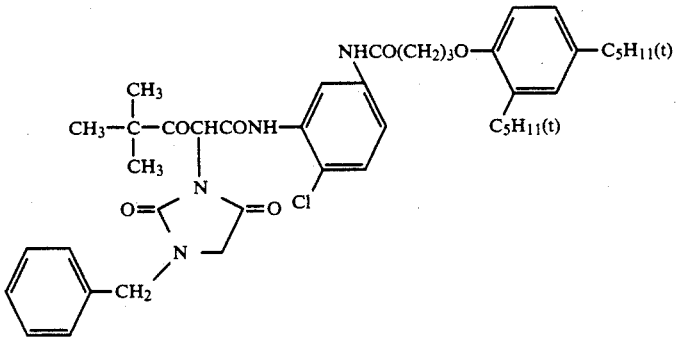

-continued
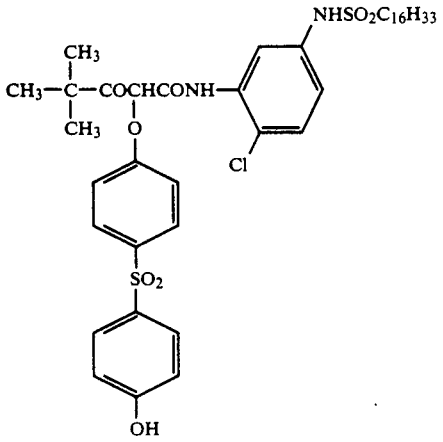
(Y-17)
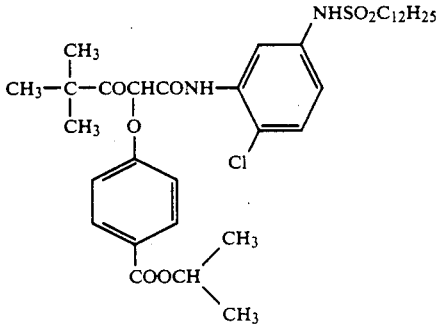
(Y-18)
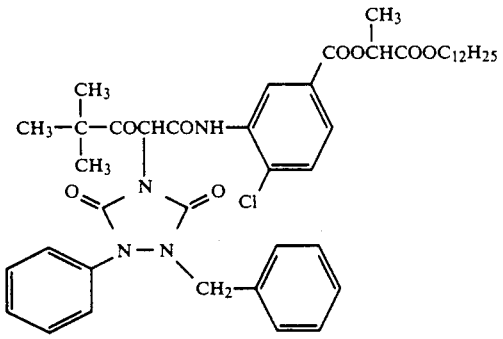
(Y-19)
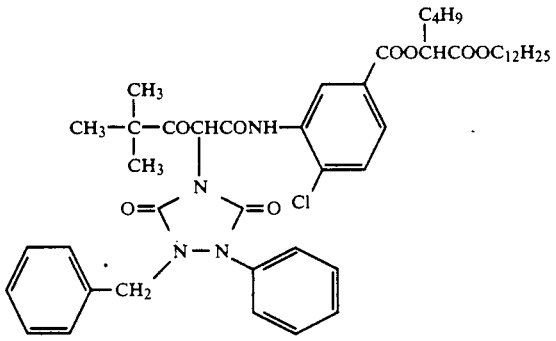
(Y-20)

-continued
(Y-21)
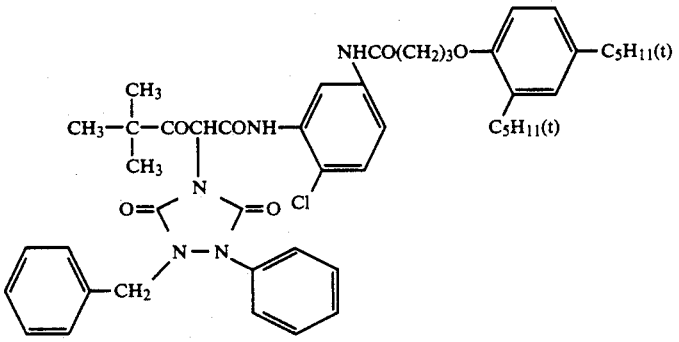
(Y-22)
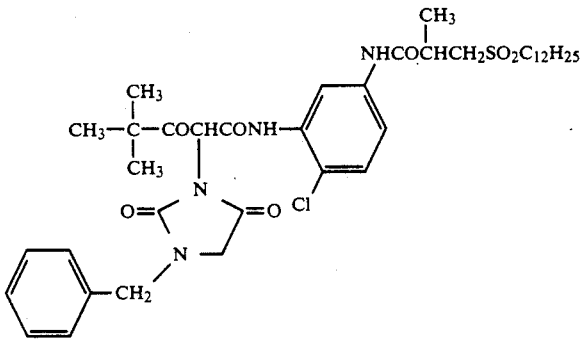
(Y-23)
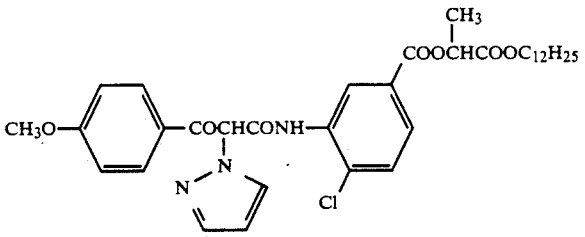
(Y-24)
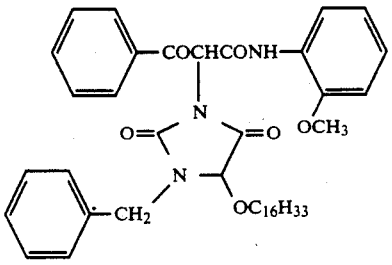

-continued
(Y-25)
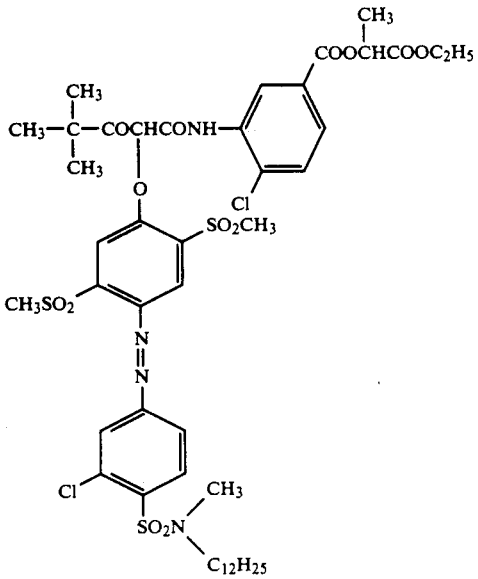
(Y-26)
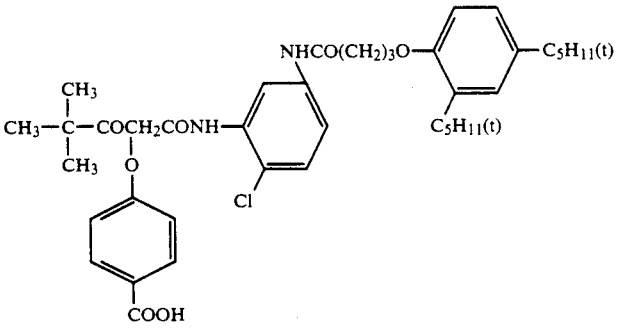
(Y-27)
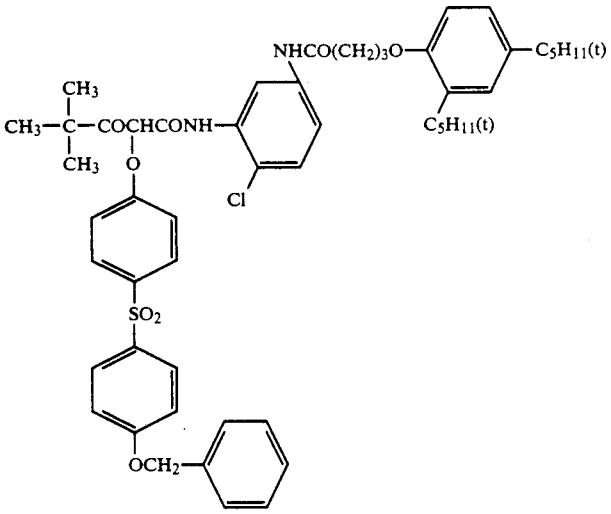

-continued
(Y-28)
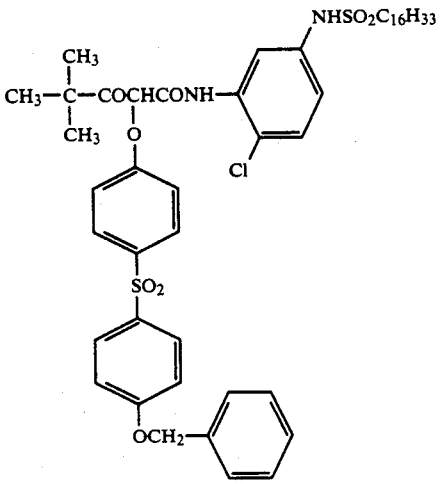
(Y-29)
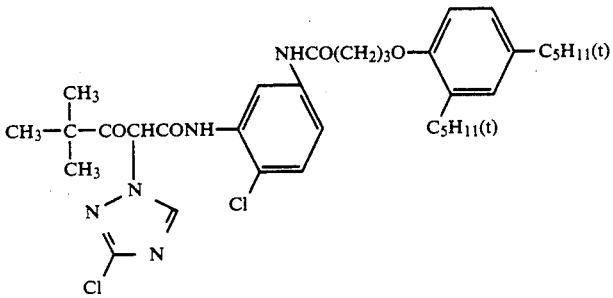
(Y-30)
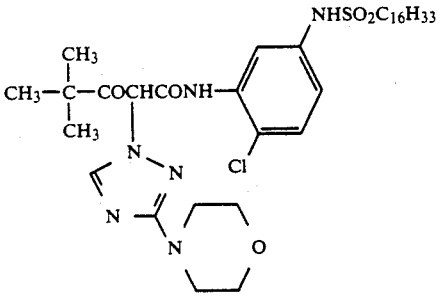
(Y-31)
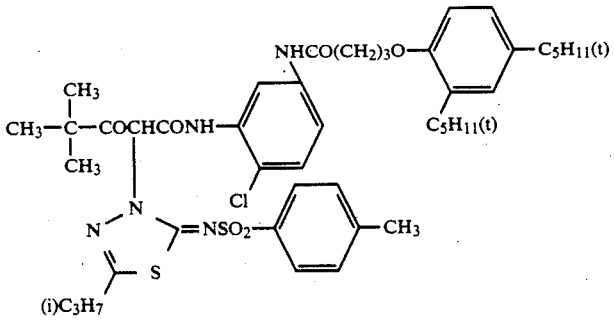
(Y-32)
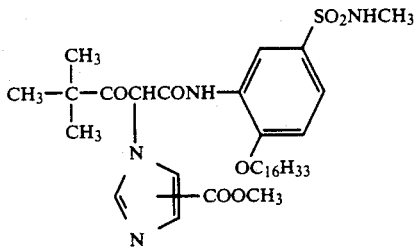

-continued
(Y-33)
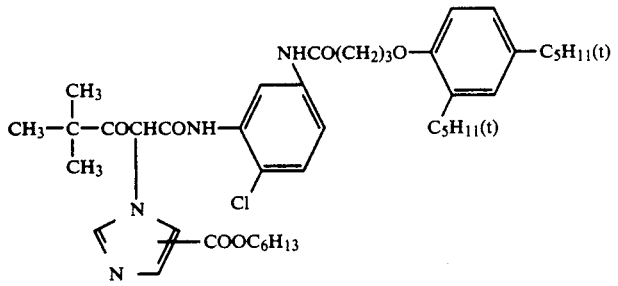
(Y-34)
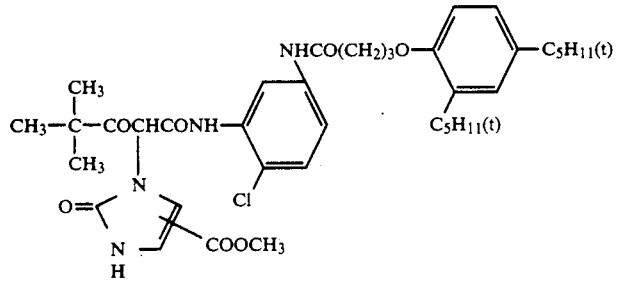
(Y-35)
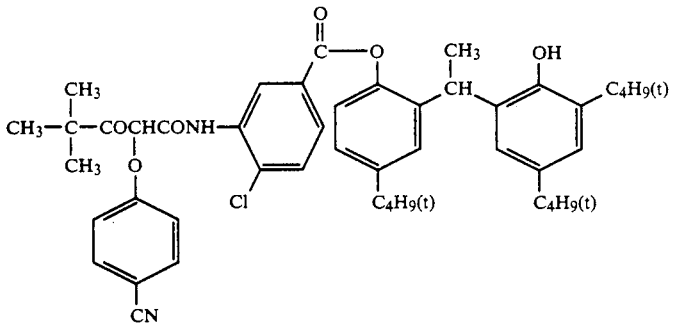
(Y-36)
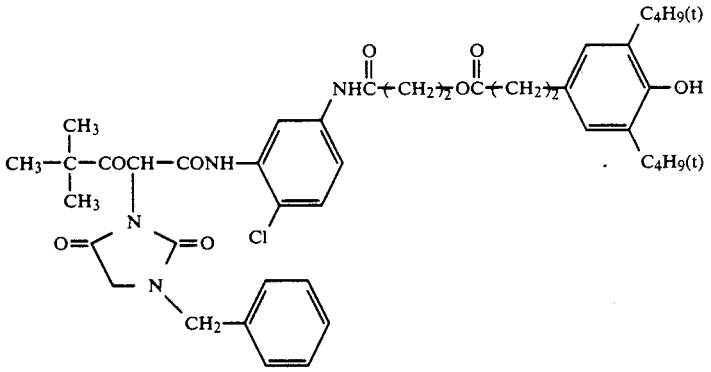
(M-1)
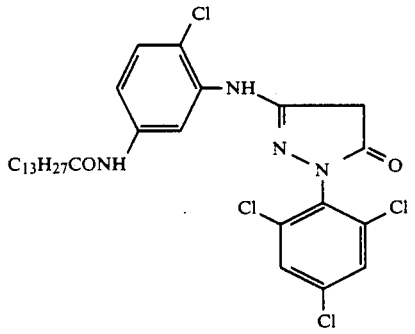

-continued
(M-2)
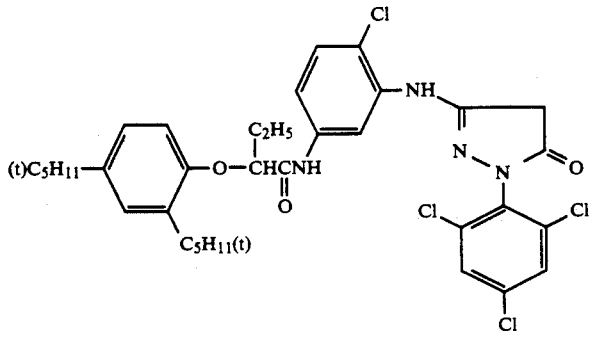
(M-3)
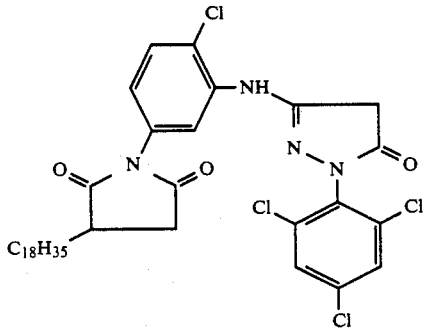
(M-4)
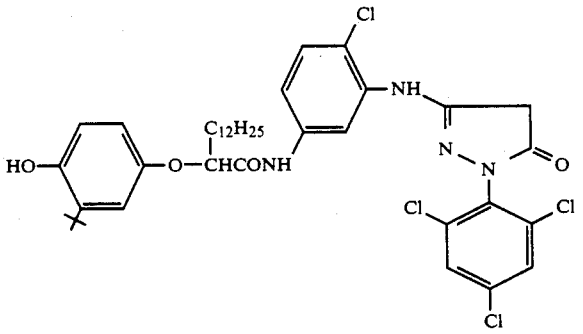
(M-5)
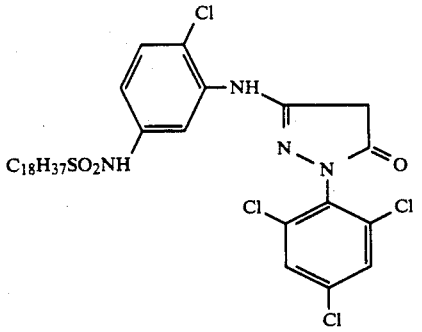
(M-6)
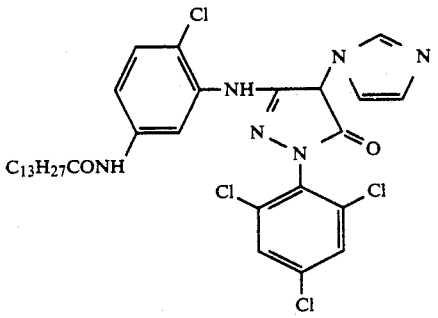

-continued
(M-7)
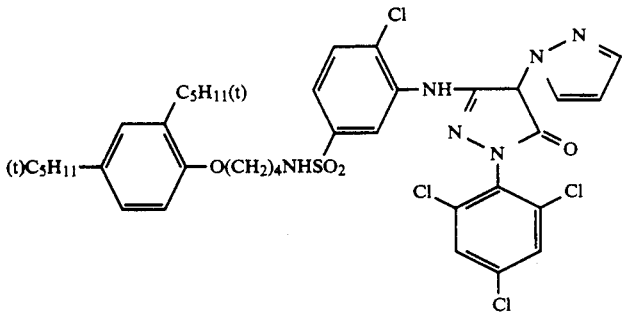
(M-8)
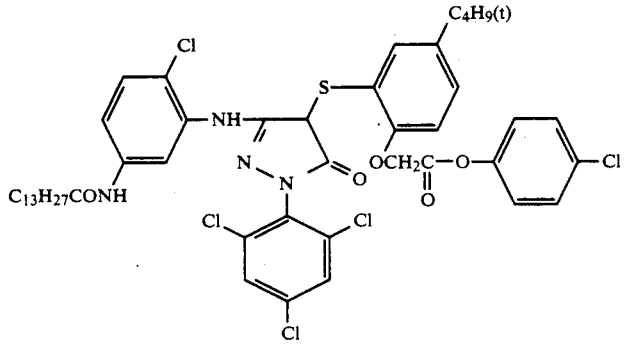
(M-9)
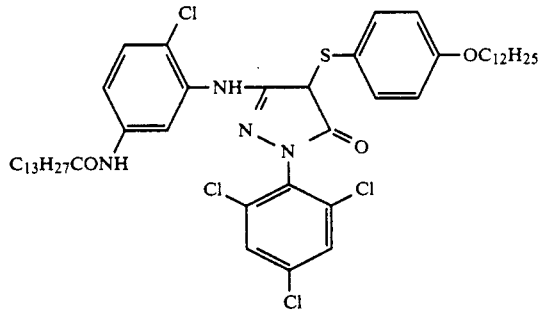
(M-10)
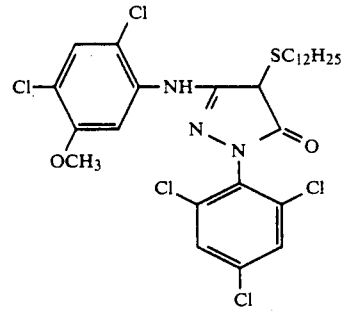
(M-11)
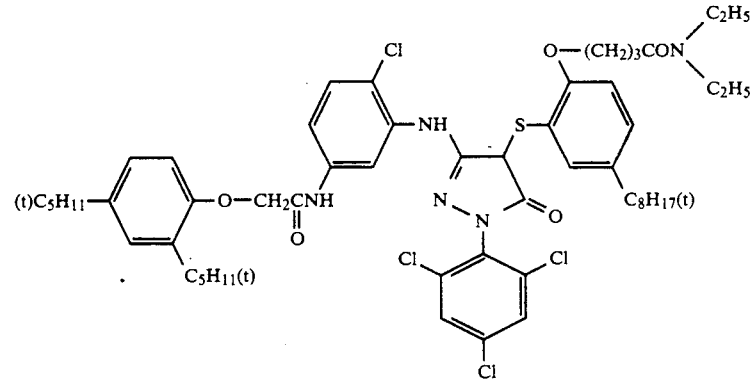

-continued
(M-12)
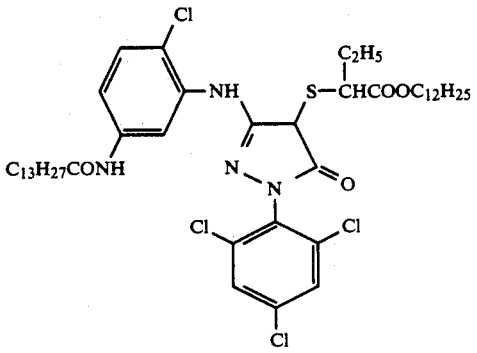
(M-13)
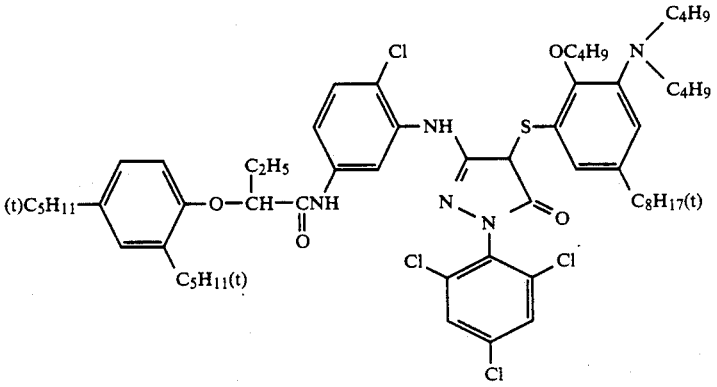
(M-14)
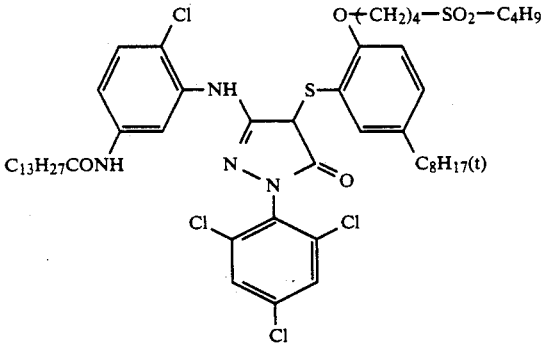
(M-15)
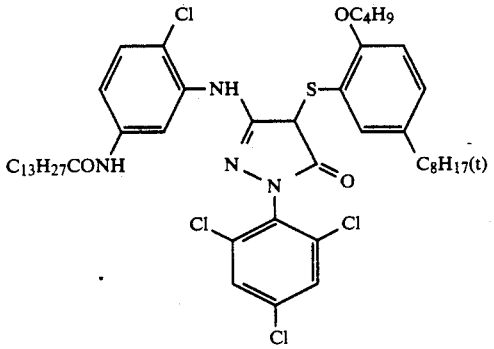

-continued
(M-16)
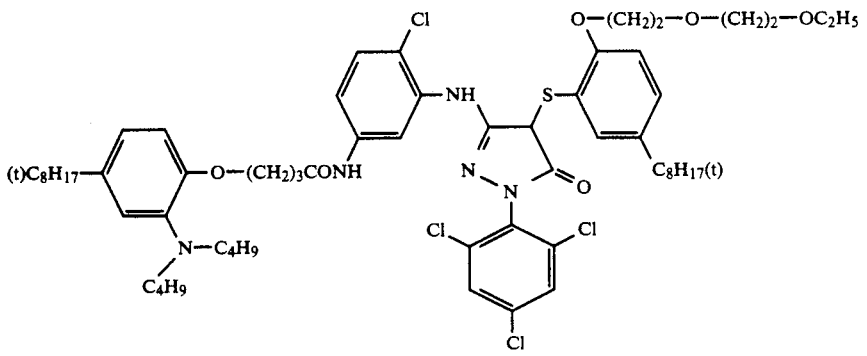
(M-17)
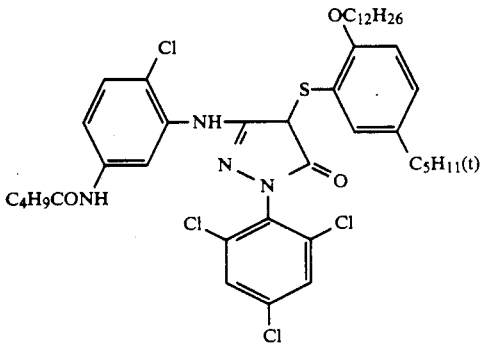
(M-18)
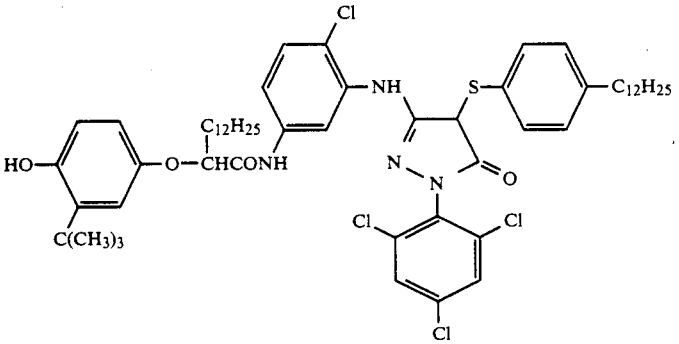
(M-19)
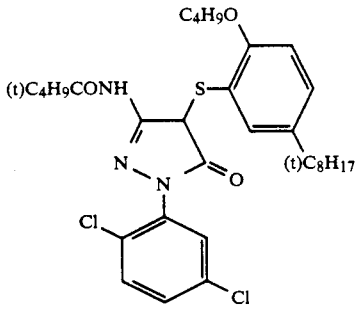
(M-20)
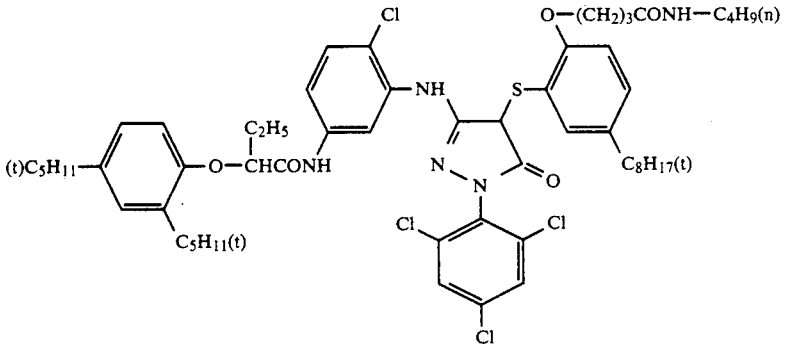

-continued
(M-21)
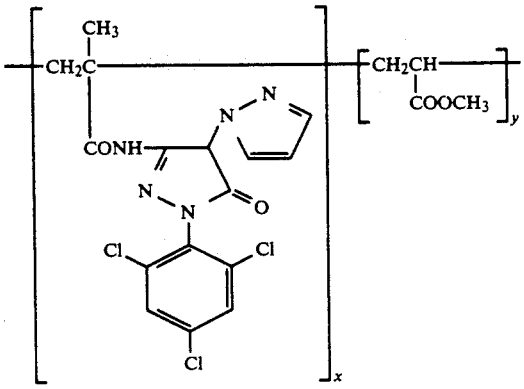
x/y = 60/40 (wt)
(M-22)
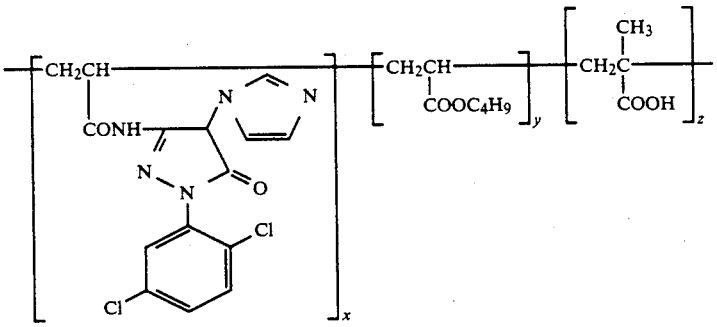
x/y/z = 45/45/10 (wt)
(M-23)
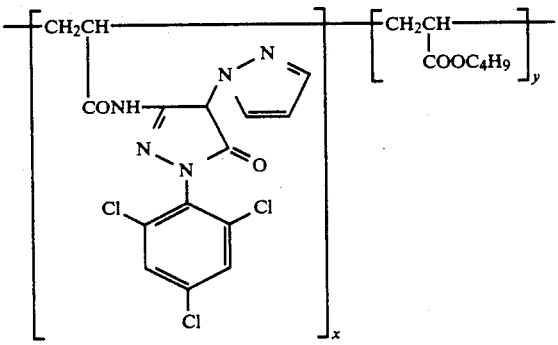
x/y = 50/50 (wt)

-continued
(M-24)
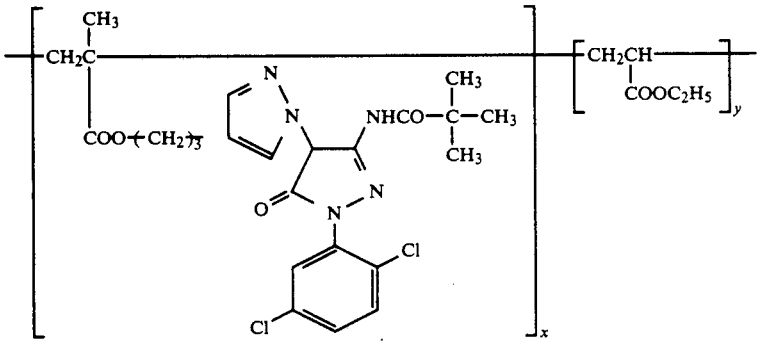
x/y = 60/40 (wt)
(M-25)
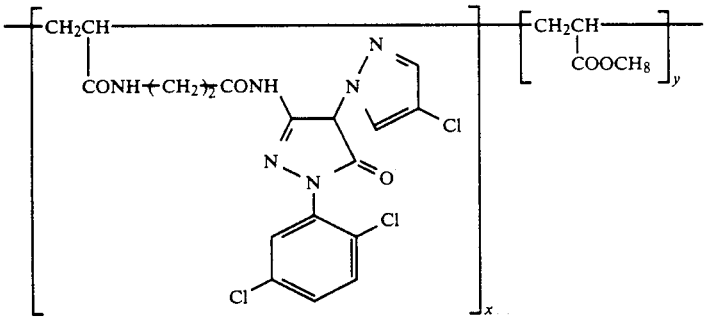
x/y = 50/50 (wt)
(M-26)
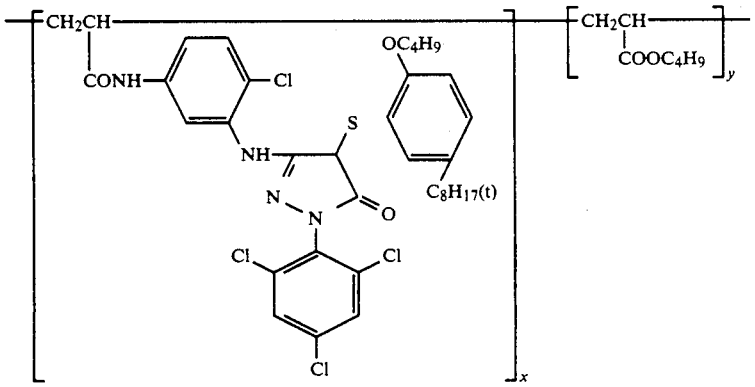
x/y = 50/50 (wt)

-continued
(M-27)
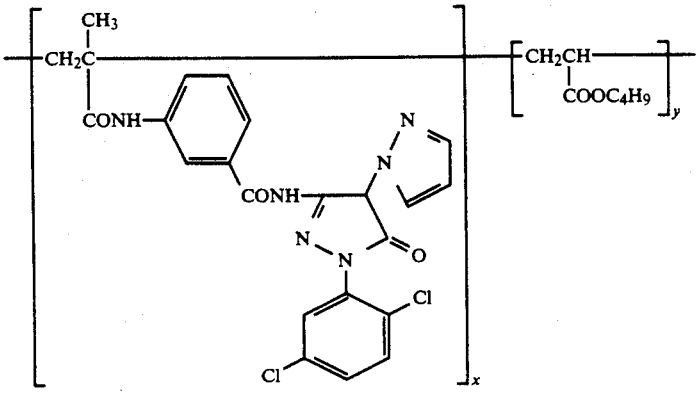
x/y = 55/45 (wt)
(M-28)
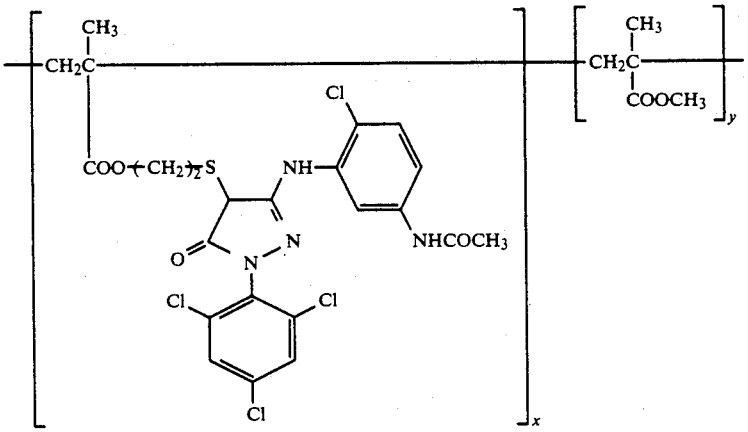
x/y = 45/55 (wt)
(M-29)
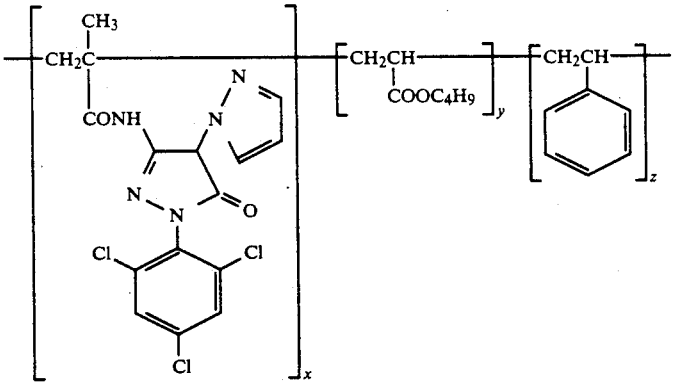
x/y/z = 50/25/25 (by weight)
[IVc]
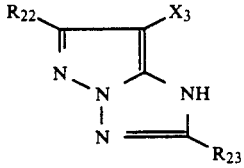
| Compound | $R_{22}$ | $R_{23}$ | $X_3$ |
|---|---|---|---|

-continued

[IVc]

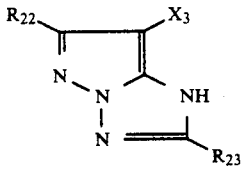

| | | | |
|---|---|---|---|
| M-30 | $CH_3$— | $-CH(CH_3)CH_2NHSO_2$—(2-$OC_8H_{17}$)—NH—$SO_2$—(2-$OC_8H_{17}$, 5-$C_8H_{17}$(t)) | Cl |
| M-31 | as above | $-CH(CH_3)CH_2NHSO_2$—(2-$OC_8H_{17}$, 5-$C_8H_{17}$(t)) | as above |
| M-32 | as above | $-CH(CH_3)CH_2NHSO_2$—(2-$OC_8H_{17}$, 5-$OC_8H_{17}$) | —O—(4-$CH_3$) |
| M-33 | (2-$OCH_3$)—O— | —(4)—$NHSO_2$—(2-$OC_8H_{17}$, 5-$C_8H_{17}$(t)) | —S—(2-$OC_8H_{17}$, 5-$C_8H_{17}$(t)) |
| M-34 | $CH_3$ | $-CH(CH_3)CH_2NHSO_2$—(2-$OC_2H_4OC_2H_5$)—NH—$SO_2$—(2-$OC_8H_{17}$, 5-$C_8H_{17}$(t)) | Cl |

| Compound | $R_{33}$ | $R_{34}$ | $X_2$ |
|---|---|---|---|
| M-35 | $CH_3$— | $-C(CH_3)_2CH_2NHSO_2$—(2-$OC_8H_{17}$)—NH—$SO_2$—(2-$OC_8H_{17}$, 5-$C_8H_{17}$) | Cl |
| M-36 | —(4)—$OCH_2CH_2O$— | —(2)—O—(2-$OCH_3$)—$CH_2CH_2NHSO_2$—(2-$OC_8H_{17}$)—NH—$SO_2$—(2-$OC_8H_{17}$, 5-$C_8H_{17}$(t)) | —S—(2-$OC_4H_9$, 5-$C_8H_{17}$(t)) |
| M-37 | $CH_3CH_2O$— | as above | as above |
| M-38 | (2-$QC_8H_{17}$, 5-$C_8H_{17}$(t))—$SO_2NH$—(4)—$O(CH_2)_2O$— | —(2)—Cl, (5)—Cl | as above |

-continued
[IVc]
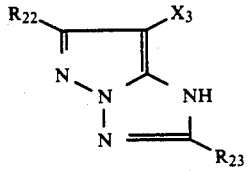
| | | | |
|---|---|---|---|
| M-39 | 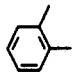 | 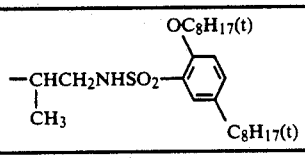 | Cl |
| Compound | $R_{22}$ | $R_{23}$ | $X_3$ |
|---|---|---|---|
| M-40 | $CH_3$— | 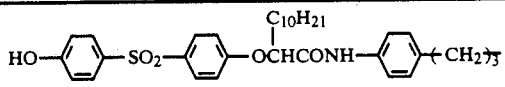 | Cl |
| M-41 | as above | 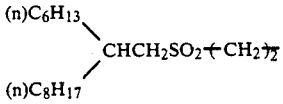 | as above |
| M-42 | 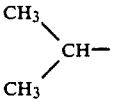 | 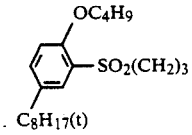 | as above |
| M-43 | 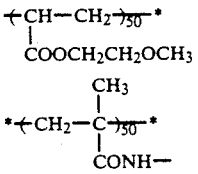 | 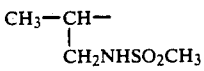 | as above |
| M-44 | 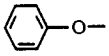 | 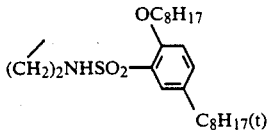 | Cl |
| M-45 | 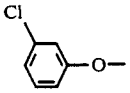 | 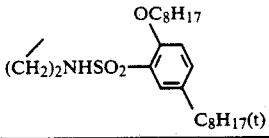 | 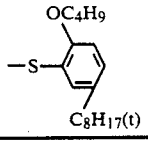 |
"*" means where the group are linked.
(c-1)
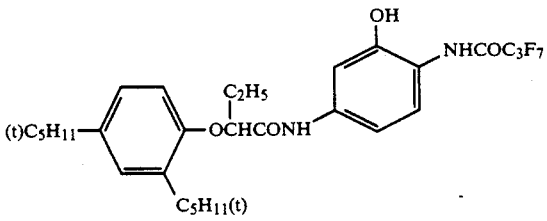
(c-2)
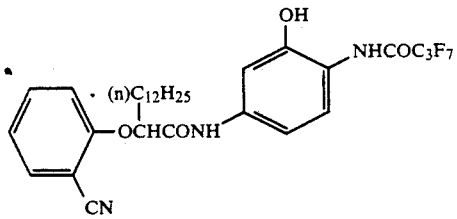

-continued
(c-3)
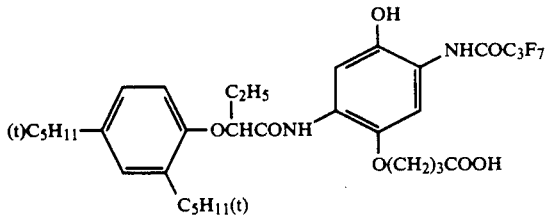
(c-4)
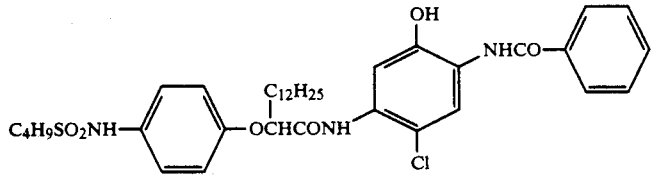
(c-5)
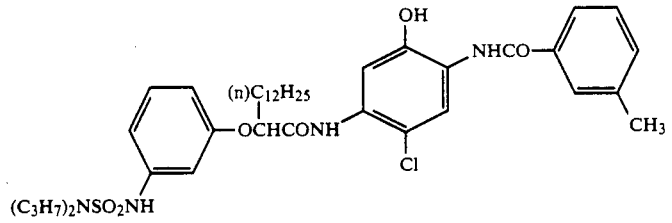
(c-6)
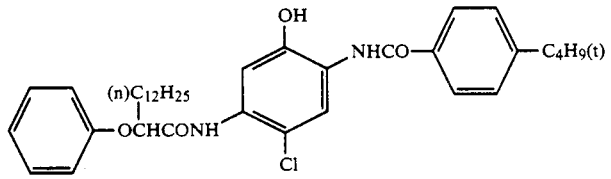
(c-7)
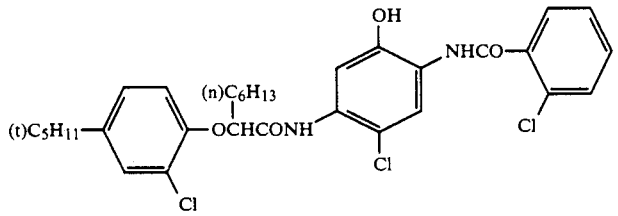
(c-8)
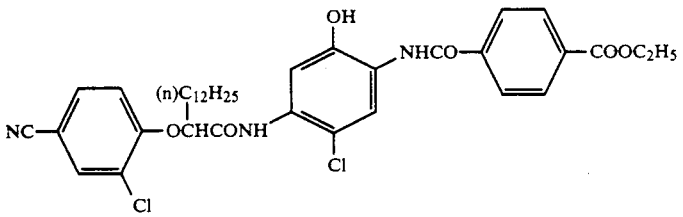
(c-9)
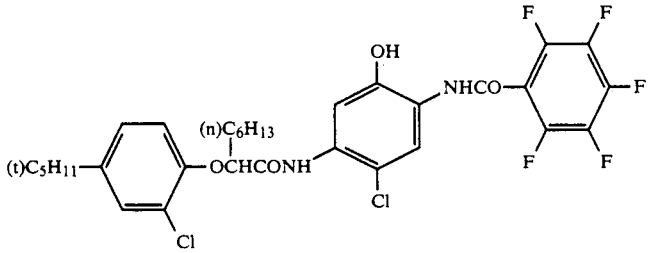

-continued
(c-10)
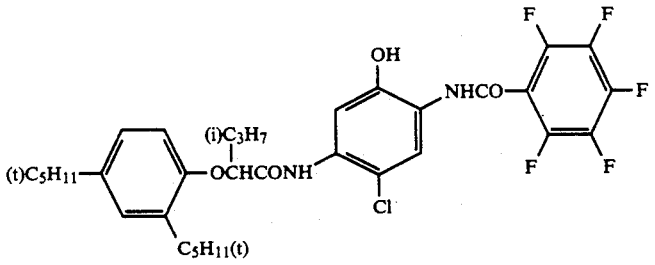
(c-11)
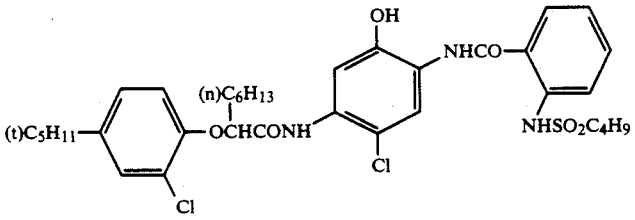
(c-12)
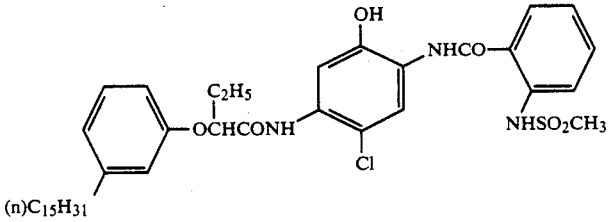
(c-13)
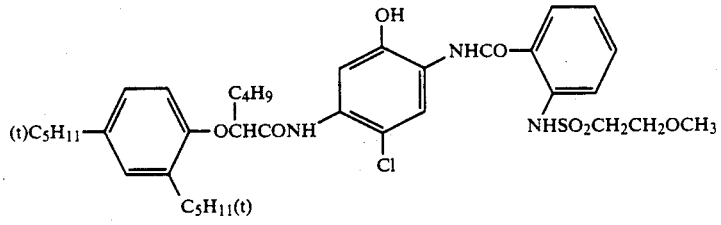
(c-14)
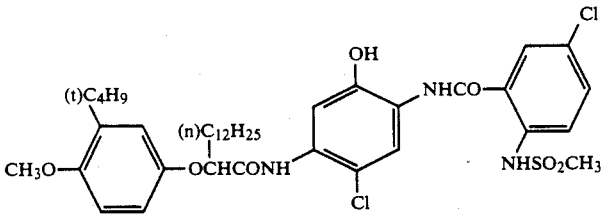
(c-15)
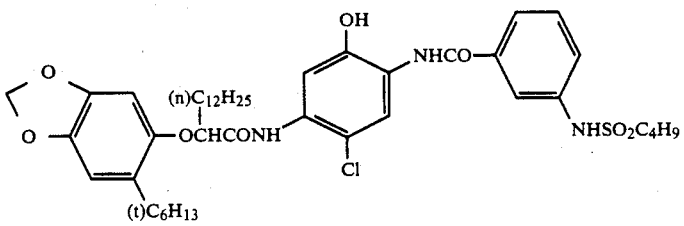
(c-16)
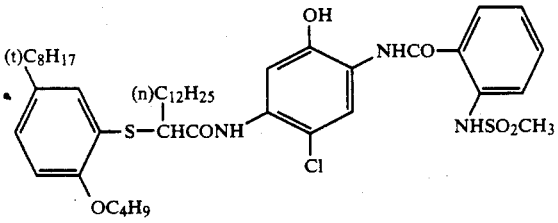

-continued
(c-17)
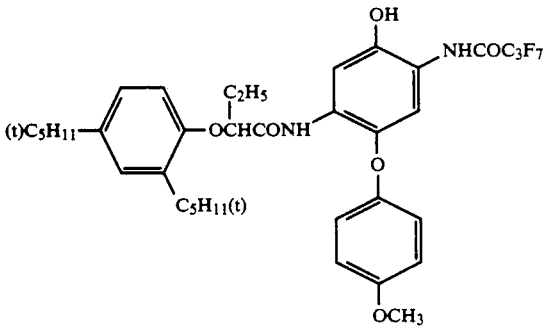
(c-18)
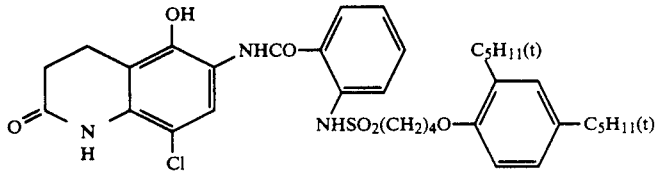
(c-19)
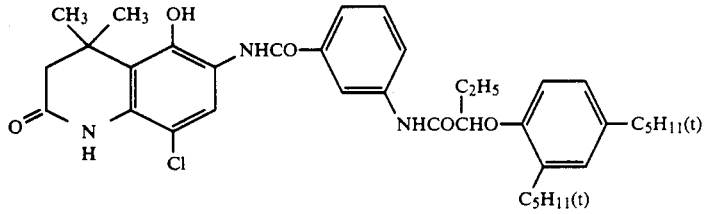
(c-20)
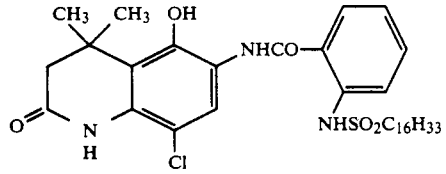
(c-21)
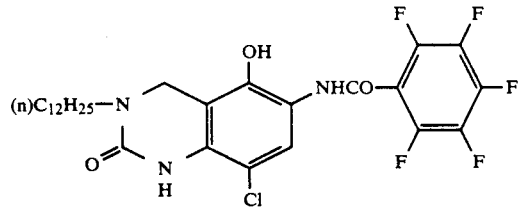
(c-22)
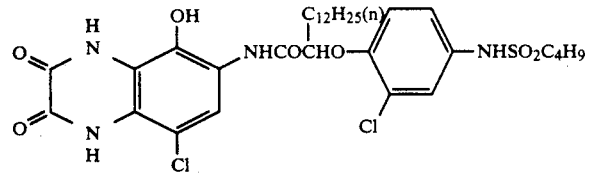
(c-23)
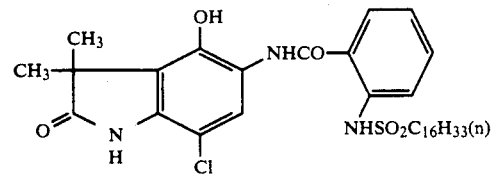

-continued
(c-24)
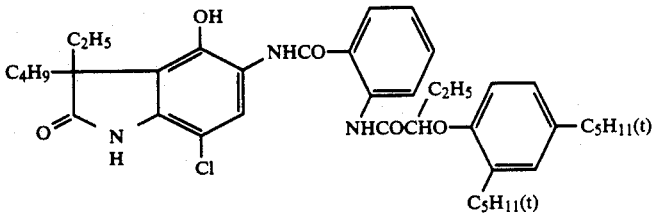
(c-25)
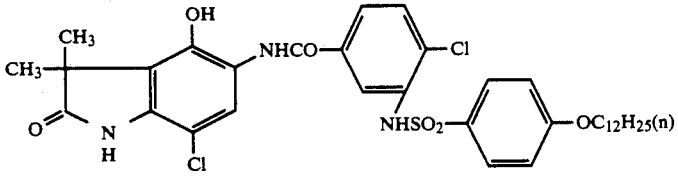
(c-26)
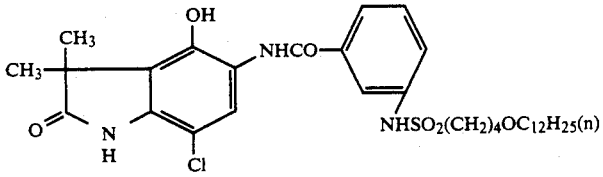
(c-27)
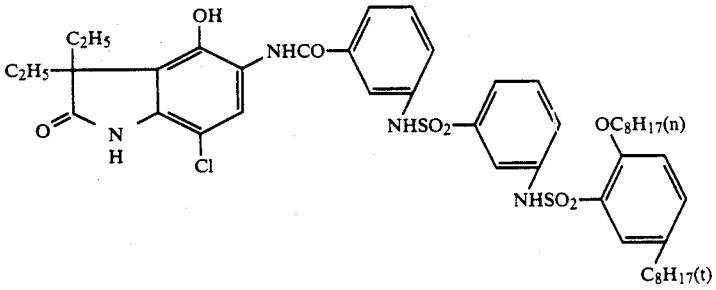
(c-28)
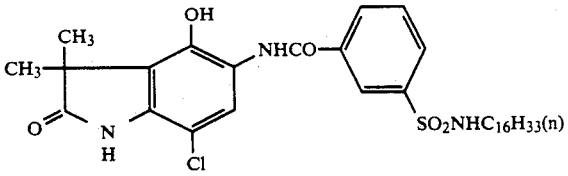
(c-29)
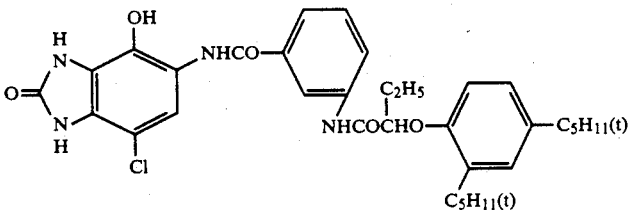
(c-30)
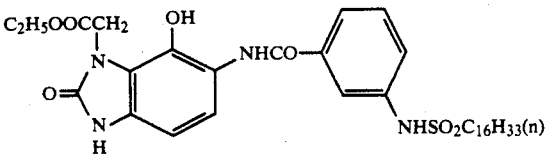
(c-31)
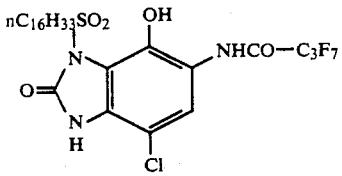

-continued
(c-32)
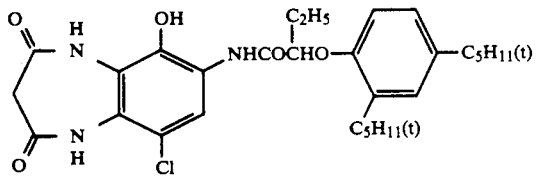
(c-33)
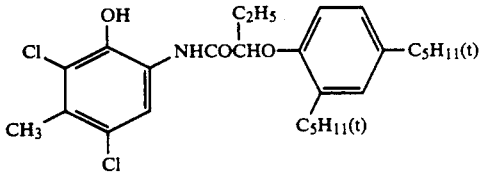
(c-34)
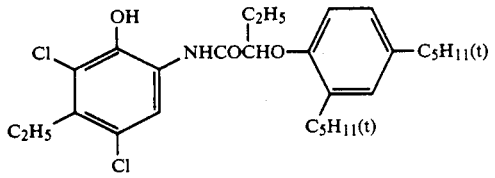
(c-35)
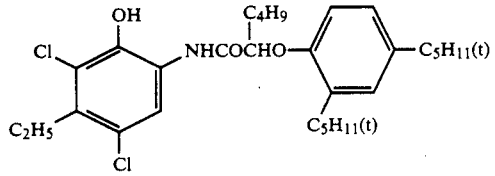
(c-36)
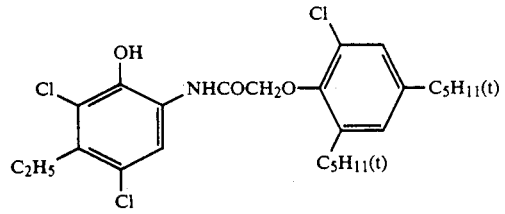
(c-37)
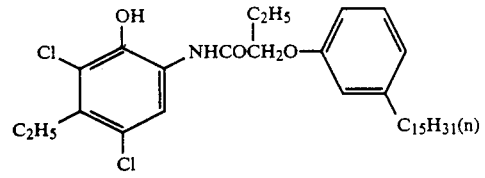
(c-38)
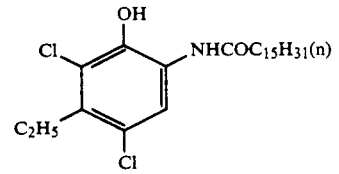
(c-39)
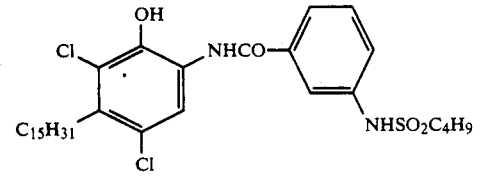

-continued
(c-40)
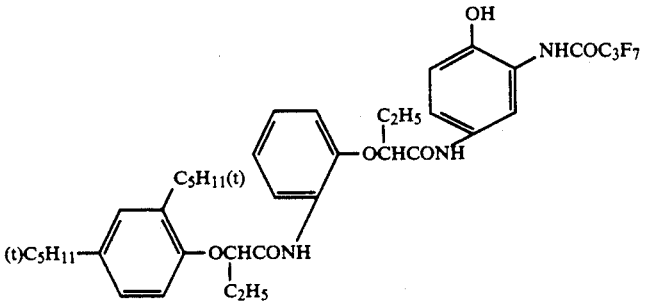
(c-41)
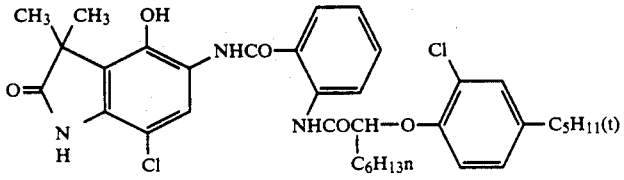
(c-42)
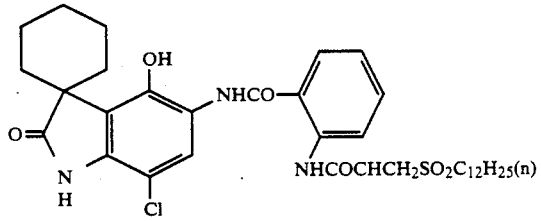
(c-43)
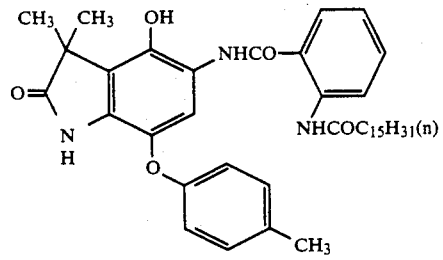
(c-44)
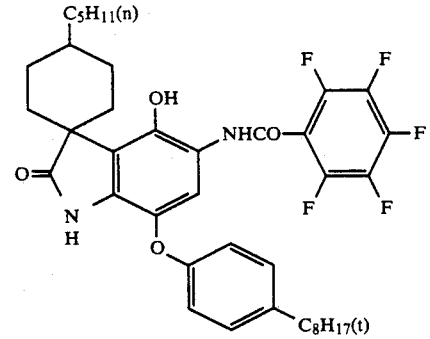
(c-45)
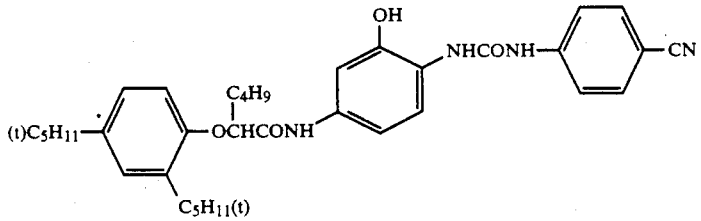

-continued
(c-46)
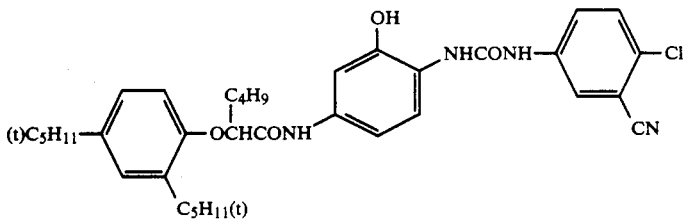
(c-47)
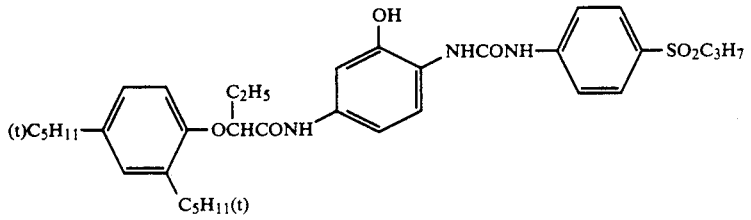
(c-48)
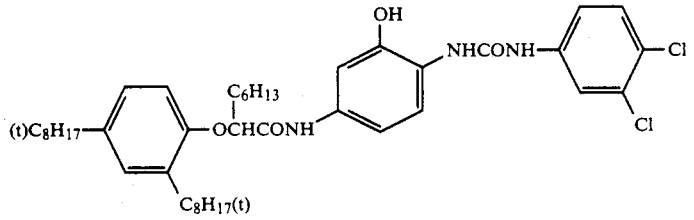
(c-49)
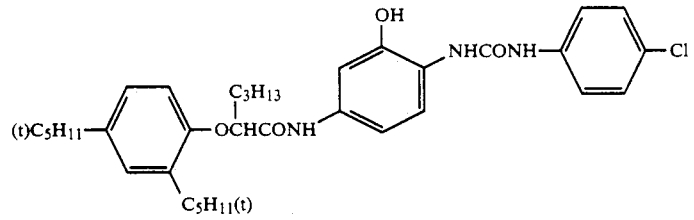
(c-50)
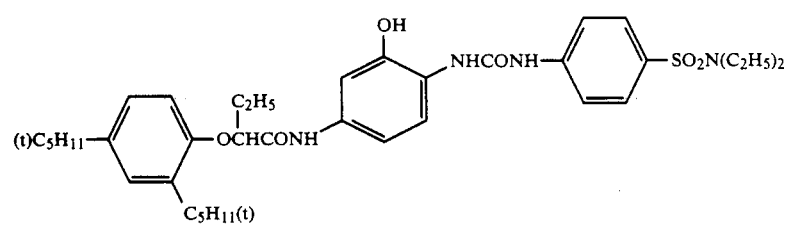
(c-51)
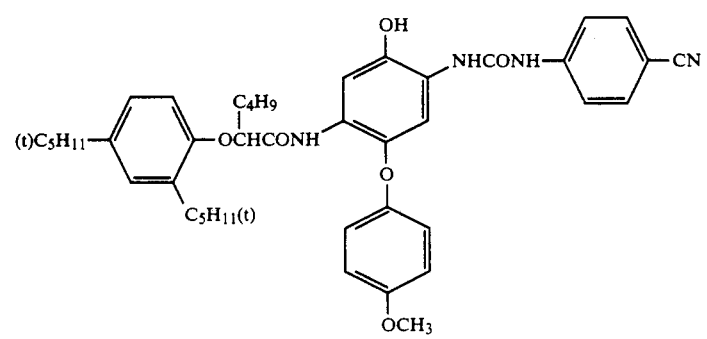

-continued
(c-52)
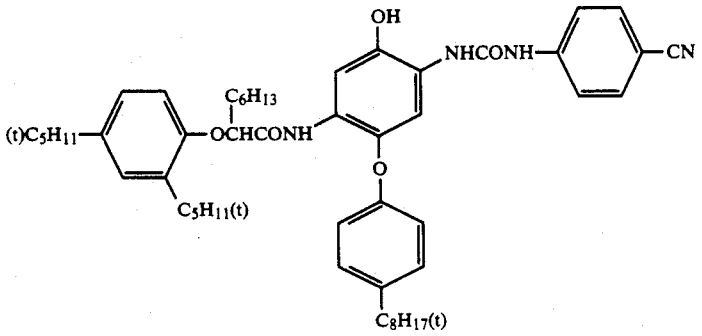
(c-53)
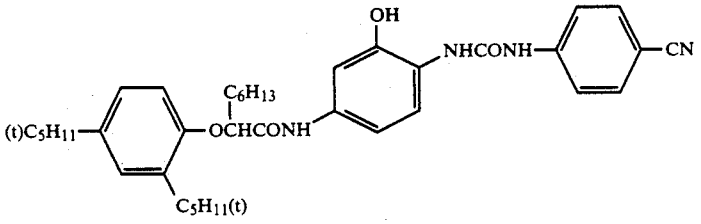
(c-54)
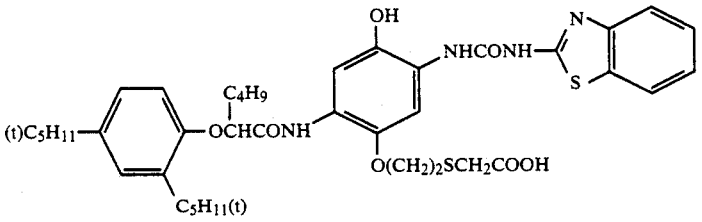
(c-55)
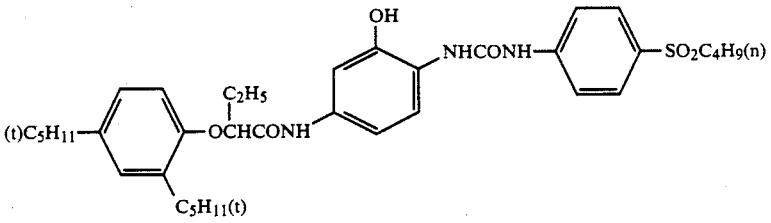
(c-56)
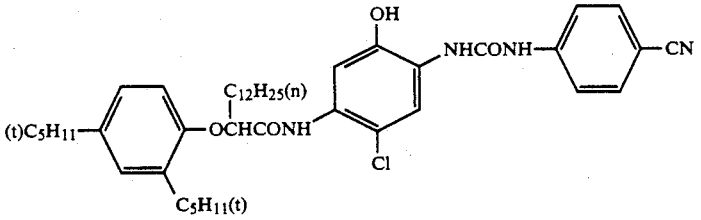
(c-57)
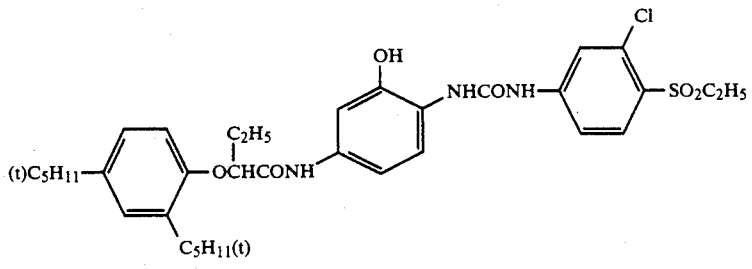

-continued
(c-58)
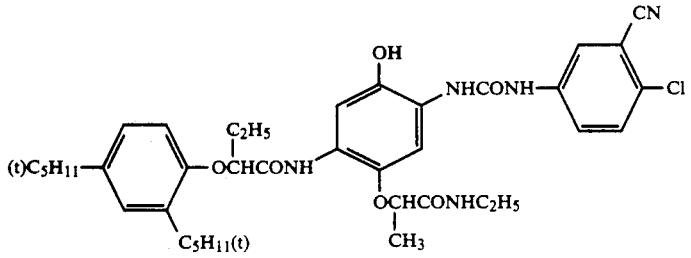
(c-59)
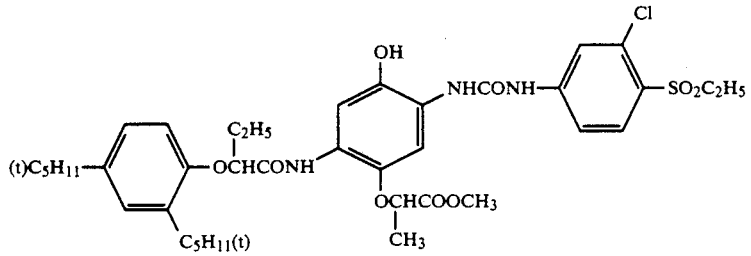
(c-60)
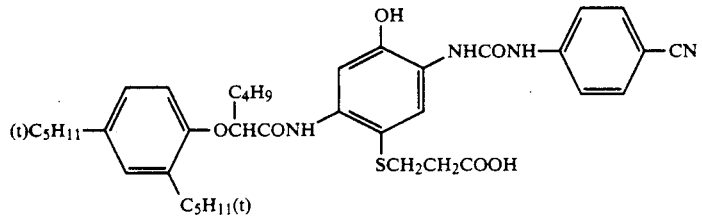
(c-61)
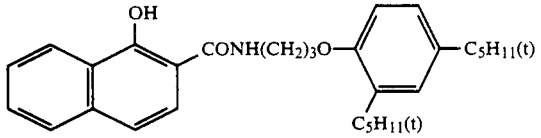
(c-62)
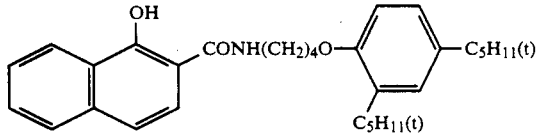
(c-63)
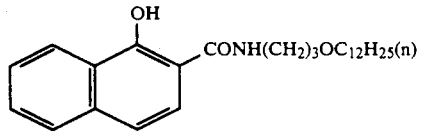
(c-64)
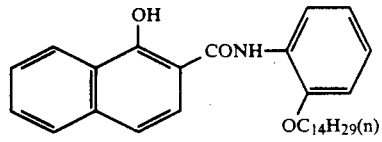
(c-65)
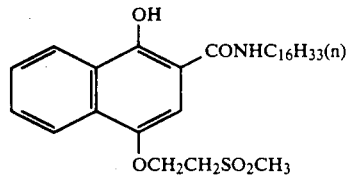

-continued
(c-66)
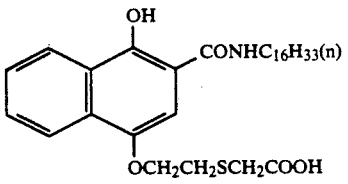
(c-67)
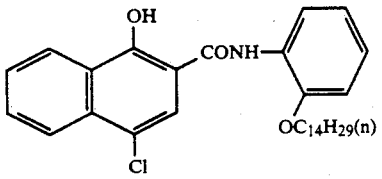
(c-68)
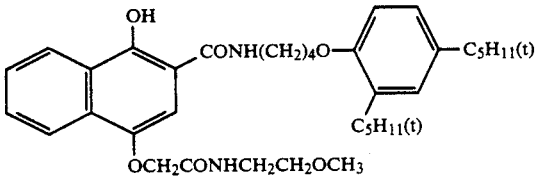
(c-69)
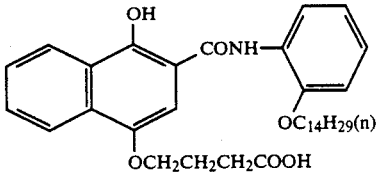
(c-70)
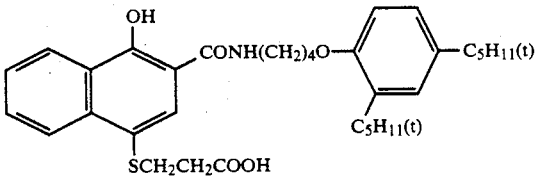
(c-71)
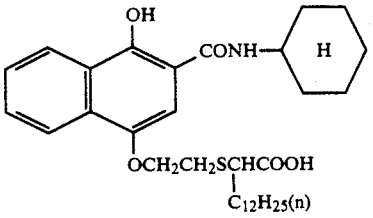
(c-72)
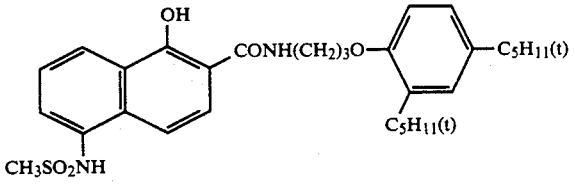
(c-73)
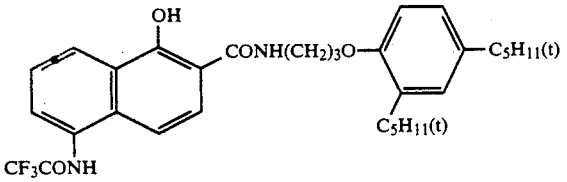

-continued
(c-74)
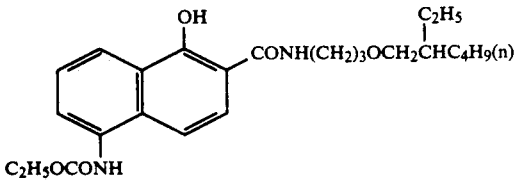
(c-75)
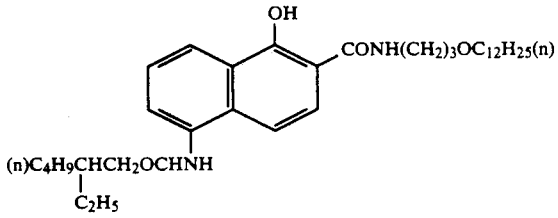
(c-76)
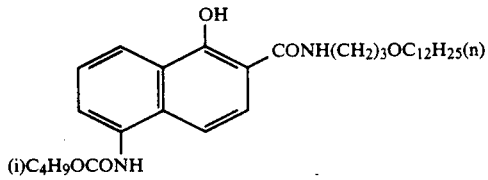
(c-77)
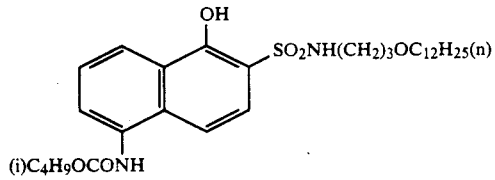
(c-78)
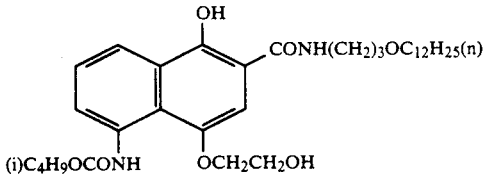
(c-79)
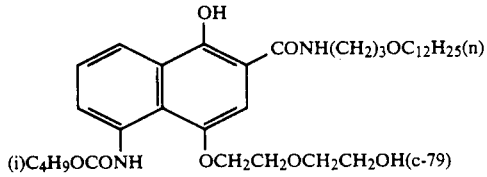
(c-80)
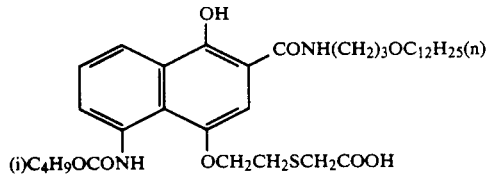
(c-81)
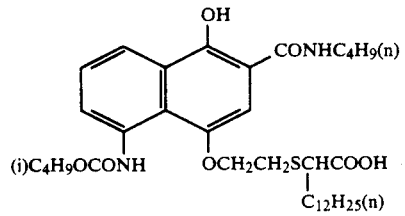
(c-82)
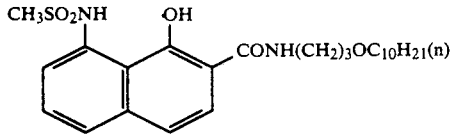

-continued
(c-83)
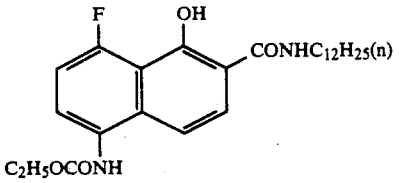
(c-84)
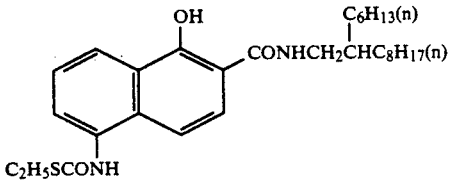
(c-85)
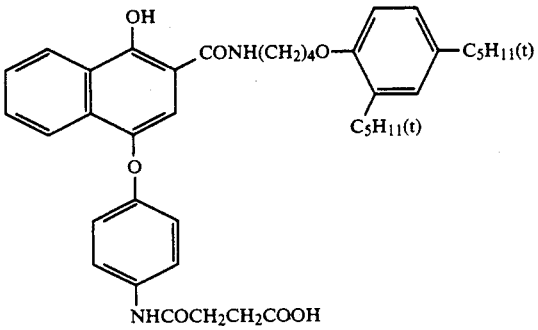
(c-86)
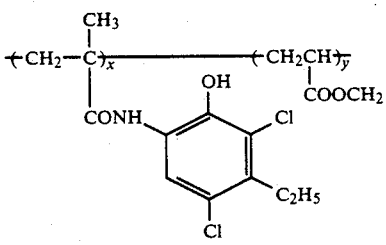
x/y = 50/50 (by weight)
(c-87)
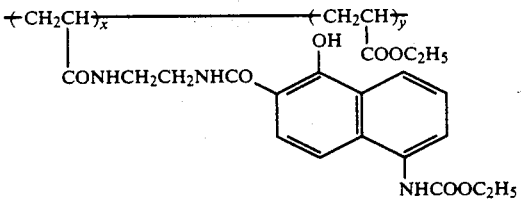
x/y = 55/45 (by weight)
(c-88)
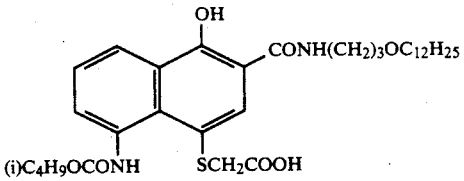
(c-89)
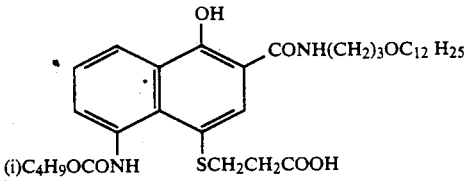

-continued (c-90)

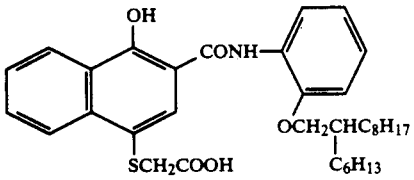

The compounds represented by the general formula [I]of this invention can be used for the emulsification and dispersion of ultraviolet absorbers which are one type of photographically useful reagent. The benzotriazoles substituted with aryl groups disclosed in U.S. Pat. Nos. 3,553,794 and 4,236,013, JP-B-51-6540 and European Patent 57,160, etc., the butadienes disclosed in U.S. Pat. Nos. 4,450,229 and 4,195,999, the cinnamic acid esters disclosed in U.S. Pat. Nos. 3,705,805 and 3,707,375, the benzophenones disclosed in U.S. Pat. No. 3,215,530 and British Patent 1,321,355, and the polymeric compounds which have ultraviolet absorbing residual groups as disclosed in U.S. Pat. Nos. 3,761,272 and 4,431,726 can be dispersed as ultraviolet absorbers. The brightening agents which have ultraviolet absorbing properties disclosed in U.S. Pat. Nos. 3,499,762 and 3,700,455 can also be dispersed. Other typical examples of ultraviolet absorbers have been disclosed in *Research Disclosure* No. 24239 (June 1984).

Examples of ultraviolet absorbers which can be used in the invention are indicated below.

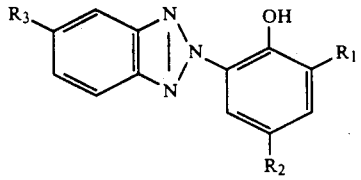

| | $R_1$ | $R_2$ | $R_3$ |
|---|---|---|---|
| (UV-1) | $C_5H_{11}$(t) | $C_5H_{11}$(t) | H |
| (UV-2) | $C_5H_{11}$(t) | $C_8H_{17}$(t) | H |
| (UV-3) | H | $C_4H_9$(t) | H |
| (UV-4) | $C_4H_9$(t) | $CH_3$ | Cl |
| (UV-5) | $C_4H_9$(t) | $C_4H_9$(t) | H |
| (UV-6) | $C_4H_9$(t) | $C_4H_9$(t) | Cl |
| (UV-7) | $C_4H_9$(sec) | $C_4H_9$(t) | H |
| (UV-8) | $C_4H_9$ | $CH_2CH_2COOC_8H_{17}$ | Cl |
| (UV-9) | H | $CH_3$ | H |

(UV-10)

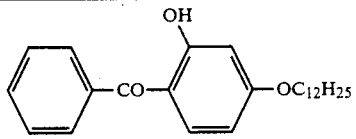

(UV-11)

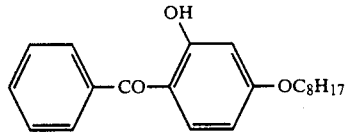

(UV-12)

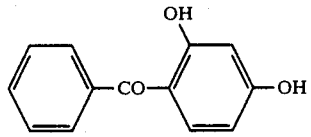

(UV-13)

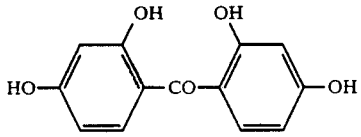

(UV-14)

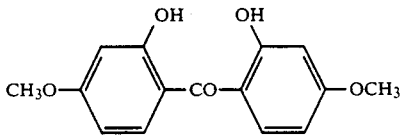

-continued
(UV-15)
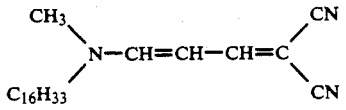
(UV-16)
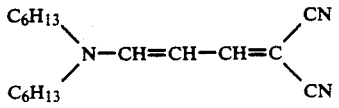
(UV-17)
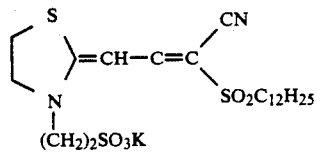
(UV-18)
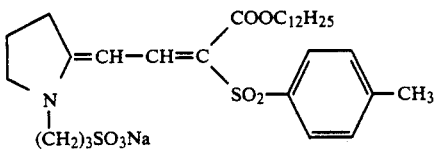
(UV-19)
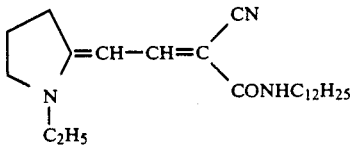
(UV-20)
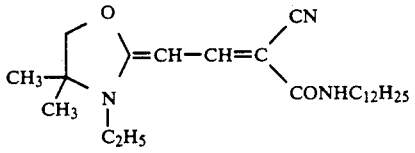
(UV-21)
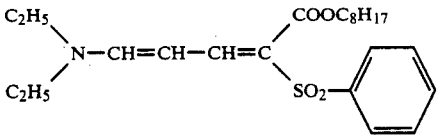
(UV-22)
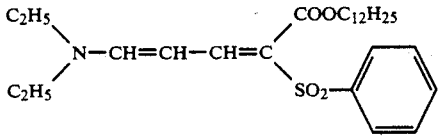
(UV-23)
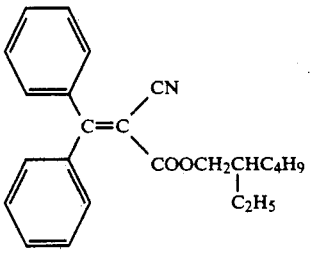
(UV-24)
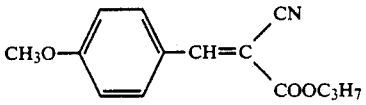

-continued (UV-25)

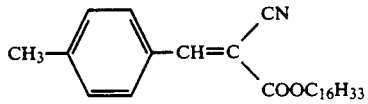

(UV-26)

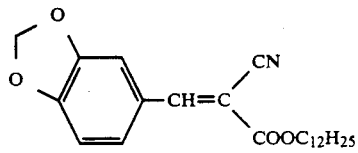

(UV-27)

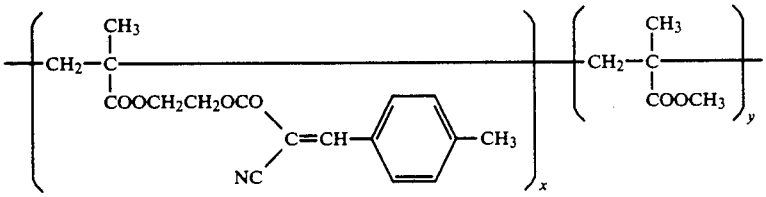

x/y = 70/30 (wt)

(UV-28)

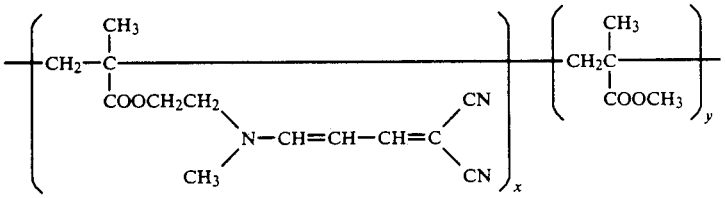

x/y = 60/40 (wt)

(UV-29)

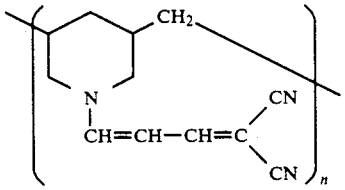

This invention can also be used with the organic and metal complex based anti-color fading agents and anti-color mixing agents which are used to improve the storage properties of a colored dye image, to prevent the occurrence of stain on the background, and to prevent the mixing of colors in different layers.

Typical examples of these compounds include hydroquinones, 6-hydroxychromans, 5-hydroxycoumarans, spirochromans, spiroindanes, p-alkoxyphenols, hindered phenols centered on bisphenols, gallic acid derivatives, methylenedioxybenzenes, aminophenols, hindered amines, ether and ester derivatives in which the phenolic hydroxyl groups of these compounds have been silylated, acylated or alkylated, and metal complexes are also included.

Actual examples of these compounds have been disclosed in the patents indicated below.

Hydroquinones: U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801 and 2,816,028, etc.; 6-hydroxychromans, 5-hydroxycoumarans and spirochromans: U.S. Pat. Nos. 3,432,300, 3,573,050, 3,574,627, 3,698,909 and 3,764,337, and JP-A-52-152225, etc.; spiroindanes: U.S. Pat. No. 4,360,589; p-alkoxyphenols: U.S. Pat. No. 2,735,765, British Patent 2,066,975(B), JP-A-59-10539 and JP-B-5719764, etc.; hindered phenols: U.S. Pat. No. 3,700,455, JP-A-52-72225, U.S. Pat. No. 4,228,235, JP-B-52-6623, etc.; gallic acid derivatives, methylene dioxybenzenes and aminophenols: respectively, in U.S. Pat. Nos. 3,457,079 and 4,332,886 and JP-B-56-21144, etc.; hindered amines: U.S. Pat. Nos. 3,336,135 and 4,268,593, British Patents 1,326,889, 1,345,313 and 1,410,846, JP-B-51-1420, and JP-A-58-114036, JP-A-59-53846 and JP-A-59-78344, etc.; ether and ester derivatives of phenolic hydroxyl groups: U.S. Pat. Nos. 4,155,765, 4,147,220, 4,254,216 and 4,264,720, JP-A-54-145530, JP-A-55-6321, JP-A-58-105147 and JP-A-59-10539, JP-B-57-37856, U.S. Pat. No. 4,279,990, and JP-B-53-3263, etc.; metal complexes: U.S. Pat. Nos. 4,050,938 and 4,241,155, and British Patent 2,027,731(A).

Examples of these anti-color fading agents and anti-color mixing agents are indicated below.

(A-1)
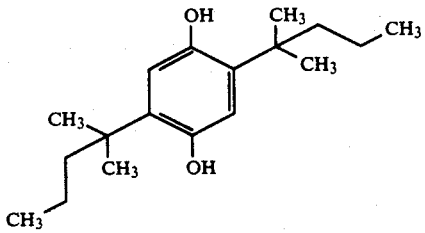
(A-2)
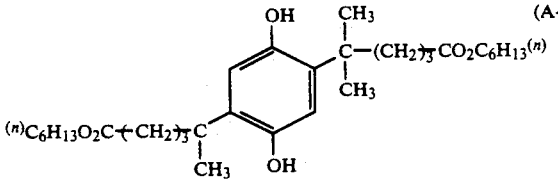
(A-3)
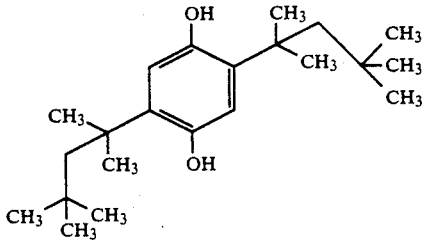
(A-4)
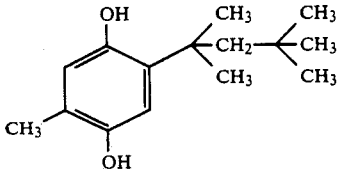
(A-5)
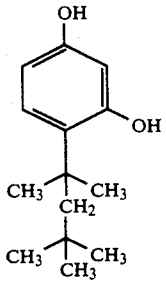
(A-6)
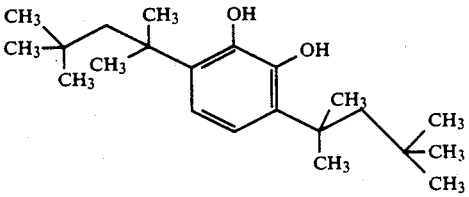
(A-7)
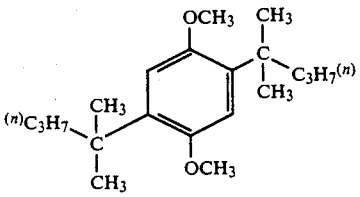
-continued
(A-8)
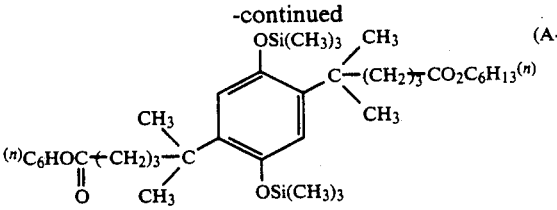
(A-9)
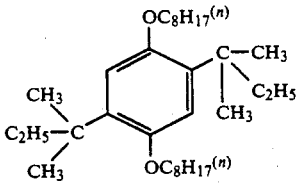
(A-10)
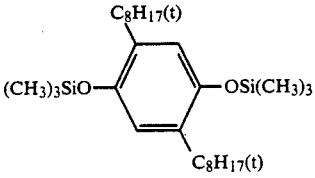
(A-11)
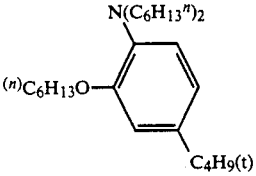
(A-12)
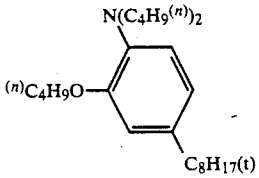
(A-13)
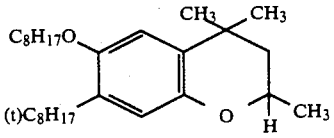
(A-14)
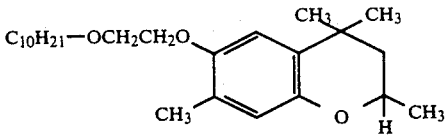
(A-15)
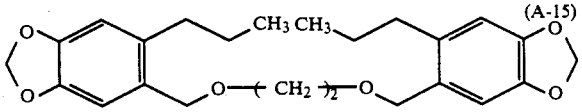
(A-16)
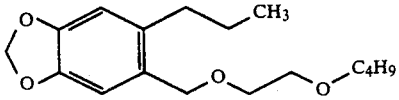
(A-17)
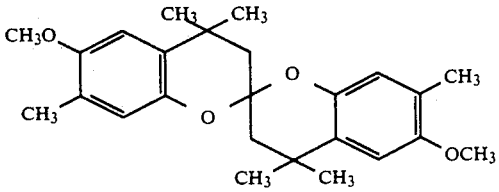

-continued
(A-18)
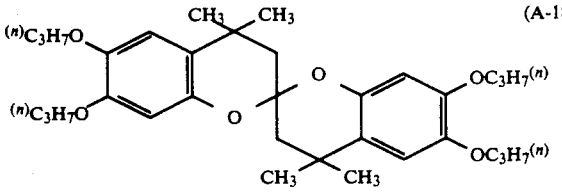
(A-19)
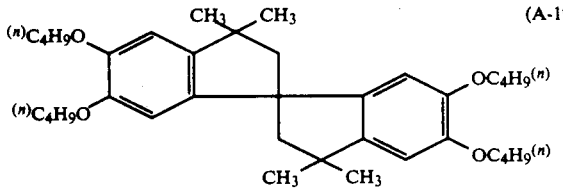
(A-20)
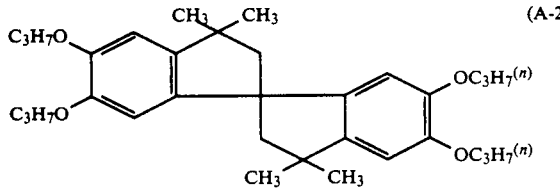
(A-21)
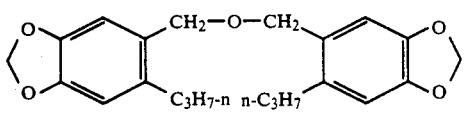
(A-22)
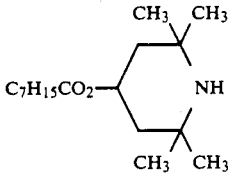
(A-23)
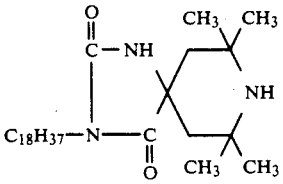
(A-24)
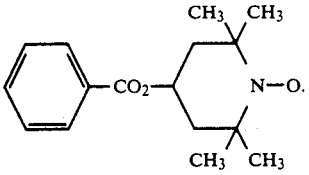
(A-25)
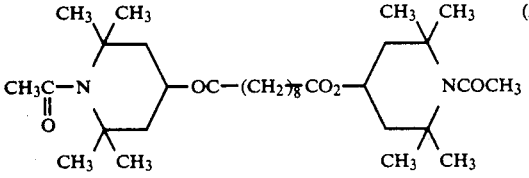
(A-26)
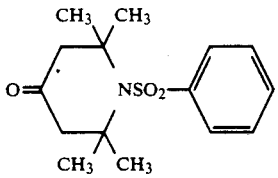
-continued
(A-27)
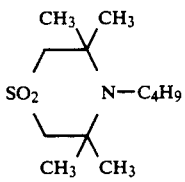
(A-28)
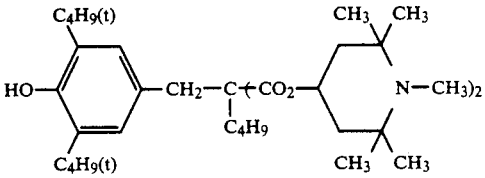
(A-29)
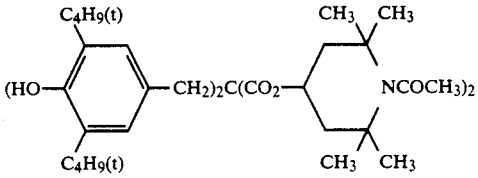
(A-30)
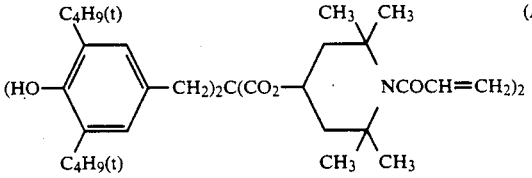
(A-31)
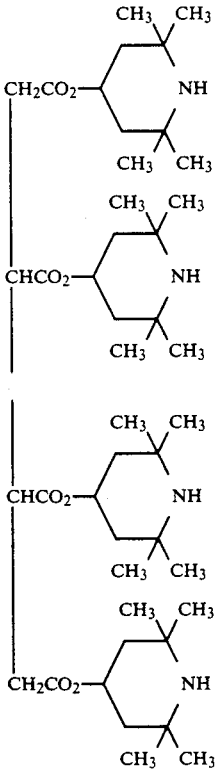
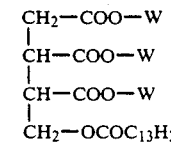

-continued
(A-32)
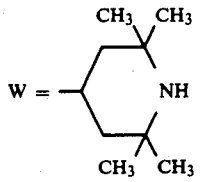
(A-33)
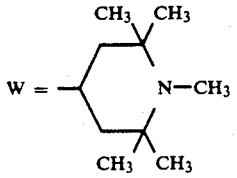
(A-34)
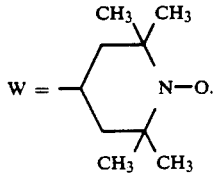
(A-35)
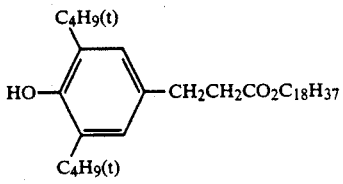
(A-36)
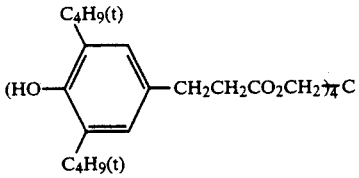
(A-37)
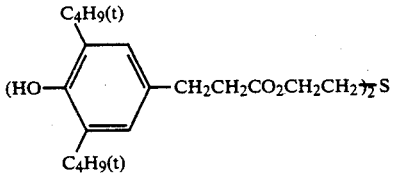
(A-38)
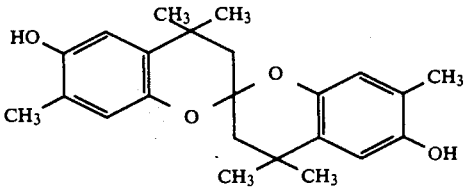
(A-39)
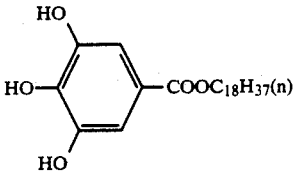
(A-40)
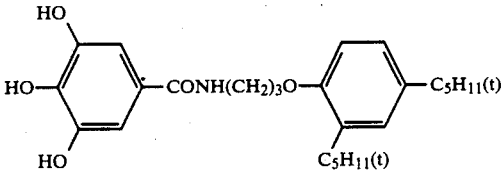
-continued
(A-41)
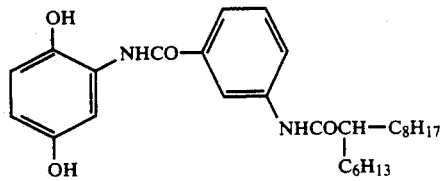
(A-42)
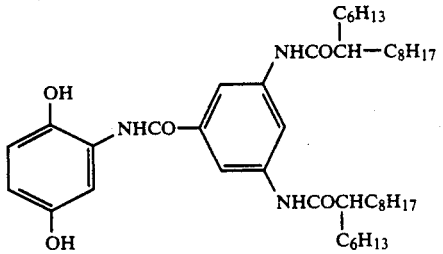
(A-43)
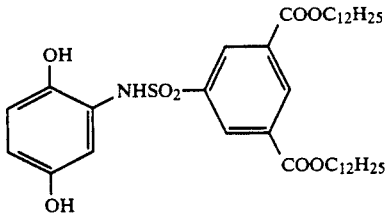
(A-44)
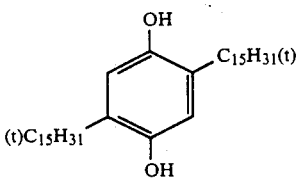
(A-45)
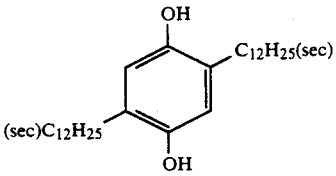
(A-46)
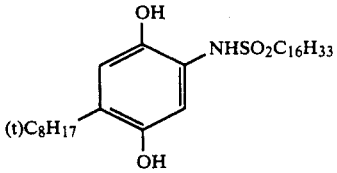
(A-47)
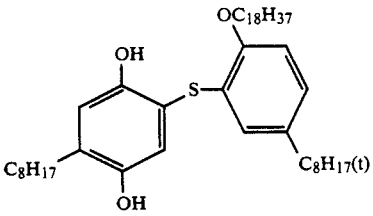
(A-48)
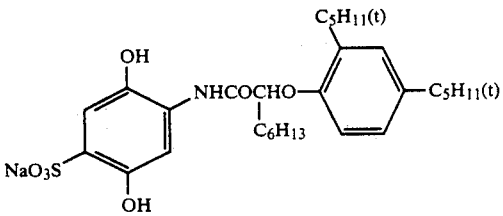

-continued (A-49)

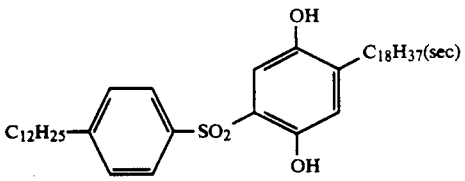

(A-50)

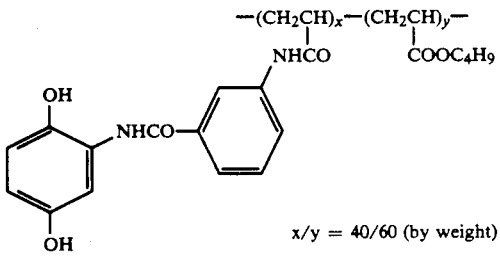

x/y = 40/60 (by weight)

(A-51)

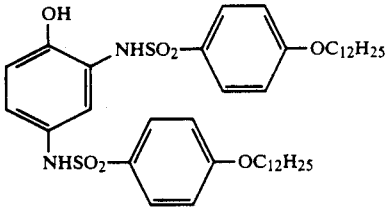

(A-52)

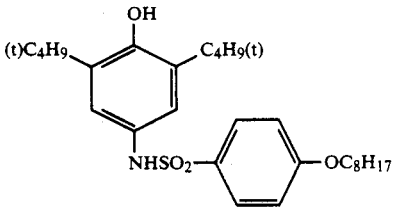

(A-53)

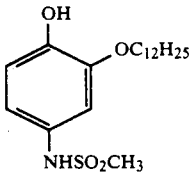

(A-54)

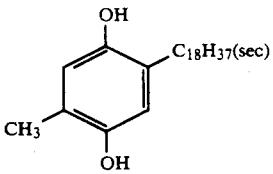

(A-55)

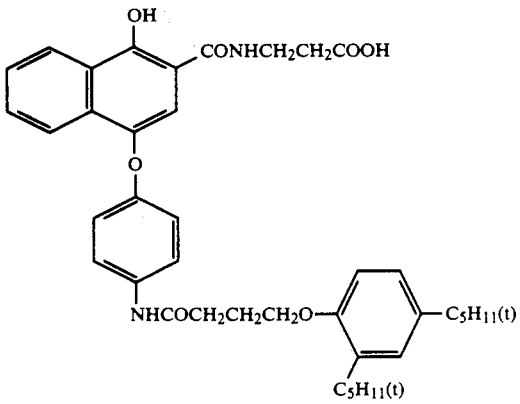

-continued (A-56)

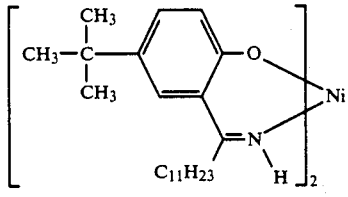

(A-57)

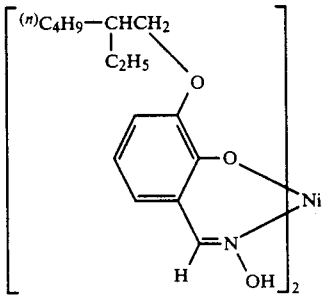

(A-58)

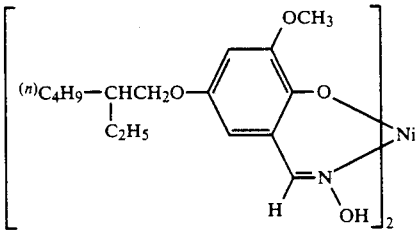

In this invention, it is preferred that the compounds as described below are used together with the aforementioned couplers for further inhibiting the occurrence of stain after the development processing. Particularly, it is preferred that the compounds are used together with pyrazoloazole couplers.

That is, it is preferred that a compound (F) that can combine chemically with the aromatic amine developing agent remaining after the color development processing to produce a chemically inactive and substantially colorless compound, and/or a compound (G) that can combine chemically with the oxidation product of the aromatic amine developing agent remaining after the color development processing to produce a chemically inactive and substantially colorless compound are used singly or in combination with each other in order to prevent the side effect such as the occurrence of stain resulting from the coloring dye formed by reaction of couples with color developing agents or the oxidation products thereof remaining in the layers during preservation after processing.

The preferred examples of the compound (F) are compounds that can react with the rate constant k2 (at 80° C. in trioctyl phosphate) of the secondary reaction with p-anisidine within the range of 1.0 l/mol. sec. to $1\times 10^{-5}$ l/mol. sec. the rate constant of the secondary reaction can be measured according to the method as described in JP-A 63 158545.

If the $k_2$ is too great the compounds themselves become unstable and react with gelatin and water to decompose. On the other hand, if the $k_2$ is too small the reaction of the compounds with the remaining aromatic amine developing agents is slow, and as a result the side effect of the remaining aromatic amine developing agents that the invention intends to obviate cannot be prevented.

Of such compounds (F), preferable ones can be represented by the following general formula (FI) or (FII):

$$R_1\text{-}(A)_n\text{-}X \qquad \text{General formula (FI)}$$

$$R_2\text{-}\underset{\underset{B}{|}}{C}=Y \qquad \text{General formula (FII)}$$

wherein $R_1$ and $R_2$ each represents an aliphatic group, an aromatic group, or a heterocyclic group, n is 1 or 0, A represents a group that can react with the aromatic amine developing agent to form a chemical bond, X represents a group that can react with the aromatic amine developing agent to split off, B represents a hydrogen atom, an aliphatic group, an aromatic group, a heterocyclic group, an acyl group or a solfonyl group, Y represents a group that can facilitate the addition of the aromatic amine developing agent to the compound having general formula (FII), and $R_1$ and X together or Y and $R_2$ or B together may combine to form-a ring structure.

Of ways wherein the remaining aromatic amine developing agent and the compound (F) chemically combine, typical ways are substitution reactions and addition reactions.

The preferred examples of the compounds represented by general formula (FI) or (FII) include the compounds as described in JP-A-63-158545, JP-A-62-283338, Japanese patent application No. 158342/87, EP 277589, etc.

More preferred examples of the compounds (G) that can chemically combine with the oxidation product of the aromatic amine developing agent remaining after the color development processing to form a chemically inactive and substantially colorless compound are those represented by the following general formula (GI):

General formula (GI)

$$R\text{—}Z$$

wherein R represents an aliphatic group, an aromatic group, or a heterocyclic group, and Z represents a nucleophilic group or a group that can decompose in the photographic material to release a nucleophilic group. In the compounds represented by the general formula (GI), Z preferably represents a group having a Pearson's nucleophilic $^nCH_3I$ value [R. G. Pearson et al., J. Am. Chem. Soc., 90, 319 (1968) ] of 5 or more, or the group derived therefrom.

The preferred examples of the compounds represented by the general formula (GI) include the compounds as described in EP-A-255722, JP-A-62-143048, JP-A-62-229145, Japanese patent application Nos. 18439/88, 136724/88, 214681/87 and 158342/87, etc.

The detailed explanation on combination of the aforementioned compound (G) and compound (F) is described in EP 277589.

Water soluble dyes can be included in the hydrophilic colloid layers of photosensitive materials of this invention as filter dyes, with a view to preventing the occurrence of irradiation, or for other purposes. Oxonol dyes, hemioxonol dyes, styryl dyes, merocyanine dyes, cyanine dyes and azo dyes are included among these dyes. Of the dyes, the oxonol dyes, the hemioxonol dyes and the merocyanine dyes are useful.

Gelatin is useful as the binding agent or protective colloid which is used in the emulsion layers of photosensitive materials of this invention, but other hydrophilic colloids such as polyvinyl pyrrolidone, polyvinyl alcohol and protein (e.g., albumin) may be used either independently, or in conjunction with gelatin.

The gelatin used in the invention may be a lime treated gelatin or a gelatin which has been treated using an acid. Details of methods for the manufacture of gelatin have been disclosed in "The Macromolecular Chemistry of Gelatin", by Arthur Weise, (Published by Academic Press, 1964).

Silver bromide, silver iodobromide, silver iodochlorobromide, silver chlorobromide and silver chloride can all be used as the silver halide in the photographic emulsion layers of photographic materials in which the invention is used. In this invention, it is advantageous to use silver chrorobromide containing at least 90 mol % of silver chloride, or silver chloride in point of the rapid processing and, particularly, of the effect of improving the heat-fastness, the effect of preventing the occurrence of stain after processing, etc.

The average grain size (the grain diameter in the case of grains which are spherical or almost spherical, and the edge length in the case of a cubic grain, being expressed as the average based upon the projected surface area) of the silver halide grains in the photographic emulsion is of no particular consequence, but an average grain size of at most 2 $\mu$ is preferred.

The grain size distribution may be narrow or wide, but the use of a mono-disperse emulsion of which the coefficient of variation is at most 15% is preferred. The "coefficient of variation" represents a value obtained by dividing the standard deviation of grain size distribution of silver halide by the average grain size thereof, which is described in T. H. James, the theory of The Photographic Process, 3rd Ed., (1966), New York, the MacMillan company, p 39.

The silver halide grains in the photographic emulsion layers may consist of regular crystals such as cubes or octahedra, or they may consist of irregular crystalline forms such as spherical or tabular forms, or they may have a complex form made up of these forms. They may also consist of mixtures of grains with various crystalline forms. Of these, the use of regular crystalline emulsions is preferred.

Emulsions in which tabular silver halide grains of which the diameter is at least five times the thickness of the grain account for at least 50% of the total projected surface area can also be used.

The interior and the surface layer of the silver halide grains may consist of different phases. The grains may be of the type in which the latent image is formed mainly on the surface, or of the type in which the latent image is formed mainly within the grain.

Cadmium salts, zinc salts, thallium salts, lead salts, iridium salts or complex salts thereof, rhodium salts or complex salts thereof, iron salts or iron complex salts etc. may also be present during the formation of physical ripening of the silver halide grains.

The silver halide emulsion is normally chemically sensitized. As the chemical sensitizers, a sulfur sensitizer (hypo, N-alkylthiourea, etc.), a gold sensitizer (an alkali metal salt of chloroauric acid, etc.) and other noble metal sensitizer (metal ions belonging to the VIII groups of the periodic table such as a platinum ion, an iridium ion, etc.) can be used.

Various compounds can be included in the photographic emulsions in which the invention is used, with a view to preventing fogging during the manufacture, storage or photographic processing of the photosensitive material, or with a view to stabilizing photographic performance. Thus a great many known compounds can be added as anti-fogging agents and stabilizers, such as the azoles and the salts formed by ionization of the azoles (for example benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles, (especially 1-phenyl-5-mercaptotetrazole, etc.), mercaptopyrimidines and mercaptotriazines, etc.); thioketo compounds such as oxadrinethione; azaindenes, for example triazaindenes, tetra-azaindenes (especially 4-hydroxy substituted (1,3,3a,7)tetra-azaindene), penta-azaindenes etc.; benzenethiosulfonic acid, benzenesulfinic acid, benzenesulfonic acid amide, etc.

The present invention can also be applied to multilayer multi-color photographic materials which have at least two different spectral sensitivities on a support. Multi-layer natural color photographic materials normally have at least one red sensitive emulsion layer, at least one green sensitive emulsion layer and at least one blue sensitive layer on a support. The order in which these layers are arranged can be selected arbitrarily according to requirements. A cyan forming coupler is normally included in the red sensitive emulsion layer, a magenta forming coupler is normally included in the green sensitive emulsion layer and a yellow forming coupler is normally included in the blue sensitive layer, but different combinations can be used, depending on the particular case.

The cellulose nitrate films, cellulose acetate films, cellulose acetate butyrate films, cellulose acetate propionate films, polystyrene films, polyethyleneterephthalate films, polycarbonate films and laminates of these materials, thin glass films, paper, etc., normally used in photographic materials can be used for the support which is used in this invention. Good results are obtained with supports such as paper which has been coated or laminated with baryta or an α-olefin polymer, especially polymers based on α-olefins which have from 2 to 10 carbon atoms such as polyethylene, polypropylene, ethylene butene copolymer, etc., vinyl chloride resins which contain a reflecting substance such as $TiO_2$, and plastic films where adhesivity with other polymeric substances has been improved by roughening the surface in the way indicated in JP-B-47-19068. Furthermore, ultraviolet hardenable resins can also be used.

A transparent support or a non-transparent support is selected in accordance with the intended purpose of the photographic material. Furthermore the support may be rendered colored and transparent by the addition of dyes or pigments.

As well as truly non-transparent materials such as paper, supports obtained by adding dyes or pigments such as titanium oxide to transparent films, plastic films which have been surface treated using the method disclosed in JP-B-47-19068, and paper or plastic films to which carbon black or dyes, etc., have been added so that they block out light completely can be used as non-transparent supports. A comventional undercoating or subbing layer is normally established on the support. Preliminary treatments such as a corona discharge, ultraviolet irradiation, flaming, etc., can also be applied to the support surface in order to further improve adhesivity.

Normal color photosensitive materials, especially the color photographic materials for prints, can be preferably used for making color photographs of this invention.

The color developer used for the development processing of photosensitive materials of this invention is comventional and is preferably an aqueous alkaline solution which contains a primary aromatic amine based color developing agent as the principal component. Aminophenol based compounds are also useful as color developing agents, but the use of p-phenylenediamine based compounds is preferred. Typical examples of these compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and the sulfate, hydrochloride and p-toluenesulfonate salts of these compounds. Two or more of these compounds can be used jointly, depending on the intended purpose.

The color development baths generally contain pH buffers such as the carbonates, borates or phosphates of the alkali metals and development inhibitors or antifogging agents such as bromides, iodides, benzimidazoles, benzothiazoles or mercapto compounds, etc. They may also contain, as required, various preservatives, such as hydroxylamine, diethylhydroxylamine, hydrazine sulfites, phenylsemicarbazides, triethanolamine, catechol sulfonic acids, triethylenediamine(1,4-diazabicyclo[2,2,2]octane), etc., organic solvents such as ethylene glycol and diethylene glycol, development accelerators such as benzyl alcohol, poly(ethylene glycol), quaternary ammonium salts and amines, color forming couplers, competitive couplers, fogging agents such as sodium boronhydride, auxiliary developing agents such as 1-phenyl-3-pyrazolidone, viscosity imparting agents, various chelating agents as typified by the aminopolycarboxylic acids, aminopolyphosphonic acids, alkylphosphonic acids and phosphonocarboxylic acids, typical examples of which include ethylenediamine tetraacetic acid, nitrilo triacetic acid, diethylenetriamine pentaacetic acid, cyclohexanediamine tetraacetic acid, hydroxyethylimino diacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine di(o-hydroxyphenylacetic acid), and salts of these compounds. It is preferred that benzyl alcohol is substantially used as a development accelerator from the point of view of environmental conservation.

Color development is carried out after a conventional black-and-white development in the case of reversal processing. Known black-and-white developing agents, for example the dihydroxybenzenes such as hydroquinone, etc., the 3-pyrazolidones such as 1-phenyl-3-pyrazolidone, etc., and the amino phenols such as N-methyl-p-aminophenol, etc., can be used individually or in combinations for the black-and-white developer.

The pH of these color developers and black-and-white developers is generally within the range from 9 to 12. Furthermore, the replenishment rate of the development bath depends on the color photographic material which is being processed, but it is generally at most 3 liters per square meter of photosensitive material and it is possible, by reducing the bromide ion concentration in the replenisher, to use a replenishment rate of at most 500 ml per square meter of photosensitive material. The prevention of loss of liquid by evaporation, and aerial oxidation, by minimizing the contact area with the air in the processing tank is desirable in cases where the replenishment rate is low. Furthermore, the replenishment rate can be reduced by using a means of suppressing the accumulation of bromide ion in the developer.

The photographic emulsion layers are subjected to a conventional bleaching after color development. The bleaching may be carried out at the same time as the fixing (in a bleach-fixing) or it may be carried out as a separate process. Moreover, a bleach-fixing can be carried out after a bleach in order to speed-up processing. Moreover processing can be carried out in two connected bleach-fix baths, fixing can be carried out before carrying out bleach-fix or a bleaching process can be carried out after a bleach-fixing, according to the intended purpose of the processing.

Compounds of a multi-valent metal such as iron (III), cobalt (III), chromium (VI), copper (II), etc., peracids, quinones, nitro compounds, etc., can be used as bleaching agents. Typical bleaching agents include ferricyanides; dichromates; organic complex salts of iron (III) or cobalt (III), for example complex salts with aminopolycarboxylic acids such as ethylenediamine tetraacetic acid, diethylenetriamine pentaacetic acid, cyclohexanediamine tetraacetic acid, methylimino diacetic acid, 1,3-diaminopropane tetraacetic acid, glycol ether diamine tetraacetic acid, etc., or citric acid, tartaric acid, malic acid, etc.; persulfates; bromates; permanganates and nitrobenzenes etc. Of these materials, the use of the aminopolycarboxylic acid iron (III) complex salts, principally ethylenediamine tetraacetic acid iron (III) complex salts, and persulfates, is preferred from the points of view of both rapid processing and the prevention of environmental pollution. Moreover, the amino polycarboxylic acid iron (III) complex salts are especially useful in both bleach baths and bleach-fix baths. The pH of a bleach or bleach-fix bath in which aminopolycarboxylic acid iron (III) complex salts are being used is normally from 5.5 to 8, but processing can be carried out at lower pH values in order to speed-up processing.

Bleach accelerators can be used, as required, in the bleach baths, bleach-fix baths, or bleach or bleach-fix pre-baths. Actual examples of useful bleach accelerators have been disclosed in the following specifications: Thus there are the compounds which have a mercapto group or a disulfide group disclosed in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and in *Research Disclosure,* No. 17,129 (July 1978), etc.; the thiazolidine derivatives disclosed in JP-A-50-140129; the thiourea derivatives disclosed in JP-B-45-8506, JP-A-52-20832 and JP-A-53-32735, and in U.S. Pat. No. 3,706,561; the iodides disclosed in West German Patent 1,127,715 and in JP-A-58-16235; the polyoxyethylene compounds disclosed in West German Patents 966,410 and 2,748,430; the polyamine compounds disclosed in JP-B-45-8836; the other compounds disclosed in JP-A-49-42434, JP-A-49-59644, JP-A-53-94927, JP-A-54-5727, JP-A-55-26506 and JP-A-58-163940; and bromide ions, etc. Among these compounds, those which have a mercapto group or a disulfide group are preferred in view of their high accelerating effect, and the use of the compounds disclosed in U.S. Pat. No. 3,893,858, West German Patent 1,290,812 and in JP-A-53-95630 is especially desirable. Moreover, the use of the compounds disclosed in U.S. Pat. No. 4,552,834 is also desirable. These bleach accelerators may be added to the photosensitive material. These bleach accelerators are especially effective when bleach-fixing color photosensitive materials for photographic purposes.

Thiosulfates, thiocyanates, thioether based compounds, thioureas and high quantities of iodides, etc., can be used as fixing agents, but thiosulfates are generally used for this purpose, and ammonium thiosulfate in particular can be used in the widest range of applications. Sulfites or bisulfites, or carbonyl-bisulfite addition compounds, are the preferred preservatives for bleach-fix baths.

The silver halide color photographic materials of this invention are generally subjected to a water washing and/or stabilizing process after the desilvering process. The amount of water used in the water washing process can be fixed within a wide range according to the nature of the photosensitive material (for example the materials, such as the couplers, which are being used), the application the wash water temperature, the number of washing tanks (the number of washing stages), the replenishment system, i.e., whether a counter-current or a sequential-current system is used, and various other conditions. The relationship between the amount of water used and the number of water washing tanks in a multistage counter-current system can be obtained using the method outlined on pages 248~253 of journal of the Society of Motion Picture and Television Engineers, Volume 64 (May 1955).

The amount of wash water can be greatly reduced by using the multi-stage counter-current system noted in the aforementioned literature, but bacteria proliferate due to the increased residence time of the water in the tanks and problems arise as a result of the sediments which are formed becoming attached to the photosensitive material. The method in which the calcium ion and manganese ion concentrations are reduced as disclosed in JP-A-62-288838 can be used very effectively to overcome problems of this sort in the processing of color photosensitive materials of this invention. Furthermore, the isothiazolone compounds and thiabendazoles disclosed in JP-A-57-8542 and the chlorine-based disinfectants such as chlorinated sodium isocyanurate, and benzotriazoles, etc., and the disinfectants disclosed in "Chemistry of Biocides and Fungicides" by Hiroshi Horiguchi, "Reduction of Microorganisms, Biocidal and Fungicidal Techniques", published by the Health and Hygiene Technical Society and in "A Dictionary of Biocides and Fungicides", published by the Japanese Biocide and Fungicide Society, can be used for this purpose.

The pH value of the wash water used in the processing of the photosensitive materials of invention is generally within the range from 4 to 9, and preferably within the range from 5 to 8. The wash water temperature and the washing time can be set variously according to the nature of the photosensitive material and the application, etc., but, in general, washing conditions of from 20 seconds to 10 minutes at a temperature of from 15° to 45° C, and preferably of from 30 seconds to 5 minutes at a temperature of from 25° to 40° C, are selected. Moreover, the photosensitive materials of this invention can be processed directly in a stabilizing bath instead of being subjected to a water wash as described above. The known methods disclosed in JP-A-57-8543, JP-A-

58-14834 and JP-A-60-220345 can all be used for this purpose.

Furthermore, there are cases in which a stabilization process is carried out following the aforementioned water washing process and the stabilizing baths which contain formalin and surfactant which are used as a final bath for color photosensitive materials used for photographic purposes are an example of such a process. Various chelating agents and fungicides, etc., can be added to these stabilizing baths.

The overflow which accompanies replenishment of the abovementioned wash water and/or stabilizer can be re-used in other processes such as a desilvering process, etc.

A color developing agent may also be incorporated into the silver halide color photosensitive materials of this invention in order to simplify and speed-up processing. The incorporation of various color developing agent precursors is preferred. For example, the indoaniline based compounds disclosed in U.S. Pat. No. 3,342,597, the Schiff's base type compounds disclosed in U.S. Pat. No. 3,342,599 and in *Research Disclosure* Nos. 14,850 and 15,159, the aldol compounds disclosed in *Research Disclosure* No. 13,924, the metal salt complexes disclosed in U.S. Pat. No. 3,719,492, and the urethane based compounds disclosed in JP-A-53-135628 can be used for this purpose.

Various 1-phenyl-3-pyrazolidones can be incorporated, as required, into the silver halide color photosensitive materials of this invention with a view to accelerating color development. Typical compounds of this type have been disclosed in JP-A-56-64339, JP-A-57-144547 and JP-A-58-115438, etc.

The various processing baths are used at a temperature of from 10° to 50° C. in this invention. The standard temperature is normally from 33° to 38° C., but processing is accelerated and the processing time is shortened at higher temperatures and, conversely, increased picture quality and improved stability of the processing baths can be achieved at lower temperatures. Furthermore, processes using hydrogen peroxide intensification or cobalt intensification as disclosed in West German Patent 2,226,770 or U.S. Pat. No. 3,674,499 can be carried out in order to economize on silver in the photosensitive material.

The invention can be applied to various color and black-and-white photosensitive materials. Typical examples of such materials include general purpose and projection type color negative films, color reversal films for slides or television purposes, color papers, direct positive color papers in which an internal latent image type emulsion is used, color positive films and color reversal papers, color diffusion transfer type photosensitive materials and heat developable type color photosensitive materials etc. The invention can be applied to black-and-white photosensitive materials such as those used for X-ray purposes in which the tricolor coupler mixtures as disclosed in *Research Disclosure* No. 17123 (July 1978), etc., or the black color forming couplers disclosed in U.S. Pat. No. 4,126,461 and British Patent 2,102,136, etc., are used. The invention can also be applied to films used for plate making purposes, such as lith films and scanner films, to direct medical, indirect medical and industrial X-ray films, to black-and-white negative films intended for photographic purposes, black-and-white printing papers, COM or normal microfilms, silver salt diffusion transfer type photosensitive materials and print-out type photosensitive materials.

The present invention is now illustrated in greater detail by reference to the following examples which, however, are not to be construed as limiting the invention in any way.

EXAMPLE 1

A solution consisting of 10 grams of the cyan coupler (C-34), 6 ml of the compound (S-3) of this invention and 50 ml of ethyl acetate was heated to 50° C. and then 100 ml of an aqueous solution at 60° C. which contained 15 grams of gelatin, 1.0 gram of sodium dodecylbenzenesulfonate and 0.5 gram of sodium di-2-ethylhexylsulfosuccinate was added and the mixture was emulsified using a high speed stirrer (a homogenizer, made by Nippon Seiki Seisakujo). Water was added subsequently to make up a total weight of 400 grams of emulsion (A).

Emulsions (B) to (R) were prepared in the same way in accordance with the compositions shown in Table 1.

The stabilities of the emulsions (A)~(R) in the form of hot solutions (40° C.) which were being stirred were investigated and the results obtained are shown in Table 1. (The average grain size was measured using a "Nanosizer" made by the British Coal Tar Co.)

TABLE 1

| | Coupler | | Compound | | Mean Particle Diameter (μ) | | |
|---|---|---|---|---|---|---|---|
| Emulsion | Type | Amount (g) | Type | Amount (ml) | Emulsion | After 48 Hours | Remarks |
| A | C-34 | 10 | S-3 | 6 | 0.16 | 0.18 | Present Invention |
| B | C-34 | 10 | S-7 | 6 | 0.17 | 0.18 | |
| C | C-34 | 10 | S-9 | 6 | 0.17 | 0.18 | |
| D | C-34 | 10 | X-1 | 6 | 0.17 | 0.21 | Comparison |
| E | C-34 | 10 | X-2 | 6 | 0.17 | 0.26 | |
| F | C-34 | 10 | X-5 | 6 | 0.16 | 0.24 | |
| G | Y-15 | 10 | S-5 | 3 | 0.14 | 0.15 | Present Invention |
| H | Y-15 | 10 | S-9 | 3 | 0.15 | 0.16 | |
| I | Y-15 | 10 | S-10 | 3 | 0.15 | 0.16 | |
| J | Y-15 | 10 | X-1 | 3 | 0.16 | 0.21 | Comparison |
| K | Y-15 | 10 | X-3 | 3 | 0.16 | 0.20 | |
| L | Y-15 | 10 | X-6 | 3 | 0.16 | 0.19 | |
| M | M-34 | 10 | S-3 | 20 | 0.18 | 0.19 | Present Invention |
| N | M-34 | 10 | S-8 | 20 | 0.17 | 0.19 | |
| O | M-15 | 10 | S-9 | 20 | 0.19 | 0.20 | |
| P | M-34 | 10 | X-2 | 20 | 0.17 | 0.24 | Comparison |
| Q | M-34 | 10 | X-4 | 20 | 0.18 | 0.25 | |
| R | M-15 | 10 | X-7 | 20 | 0.20 | 0.25 | |

It is clear from Table 1 that the emulsions in which the compounds of this invention had been used displayed less coarsening of the emulsified particles with the passage of time than the comparative emulsions, and that the emulsions of this invention had superior stability.

NOTE)

X-1

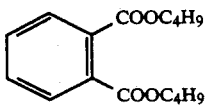

X-2

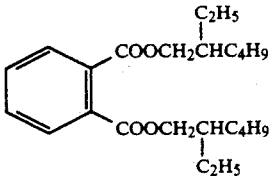

X-3

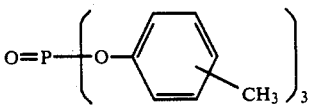

X-4

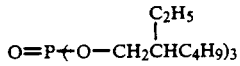

X-5

$C_{12}H_{18}Cl_8$
(The compound disclosed in JP-A-61-84641)

X-6

$CH_2COOCH_2(CF_2)_6H$
|
$CH_2COOCH_2(CF_2)_6H$
(The compound disclosed in JP-A-53-146622)

X-7

$CH_3(CH_2)_4COOCH_2(CF_2)_6H$
(The compound disclosed in JP-A-53-146622)

EXAMPLE 2

Sample (A) of this invention was prepared in the following way.

A solution consisting of 6 grams of compound (S-3) of this invention, 10 grams of the coupler (C-33) and 50 ml of ethyl acetate was heated to 50° C. and then 100 ml of an aqueous solution which contained 15 grams of gelatin, 1.0 gram of sodium dodecylbenzenesulfonate and 0.5 gram of sodium di-2-ethylhexylsulfosuccinate was added and a fine particle emulsified dispersion was obtained using a high speed mixer (a homogenizer, made by the Nippon Seiki Seisakujo).

This emulsified dispersion was mixed with a silver chlorobromide (98 mol. % silver chloride) photographic emulsion and, after adjusting the pH to 6.0, the mixture was coated onto a paper support which was laminated on both sides with polyethylene and sample (A) of the invention was prepared with the layer structure and main component composition shown in Table 2. (Here 1-oxy-3,5-dichloro-s-triazine sodium salt, was used as a gelatin crasslinking agent.)

TABLE 2

| | |
|---|---|
| Third Layer (Protective Layer) | |
| Gelatin | 1000 mg/m$^2$ |
| Second Layer (UV Absorbing Layer) | |
| Ultraviolet Absorber (*1) | 600 mg/m$^2$ |
| Ultraviolet Absorber Solvent (*2) | 300 mg/m$^2$ |
| Gelatin | 800 mg/m$^2$ |

TABLE 2-continued

| | |
|---|---|
| First Layer | |
| Silver chlorobromide (98 mol. % AgCl) as silver | 300 mg/m$^2$ |
| Coupler (C-33) | 1.01 mmol/m$^2$ |
| Compound (S-3) | 300 mg/m$^2$ |
| Gelatin | 1200 mg/m$^2$ |
| Support | |
| Paper support laminated on both sides with polyethylene. | |

(*1) 2-(2-Hydroxy-3-sec-butyl-5-tert-butylphenyl)benzotriazole
(*2) Dioctyl sebacate Samples (B)~(U) of this invention and comparative samples (1)~(7) were prepared in the same way. Here, the polymers of this invention, the comparative compounds and the type of coupler were as shown in Table 3, and all other factors were the same as for sample (A) shown in Table 2.

These samples were subjected to a continuous gradation exposure through a sensitometric optical wedge and then they were processed in the way indicated below.

| | | |
|---|---|---|
| 1. Color Development | 35° C. | 45 seconds |
| 2. Bleach-fixing | 35° C. | 1 minute 00 seconds |
| 3. Water Washing | 25° ~ 30° C. | 2 minutes 30 seconds |

The compositions of the various processing baths used in the color development process were as follows:

| | |
|---|---|
| Color Development Bath | |
| Water | 800 cc |
| Ethylenediamine tetraacetic acid | 1.0 gram |
| Sodium sulfite | 0.2 gram |
| N,N-diethylhydroxylamine | 4.2 grams |
| Potassium bromide | 0.01 gram |
| Sodium chloride | 1.5 grams |
| Triethanolamine | 8.0 grams |
| Sodium carbonate | 30 grams |
| N-Ethyl-N-(β-methanesulfonamidoethyl) 3-methyl-4-aminoaniline sulfate | 4.5 grams |
| 4,4'-diaminostilbene based fluorescent brightening agent ("Whitex 4", Sumitomo Chemical Co.) | 2.0 grams |
| Water to make up to | 1000 cc |
| pH (adjusted with KOH) | 10.25 |
| Bleach-Fix Bath | |
| Ammonium thiosulfate (54 wt. % aqueous solution) | 150 ml |
| $Na_2SO_3$ | 15 grams |
| $NH_4[Fe(III)(EDTA)]$ | 55 grams |
| EDTA.2Na | 4 grams |
| Glacial acetic acid | 8.61 grams |
| Water to make up to | 1000 ml |
| pH | 5.4 |
| Rinse Bath | |
| EDTA.2Na.2$H_2O$ | 0.4 gram |
| Water to make up to | 1000 ml |
| pH | 7.0 |

The test described below was carried out in connection with the heat fastness of each of the developed samples. Thus, the extent of color fading was measured using the fractional reduction in density from an initial density of 1.5 on storing the developed samples in the dark for 6 days and in the dark for 10 days at 80° C., 70% RH. The results obtained were as shown in Table 3.

TABLE 3

| Sample | Type of Coupler | Type of Polymer: Type | Type of Polymer: Amount (mg/m²) | Dark Color Fading: 6 days at 100° C. | Dark Color Fading: 10 days at 80° C., 70% |
|---|---|---|---|---|---|
| This Invention | | | | | |
| A | C-33 | S-3 | 300 | 42% | 30% |
| B | C-34 | S-5 | 300 | 40% | 30% |
| C | C-34 | S-7 | 300 | 38% | 29% |
| D | C-34 | X-2/S-7 (1:1 by wt.) | 300 | 38% | 28% |
| E | C-34 | S-9 | 300 | 38% | 28% |
| F | C-34 | S-10 | 300 | 36% | 26% |
| G | C-34/C-7 (1:1 by wt.) | S-8 | 300 | 19% | 14% |
| H | C-35 | S-3 | 300 | 19% | 8% |
| I | C-35 | S-5 | 300 | 18% | 8% |
| J | C-35 | S-7 | 300 | 18% | 7% |
| K | C-35 | X-1/S-7 (1:1 by wt.) | 300 | 19% | 9% |
| L | C-35/C-7 (1:1 by wt.) | S-10 | 300 | 9% | 4% |
| M | C-35 | S-9 | 600 | 14% | 5% |
| N | C-38 | S-3 | 300 | 24% | 10% |
| O | C-38 | S-7 | 300 | 23% | 11% |
| P | C-38 | S-9 | 300 | 23% | 10% |
| Q | C-35/C-38 (1:1 by wt.) | S-7 | 300 | 16% | 6% |
| R | C-19 | S-5 | 300 | 5% | 4% |
| S | C-25 | S-8 | 300 | 4% | 4% |
| T | C-28 | S-8 | 300 | 5% | 5% |
| U | C-30 | S-4 | 300 | 5% | 3% |
| For Comparison | | | | | |
| 1 | C-33 | X-1 | 300 | 62% | 34% |
| 2 | C-34 | X-3 | 300 | 60% | 32% |
| 3 | C-34 | X-4 | 300 | 64% | 34% |
| 4 | C-34 | X-5 | 300 | 60% | 30% |
| 5 | C-35 | X-2 | 300 | 31% | 12% |
| 6 | C-35 | X-4 | 300 | 33% | 14% |
| 7 | C-35 | X-6 | 300 | 32% | 16% |
| 8 | C-38 | X-1 | 300 | 39% | 14% |
| 9 | C-38 | X-4 | 300 | 37% | 16% |
| 10 | C-19 | X-1 | 300 | 8% | 7% |
| 11 | C-25 | X-3 | 300 | 7% | 6% |
| 12 | C-28 | X-3 | 300 | 8% | 5% |
| 13 | C-30 | X-7 | 300 | 10% | 7% |

NOTE
X-1 to X-7 are the same high boiling point coupler solvents as used in Example 1.

It is clear from Table 3 that the heat resistance of the dye image is better when the invention is used.

EXAMPLE 3

The multi-layer printing paper (1) of which the layer structure is indicated below was prepared on a paper support which had been laminated on both sides with polyethylene.

Preparation of the First Layer Coating Liquid

Ethyl acetate (27.2 cc) and 15 cc of high boiling point organic solvent (X-1/X-4=1/1) was added to 10.2 grams of yellow coupler (Y-7), 9.1 grams of yellow coupler (Y-15) and 2.1 grams of colored image stabilizer (Cpd-2) to form a solution which was then emulsified and dispersed in 185 cc of 10% aqueous gelatin solution which contained 8 cc of 10% sodium dodecylbenzene sulfonate. This emulsified dispersion was mixed with emulsions EM-1 and EM-2 to form a solution and the first layer coating liquid was prepared by adjusting the gelatin concentration in accordance with the composition indicated below. The coating liquids for the second to the seventh layers were prepared using the same procedure as used for the preparation of the first coating layer. Moreover, 1-oxy-3,5-dichloro-s-triazine sodium salt, was used as a gelatin hardening agent in each layer.

Furthermore, (Cpd-1) was used as a viscosity increasing agent.

Layer Structure

The composition of each layer is indicated below. The numerical values indicate coated weights (grams per square meter). In the case of the silver halide emulsions the amounts coated are indicated after calculation as silver.

Support

Polyethylene laminated paper [White pigment ($TiO_2$) and bluish dye were included in the polyethylene on the first layer side.]

| First Layer (Blue Sensitive Layer) | |
|---|---|
| Monodisperse silver chlorobromide emulsion (EM-1) spectrally sensitized with the sensitizing dye (ExS-1) | 0.13 |
| Monodisperse silver chlorobromide emulsion (EM-2) spectrally sensitized with the sensitizing dye (ExS-1) | 0.13 |
| Gelatin | 1.86 |
| Yellow coupler (Y-7) | 0.44 |
| Yellow coupler (Y-15) | 0.39 |
| Colored image stabilizer (Cpd-2) | 0.08 |

-continued

| | |
|---|---|
| Solvent (X-1) | 0.35 |
| Solvent (X-4) | 0.35 |
| Anti-color mixing agent (Cpd-18) | 0.01 |
| Second Layer (Anti-color Mixing Layer) | |
| Gelatin | 0.99 |
| Anti-color mixing agent (Cpd-3) | 0.08 |
| Third Layer (Green Sensitive Layer) | |
| Monodisperse silver chlorobromide emulsion (EM-3) spectrally sensitized with the sensitizing dyes (ExS-2, 3) | 0.05 |
| Monodisperse silver chlorobromide emulsion (EM-4) spectrally sensitized with the sensitizing dyes (ExS-2, 3) | 0.11 |
| Gelatin | 1.80 |
| Magenta coupler (M-34) | 0.39 |
| Colored image stabilizer (Cpd-4) | 0.20 |
| Colored image stabilizer (Cpd-5) | 0.02 |
| Colored image stabilizer (Cpd-6) | 0.03 |
| Solvent (X-3) | 0.12 |
| Solvent (X-4) | 0.25 |
| Fourth Layer (Ultraviolet Absorbing Layer) | |
| Gelatin | 1.60 |
| Ultraviolet Absorber (Cpd-7/Cpd-9/Cpd-16 = 3/2/6 by weight) | 0.70 |
| Anti color mixing agent (Cpd-11) | 0.05 |
| Solvent (X-8) | 0.27 |
| Fifth Layer (Red Sensitive Layer) | |
| Monodisperse silver chlorobromide emulsion (EM-5) spectrally sensitized with the sensitizing dyes (ExS-4, 5) | 0.07 |
| Monodisperse silver chlorobromide emulsion (EM-6) spectrally sensitized with the sensitizing dyes (ExS-4, 5) | 0.16 |

-continued

| | |
|---|---|
| Gelatin | 0.92 |
| Cyan coupler (C-35) | 0.15 |
| Cyan coupler (C-38) | 0.17 |
| Colored image stabilizer (Cpd-8/Cpd-9/Cpd-10 = 3/4/2 by weight) | 0.17 |
| Colored image stabilizer (Cpd-18) | 0.02 |
| Colored image stabilizer (Cpd-3) | 0.02 |
| Poly-t-butylacrylamide (Number average molecular weight 45,000) | 0.05 |
| Solvent (X-1) | 0.10 |
| Solvent (X-4) | 0.10 |
| Solvent (X-9) | 0.10 |
| Sixth Layer (Ultraviolet-Absorbing Layer) | |
| Gelatin | 0.54 |
| Ultraviolet Absorber (Cpd-7/Cpd-8/Cpd-9 = 1/5/3 by weight) | 0.21 |
| Solvent (X-8) | 0.08 |
| Seventh Layer (Protective Layer) | |
| Gelatin | 1.33 |
| Acrylic modified poly(vinyl alcohol) copolymer (17% modification) | 0.17 |
| Liquid paraffin | 0.03 |

Furthermore, (Cpd-12, Cpd-13) were used as antiirradiation dyes at this time.

"Alcanol XC" (Dupont Co.), sodium alkylbenzenesulfonate, succinic acid esters and "Megafac F-120" (made by the Dainippon Ink Co.) were used in each layer as emulsification and dispersing agents and coating promotors. (Cpd-14,15,17) were also used as a silver halide stabilizing agents.

Cpd-1

A homopolymer having the recurring unit represented by the following formula:

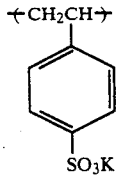

Cpd-2

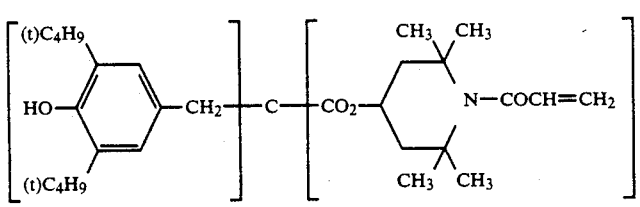

Cpd-3

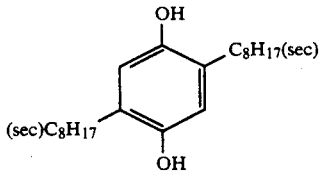

Cpd-4

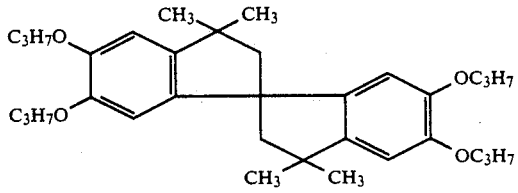

-continued
Cpd-5
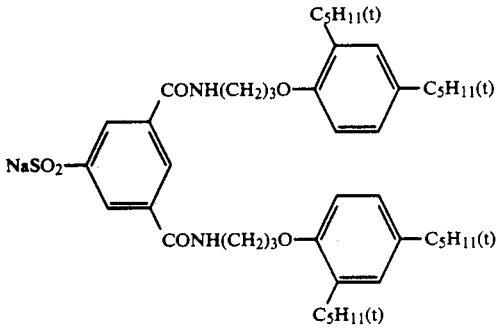
Cpd-6
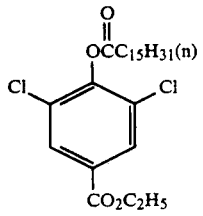
Cpd-7
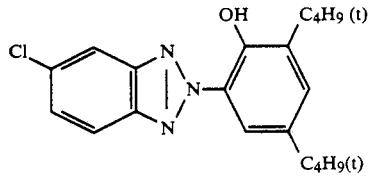
Cpd-8
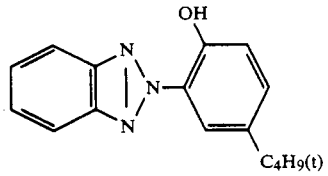
Cpd-9
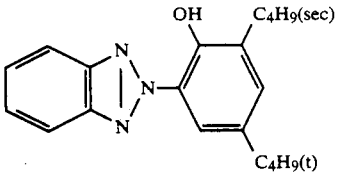
Cpd-10
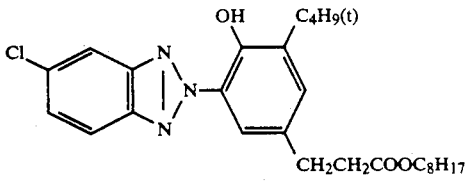
Cpd-11
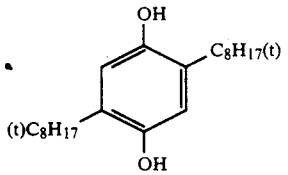

-continued
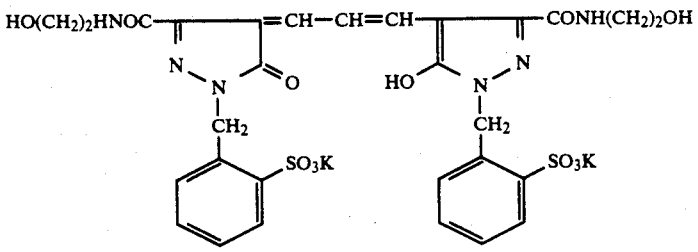
Cpd-12
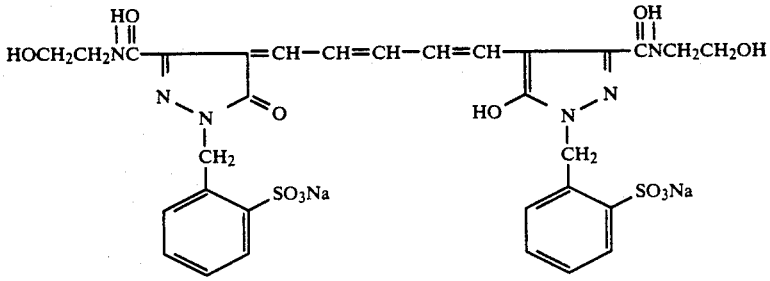
Cpd-13
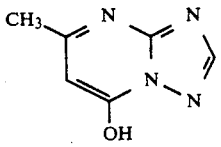
Cpd-14
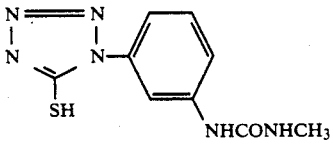
Cpd-15
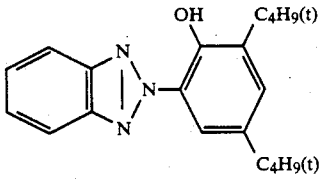
Cpd-16
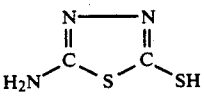
Cpd-17
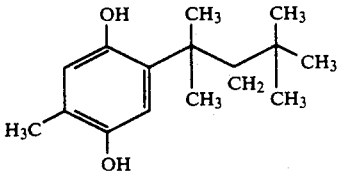
Cpd-18
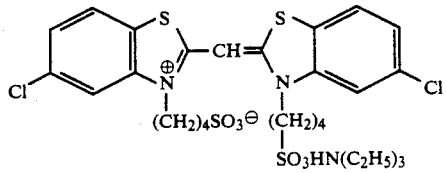
ExS-1

-continued

ExS-2

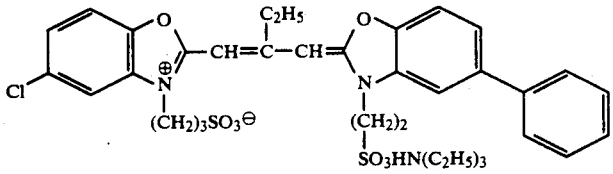

ExS-3

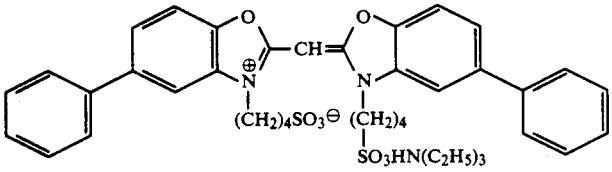

ExS-4

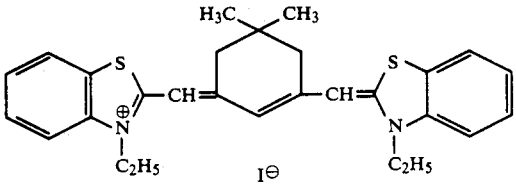

ExS-5

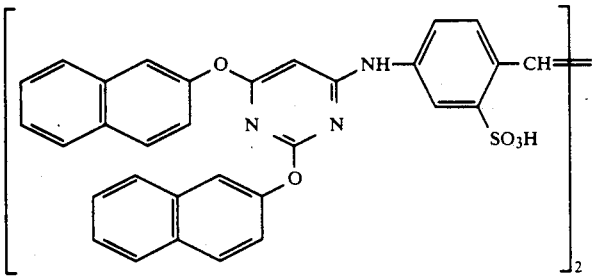

X-1 to X-4 are the same as the corresponding compounds in Example 1

X-8

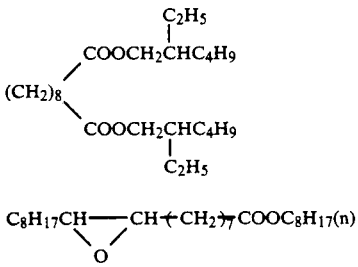

| Emulsion | Form | Average Grain Size*1 (μ) | Br Content (mol. %) | Variation Coeff.*2 |
|---|---|---|---|---|
| EM-1 | Cubic | 1.0 | 80 | 0.08 |
| EM-2 | Cubic | 0.75 | 80 | 0.07 |
| EM-3 | Cubic | 0.5 | 83 | 0.09 |
| EM-4 | Cubic | 0.4 | 83 | 0.10 |
| EM-5 | Cubic | 0.5 | 73 | 0.09 |
| EM-6 | Cubic | 0.4 | 73 | 0.10 |

*1In this case, represented by the average edge length based on the projected area.
*2Represented by the ratio of the statistical standard deviation (s) and the average grain size (d) (s/d).

Printing papers (2)~(9) were then prepared in the same way as printing paper (1) except that the compounds used were varied as shown in Table 4.

TABLE 4

| Printing Paper | Blue Sensitive Layer Type | Blue Sensitive Layer Amount (mg/m²) | Green Sensitive Layer Type | Green Sensitive Layer Amount (mg/m²) | Red Sensitive Layer Type | Red Sensitive Layer Amount (mg/m²) | Remarks |
|---|---|---|---|---|---|---|---|
| (1) | X-1 | 0.35 | X-3 | 0.12 | X-1 | 0.10 | For Comparison |
| | X-4 | 0.35 | X-4 | 0.25 | X-4 | 0.10 | |
| | | | | | X-9 | 0.10 | |
| (2) | " | " | " | " | S-3 | 0.30 | Examples |
| (3) | " | " | " | " | S-8 | 0.30 | of |
| (4) | " | " | " | " | X-4 | 0.10 | the |
| | | | | | S-8 | 0.20 | Invention |
| (5) | " | " | S-7 | 0.37 | X-1 | 0.10 | |
| | | | | | X-4 | 0.10 | |
| | | | | | X-9 | 0.10 | |
| (6) | " | " | X-3 | 0.12 | " | " | |
| | | | S-7 | 0.25 | | | |
| (7) | S-9 | 0.70 | X-3 | 0.12 | " | " | |
| | | | X-4 | 0.25 | | | |
| (8) | S-9 | 0.35 | X-3 | 0.12 | X-1 | 0.10 | |
| | X-4 | 0.35 | S-7 | 0.25 | S-5 | 0.40 | |

TABLE 4-continued

| Printing Paper | Blue Sensitive Layer Type | Blue Sensitive Layer Amount (mg/m²) | Green Sensitive Layer Type | Green Sensitive Layer Amount (mg/m²) | Red Sensitive Layer Type | Red Sensitive Layer Amount (mg/m²) | Remarks |
|---|---|---|---|---|---|---|---|
| (9) | S-10 | 0.70 | S-8 | 0.40 | S-10 | 0.30 | |

The photosensitive samples mentioned above were exposed through an optical wedge and then processed in the way indicated below.

| Processing Operation | Temperature | Time |
|---|---|---|
| Color Development | 38° C. | 1 minute 40 seconds |
| Bleach-fix | 30~34° C. | 1 minute 00 seconds |
| Rinse (1) | 30~34° C. | 20 seconds |
| Rinse (2) | 30~34° C. | 20 seconds |
| Rinse (3) | 30~34° C. | 20 seconds |
| Drying | 70~80° C. | 50 seconds |

A three tank counter-current rinse system from rinse (3) to rinse (1) was used.

| | |
|---|---|
| Color Development Bath | |
| Water | 800 ml |
| Diethylenetriamine pentaacetic acid | 1.0 gram |
| 1-Hydroxyethylidene-1,1-diphosphonic acid (60 wt % aqueous solution) | 2.0 grams |
| Nitrilotriacetic acid | 2.0 grams |
| Benzyl alcohol | 16 ml |
| Diethylene glycol | 10 ml |
| Sodium sulfite | 2.0 grams |
| Potassium bromide | 0.5 gram |
| Potassium carbonate | 30 grams |
| N-Ethyl-N-(β-methanesulfonamidoethyl)-3-methyl-4-aminoaniline sulfate | 5.5 grams |
| Hydroxylamine sulfate | 3.0 grams |
| Brightening agent (Whitex 4B, made by Sumitomo Chemicals) | 1.5 grams |
| Water | to make up to 1000 ml |
| pH (25° C.) | 10.25 |
| Bleach-Fix Bath | |
| Water | 400 ml |
| Ammonium thiosulfate (70 wt % aqueous solution) | 200 ml |
| Sodium sulfite | 20 grams |
| Ammonium ethylenediaminetetraacetato ferrate | 60 grams |
| Disodium ethylenediaminetetraacetate | 10 grams |
| Water | to make up to 1000 ml |
| pH (25° C.) | 7.00 |
| Rinse Bath | |
| Benzotriazole | 1.0 gram |
| Ethylenediamine-N,N,N',N'-tetramethylenephosphonic acid | 0.3 gram |
| Water | to make up to 1000 ml |
| pH (25° C.) | 7.50 |

The test described below was carried out in connection with the fastness to heat and the fastness to moisture and heat of the processed samples. The results obtained for fading in terms of the fractional fall in density of each of the cyan, magenta and yellow colors on standing for 1 month in a dark place under conditions of 80° C. and 70% RH were as shown in Table 5. The test results indicate the fractional fall in density with an initial density of 1.5.

TABLE 5

| Printing Paper | B | G | R | Remarks |
|---|---|---|---|---|
| (1) | 4% | 2% | 16% | Comparative Example |
| (2) | 4% | 2% | 10% | Examples of |
| (3) | 4% | 2% | 10% | |

TABLE 5-continued

| Printing Paper | B | G | R | Remarks |
|---|---|---|---|---|
| (4) | 4% | 2% | 11% | the Invention |
| (5) | 4% | 0% | 16% | |
| (6) | 4% | 0% | 15% | |
| (7) | 3% | 3% | 16% | |
| (8) | 3% | 1% | 12% | |
| (9) | 2% | 0% | 10% | |

It is clear from Table 5 that the heat resistance is increased for B, G and R by means of this invention.

Furthermore, it was confirmed that printing papers (2)~(9) of this invention had a smaller increase in staining on storage at high temperatures than the comparative printing paper (1).

EXAMPLE 4

Sample 101, a multi-layer color photosensitive material whose composition is indicated below, was prepared on an undercoated cellulose triacetate film support.

Composition of the Photosensitive Layer

The coated weights are shown in units of grams of silver per square meter in the case of silver halides and colloidal silver, in units of grams per square meter in the case of couplers, additives and gelatin, and in units of mols per mol of silver halide in the same layer in the case of the sensitizing dyes.

| | |
|---|---|
| First Layer (Anti-halation Layer) | |
| Black colloidal silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| Second Layer (Intermediate Layer) | |
| Gelatin | 1.0 |
| UV-1 | 0.03 |
| ExC-4 | 0.02 |
| ExF-1 | 0.004 |
| Solv 1 | 0.1 |
| Solv-2 | 0.1 |
| Third Layer (Low Speed Red Sensitive Emulsion Layer) | |
| Silver iodobromide emulsion (4 mol. % AgI, Uniform AgI type, Corresponding sphere diameter 0.5μ, Variation coefficient of corresponding spheres 20%, tabular grains, diameter/thickness ratio 3.0) | |
| Coated silver weight | 1.2 |
| Silver iodobromide emulsion (3 mol. % AgI, Uniform AgI type, Corresponding sphere diameter 0.3μ, Variation coefficient of corresponding spheres 15%, spherical grains, diameter/thickness ratio 1.0) | |
| Coated silver weight | 0.6 |
| Gelatin | 1.0 |
| ExS-1 | $4 \times 10^{-4}$ |
| ExS-2 | $5 \times 10^{-5}$ |
| ExC-1 | 0.05 |
| ExC-2 | 0.50 |
| ExC-3 | 0.03 |

-continued

| | |
|---|---|
| ExC-4 | 0.12 |
| ExC-5 | 0.01 |
| Fourth Layer (High Speed Red Sensitive Emulsion Layer) | |
| Silver iodobromide emulsion (6 mol. % AgI, Core/shell ratio 1:1, with the interior of the grains being higher in AgI content than the surface layer thereof, Corresponding sphere diameter 0.7μ, Variation coefficient of corresponding spheres 15%, tabular grains, diameter/thickness ratio 5.0) | |
| Coated silver weight | 0.7 |
| Gelatin | 1.0 |
| ExS-1 | $3 \times 10^{-4}$ |
| ExS-2 | $2.3 \times 10^{-5}$ |
| ExC-6 | 0.06 |
| ExC-7 | 0.05 |
| ExC-18 | 0.05 |
| ExC-4 | 0.05 |
| Solv-1 | 0.05 |
| Solv-3 | 0.05 |
| Fifth Layer (Intermediate Layer) | |
| Gelatin | 0.5 |
| Cpd-1 | 0.1 |
| Solv-1 | 0.05 |
| Sixth Layer (Low Speed Green Sensitive Emulsion Layer) | |
| Silver iodobromide emulsion (4 mol. % AgI, Core/shell ratio 1:1, with the surface layer of the grains being higher in AgI content than the interior thereof, Corresponding sphere diameter 0.5μ, Variation coefficient of corresponding spheres 15%, tabular grains, diameter/thickness ratio 4.0) | |
| Coated silver weight | 0.35 |
| Silver iodobromide emulsion (3 mol. % AgI, Uniform AgI type, Corresponding sphere diameter 0.3μ, Variation coefficient of corresponding spheres 25%, spherical grains, diameter/thickness ratio 1.0) | 0.20 |
| Coated silver weight | |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| Seventh Layer (High Speed Green Sensitive Emulsion Layer) | |
| Silver iodobromide emulsion (4 mol. % AgI, Core/shell ratio 1:3, with the interior of the grains being higher in AgI content than the surface layer thereof, Corresponding sphere diameter 0.7μ, Variation coefficient of corresponding spheres 20%, tabular grains, diameter/thickness ratio 5.0) | |
| Coated silver weight | 0.8 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |
| Eighth Layer (Intermediate Layer) | |
| Gelatin | 0.5 |
| Cpd-1 | 0.05 |
| Solv-1 | 0.02 |
| Ninth Layer (Donor Layer for Interlayer Effect on the Red Sensitive Layer) | |
| Silver iodobromide emulsion (2 mol. % AgI, Core/shell ratio 2:1, with the interior of the grains being higher in AgI content than the surface layer thereof, Corresponding sphere diameter 1.0μ, Variation coefficient of corresponding spheres 15%, tabular grains, diameter/thickness ratio 6.0) | 0.35 |
| Coated silver weight | 0.35 |
| Silver iodobromide emulsion (2 mol. % AgI, Core/shell ratio 1:1, with the interior of the grains being higher in AgI content than the surface layer thereof, Corresponding sphere diameter 0.4μ, Variation coefficient of corresponding spheres 20%, tabular grains, diameter/thickness ratio 6.0) | 0.20 |
| Coated silver weight | 0.20 |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| Tenth Layer (Yellow Filter Layer) | |
| Yellow colloidal silver | 0.05 |
| Gelatin | 0.5 |
| Cpd-2 | 0.13 |
| Cpd-1 | 0.10 |
| Eleventh Layer (Low Speed Blue Sensitive Emulsion Layer) | |
| Silver iodobromide emulsion (4.5 mol. % AgI, Uniform AgI type, Corresponding sphere diameter 0.7μ, Variation coefficient of corresponding spheres 15%, Tabular grains, diameter/thickness ratio 7.0) | |
| Coated silver weight | 0.3 |
| Silver iodobromide emulsion (3 mol. % AgI, Uniform AgI type, Corresponding sphere diameter 0.3μ, Variation coefficient of corresponding spheres 25%, Tabular grains, diameter/thickness ratio 7.0) | 0.15 |
| Coated silver weight | |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 0.5 |
| ExY-17 | 1.0 |
| Solv-1 | 0.20 |
| Twelfth Layer (High Speed Blue Sensitive Emulsion Layer) | |
| Silver iodobromide emulsion (10 mol. % AgI, with the interior of the grains being higher in AgI content than the surface layer thereof, Corresponding sphere diameter 1.0μ, Variation coefficient of corresponding spheres 25%, Multiple twined crystal tabular grains, diameter/thickness ratio 2.0) | |
| Coated silver weight | 0.5 |
| Gelatin | 0.5 |
| ExS-6 | $1 \times 10^{-4}$ |
| ExY-15 | 0.20 |
| ExY-13 | 0.01 |
| Solv-1 | 0.10 |
| Thirteenth Layer (First Protective Layer) | |
| Gelatin | 0.8 |
| UV-4 | 0.1 |
| UV-5 | 0.15 |
| Solv-1 | 0.01 |
| Solv-2 | 0.01 |
| Fourteenth Layer (Second Protective Layer) | |
| Fine grain silver bromide emulsion (2 mol. % AgI, Uniform AgI type, Corresponding sphere diameter 0.07μ) | 0.5 |
| Gelatin | 0.45 |
| Poly(methyl methacrylate) grains (diameter 1.5μ) | 0.2 |
| H-1 | 0.4 |
| Cpd-3 | 0.5 |
| Cpd-4 | 0.5 |

As well as the components indicated above, the emulsion stabilizing agent Cpd-3 (0.04 g/m$^2$), and the surfactant Cpd-4 (0.02 g/m$^2$) as coating promotor were added to each layer. The compound Cpd-5 (0.5 g/m$^2$) and Cpd-6 (0.5 g/m$^2$) were also added.
UV-1
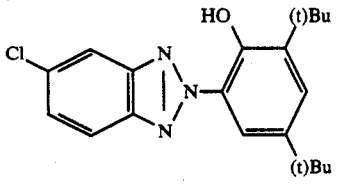
UV-2
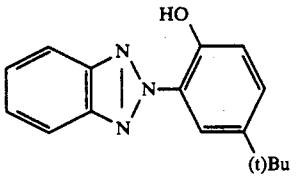
UV-3
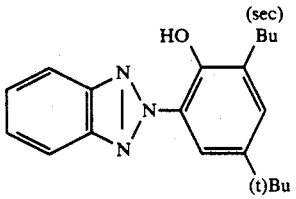
Bu = Butyl Group
UV-4
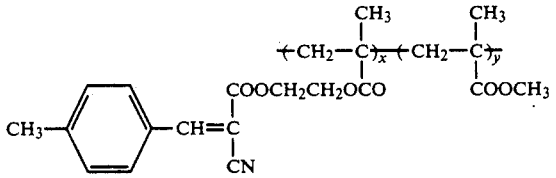
x/y = 7/3, by weight
UV-5
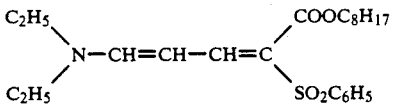
Tricresyl phosphate — Solv-1
Dibutyl phthalate — Solv-2
Solv-3
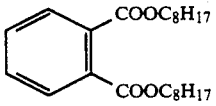
Solv-4
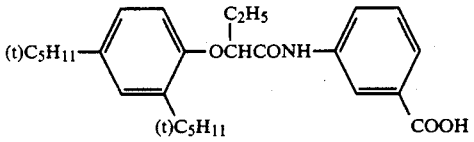
Cpd-1
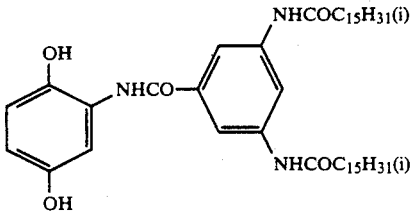
Cpd-2
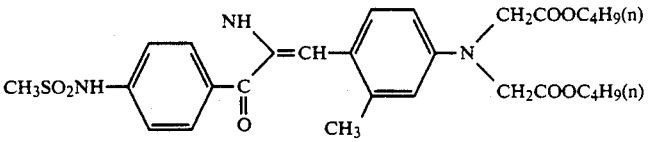

-continued
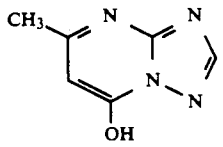
Cpd-3
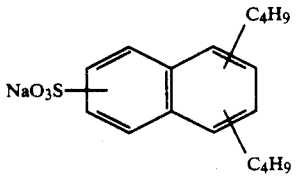
Cpd-4
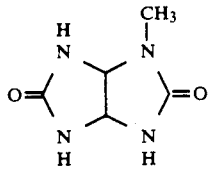
Cpd-5
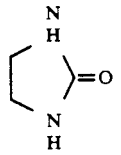
Cpd-6
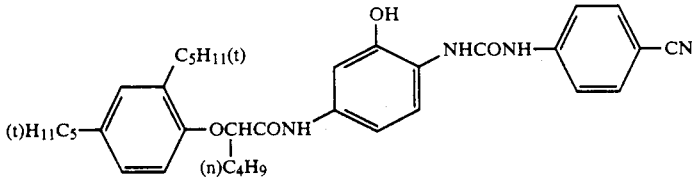
ExC-1
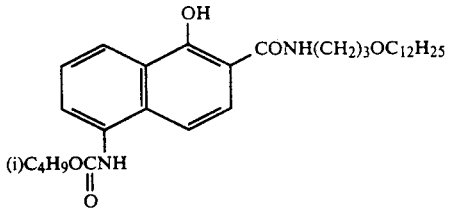
ExC-2
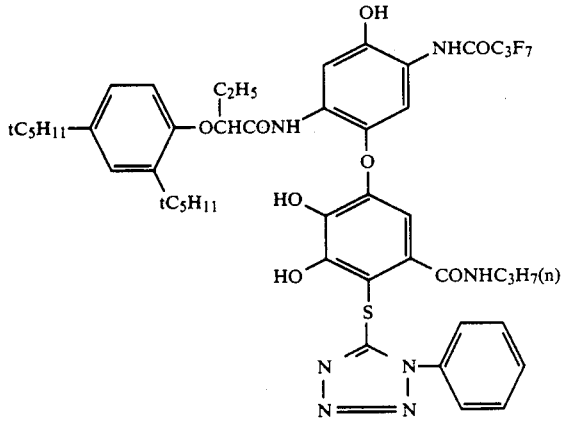
ExC-3

-continued
ExC-4
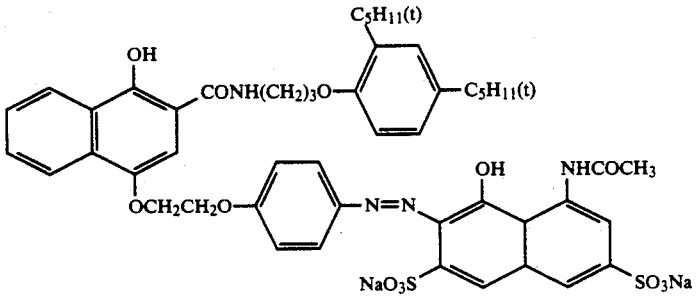
ExC-5
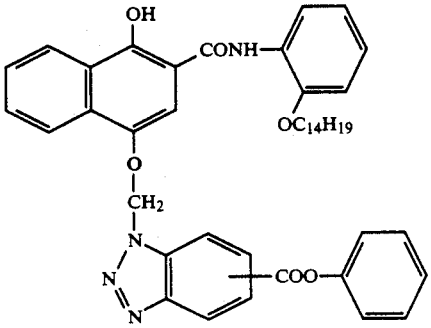
ExC-6
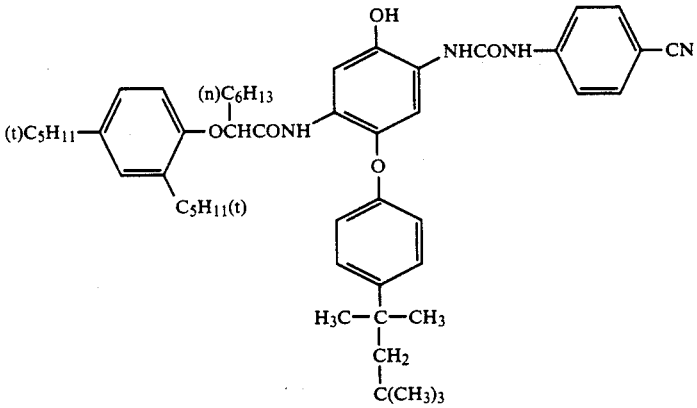
ExC-7
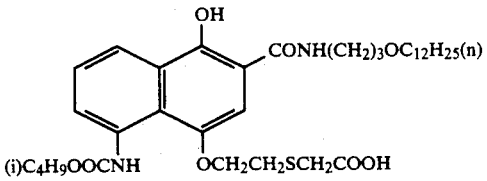
ExM-8
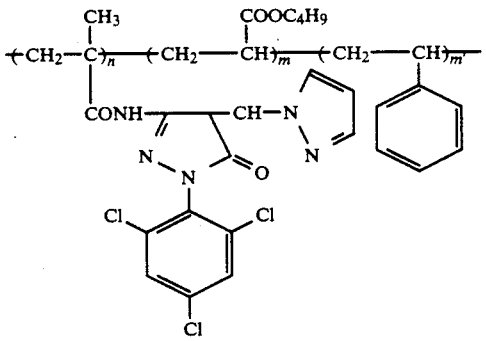
n = 50
m = 25
m' = 25
mol. wt. about 20,000

-continued
ExM-9
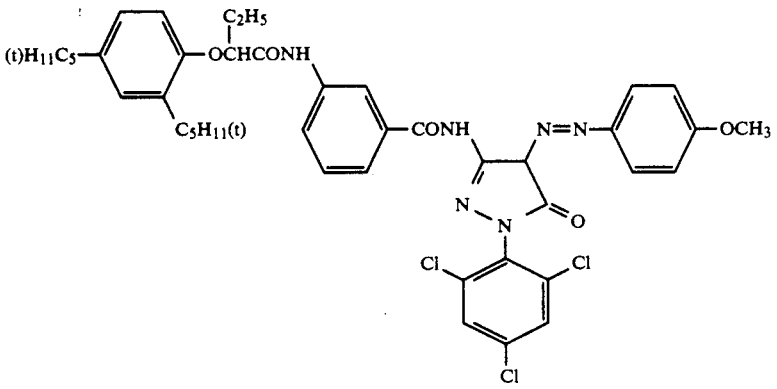
ExM-10
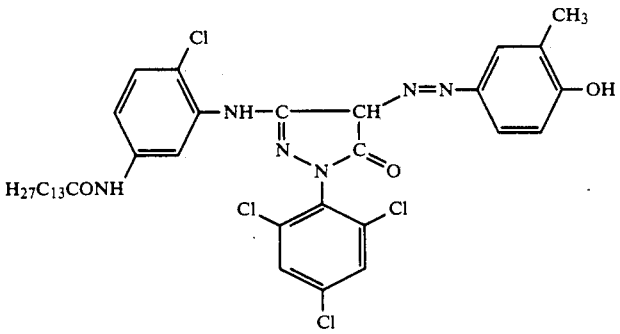
ExY-11
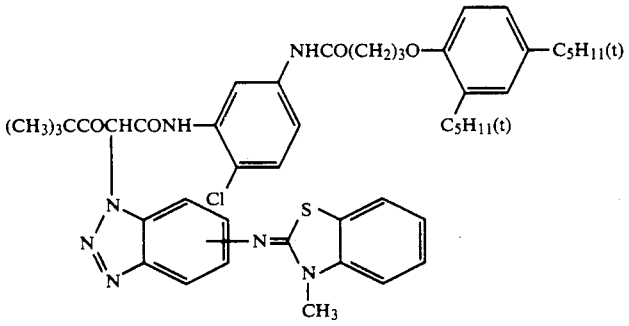
ExM-12
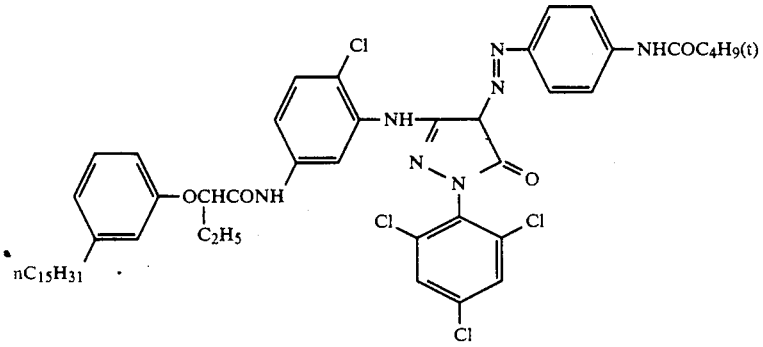

-continued
ExY-13
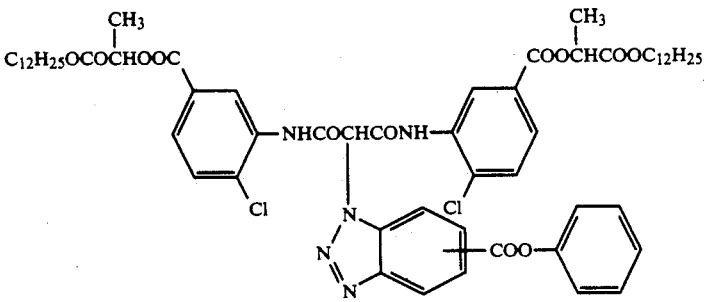
ExM-14
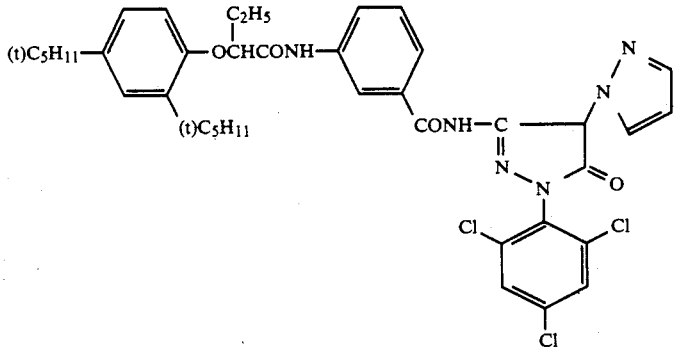
ExY-15
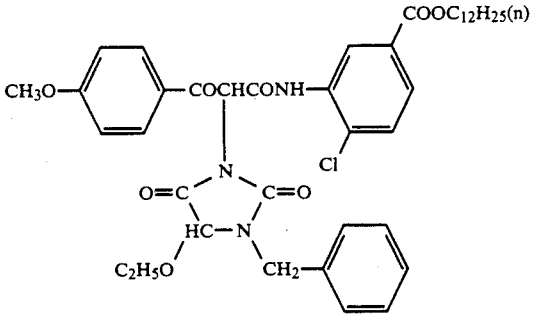
ExC-16
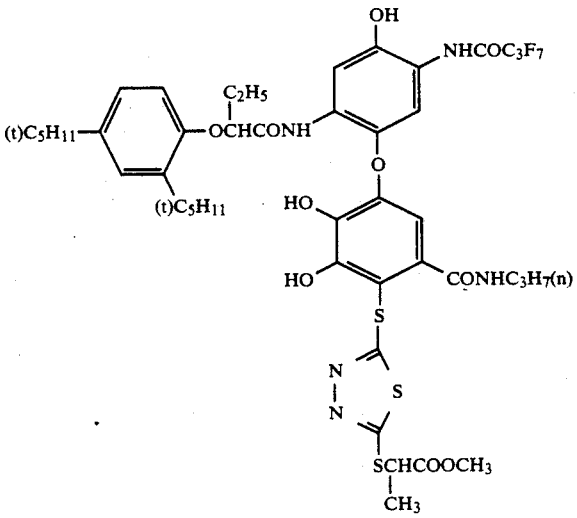

-continued
ExY-17
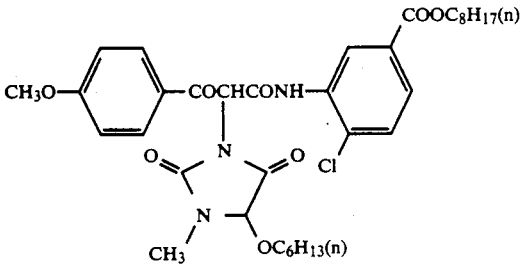
ExC-18
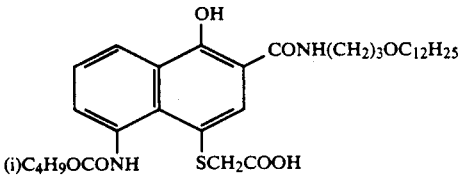
ExS-1
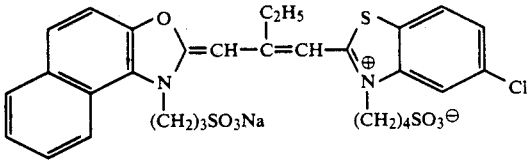
ExS-2
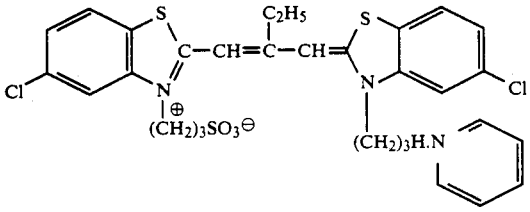
ExS-3
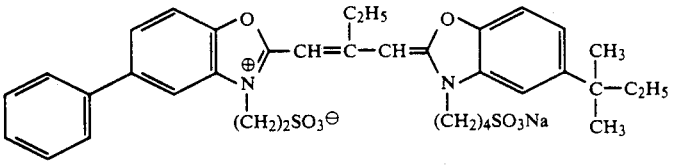
ExS-4
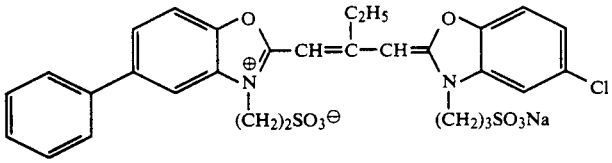
ExS-5
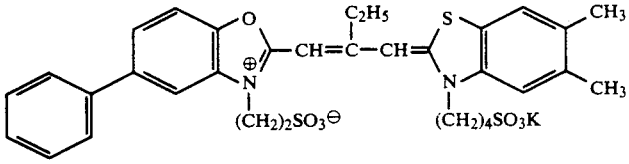
ExS-6
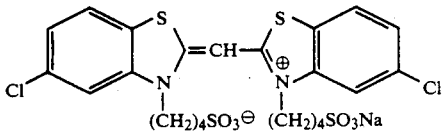
H-1
$CH_2{=}CH{-}SO_2{-}CH_2{-}CONH{-}CH_2$
$CH_2{=}CH{-}SO_2{-}CH_2{-}CONH{-}CH_2$ -continued

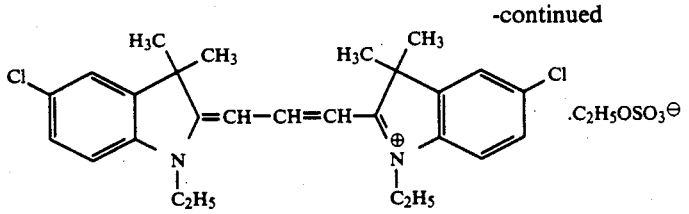

ExF-1

Samples 102~110 were prepared in the same way as sample 101 except that the high boiling point organic solvents Solv-1, Solv-2 and Solv-3 used in sample 101 were suitably replaced by polymers of this invention as shown in Table 6.

TABLE 6

| Sample No. | Layer 1. Layer | Layer 2. Layer | Layer 3. Layer | Layer 4. Layer | Layer 5. Layer | Layer 6. Layer | Layer 7. Layer |
|---|---|---|---|---|---|---|---|
| 101 | Solv-1 0.15<br>Solv-2 0.15<br>Solv-3 0.05 | Solv-1<br>0.1<br>Solv-2<br>0.1 | | Solv-1<br>0.05<br>Solv-2<br>0.05 | Solv-1<br>0.05 | Solv-1<br>0.3<br>Solv-4<br>0.05 | Solv-1<br>0.2<br>Solv-4<br>0.01 |
| 102 | Solv-1<br>0.15<br>(S-3)<br>0.20 | Solv-1<br>0.1<br>(S-3)<br>0.1 | | Solv-1<br>0.05<br>Solv-2<br>0.05 | Solv-1<br>0.05 | Solv-1<br>0.3<br>Solv-4<br>0.05 | Solv-1<br>0.2<br>Solv-4<br>0.01 |
| 103 | Solv-1 0.15<br>Solv-2 0.15<br>Solv-3 0.05 | Solv-1<br>0.1<br>Solv-2<br>0.1 | (S-5)<br>0.1 | Solv-1<br>0.05<br>(S-5)<br>0.05 | Solv-1<br>0.05 | Solv-1<br>0.3<br>Solv-4<br>0.05 | Solv-1<br>0.2<br>Solv-4<br>0.01 |
| 104 | Solv-1 0.15<br>Solv-2 0.15<br>Solv-3 0.05 | Solv-1<br>0.1<br>Solv-2<br>0.1 | | Solv-1<br>0.05<br>Solv-2<br>0.05 | (S-6)<br>0.05 | Solv-1<br>0.3<br>Solv-4<br>0.05 | Solv-1<br>0.2<br>Solv-4<br>0.01 |
| 105 | Solv-1 0.15<br>Solv-2 0.15<br>Solv-3 0.05 | Solv-1<br>0.1<br>Solv-2<br>0.1 | | Solv-1<br>0.05<br>Solv-2<br>0.05 | Solv-1<br>0.05 | Solv-1 0.1<br>Solv-4<br>0.05<br>(S-6) 0.2 | Solv-1 0.1<br>Solv-4<br>0.01<br>(S-6) 0.1 |
| 106 | Solv-1 0.15<br>Solv-2 0.15<br>Solv-3 0.05 | Solv-1<br>0.1<br>Solv-2<br>0.1 | | Solv-1<br>0.05<br>Solv-2<br>0.05 | Solv-1<br>0.05 | Solv-1<br>0.3<br>Solv-4<br>0.05 | Solv-1<br>0.2<br>Solv-4<br>0.01 |
| 107 | Solv-1 0.15<br>Solv-2 0.15<br>Solv-3 0.05 | Solv-1<br>0.1<br>Solv-2<br>0.1 | | Solv-1<br>0.05<br>Solv-2<br>0.05 | Solv-1<br>0.05 | Solv-1<br>0.3<br>Solv-4<br>0.05 | Solv-1<br>0.2<br>Solv-4<br>0.01 |
| 108 | Solv-1 0.15<br>Solv-2 0.15<br>Solv-3 0.05 | Solv-1<br>0.1<br>Solv-2<br>0.1 | | Solv-1<br>0.05<br>Solv-2<br>0.05 | Solv-1<br>0.05 | Solv-4<br>0.05<br>(S-7)<br>0.3 | Solv-4<br>0.01<br>(S-7)<br>0.2 |
| 109 | Solv-1 0.15<br>Solv-2 0.15<br>Solv-3 0.05 | Solv-1<br>0.1<br>Solv-2<br>0.1 | (S-6)<br>0.1 | (S-6)<br>0.1 | Solv-1<br>0.05 | Solv-1<br>0.3<br>Solv-4<br>0.05 | Solv-1<br>0.2<br>Solv-4<br>0.01 |
| 110 | (S-9)<br>0.3 | (S-9)<br>0.2 | | (S-5)<br>0.1 | Solv-1<br>0.05 | Solv-4<br>0.5<br>(S-5)<br>0.3 | Solv-4<br>0.01<br>(S-5)<br>0.2 |

| Sample No. | Layer 8. Layer | Layer 9. Layer | Layer 10. Layer | Layer 11. Layer | Layer 12. Layer | Layer 13. Layer | |
|---|---|---|---|---|---|---|---|
| 101 | Solv-1<br>0.02 | Solv-1<br>0.2 | | Solv-1<br>0.2 | Solv-1<br>0.1 | Solv-1<br>0.01<br>Solv-2<br>0.01 | Comparative Example |
| 102 | Solv-1<br>0.02 | Solv-1<br>0.2 | | Solv-1<br>0.2 | Solv-1<br>0.1 | Solv-1<br>0.01<br>Solv-2<br>0.01 | Example of the Invention |
| 103 | Solv-1<br>0.02 | Solv-1<br>0.2 | | Solv-1<br>0.2 | Solv-1<br>0.1 | Solv-1<br>0.01<br>Solv-2<br>0.01 | Example of the Invention |
| 104 | (S-6)<br>0.02 | Solv-1<br>0.2 | (S-5)<br>0.1 | Solv-1<br>0.2 | Solv-1<br>0.1 | Solv-1<br>0.01<br>Solv-2<br>0.01 | Example of the Invention |
| 105 | Solv-1<br>0.02 | Solv-1<br>0.1<br>(S-7)<br>0.1 | | Solv-1<br>0.2 | Solv-1<br>0.1 | Solv-1<br>0.01<br>Solv-2<br>0.01 | Example of the Invention |

TABLE 6-continued

| | | | | | | |
|---|---|---|---|---|---|---|
| 106 | Solv-1 0.02 | Solv-1 0.2 | Solv-1 0.1 (S-5) 0.1 | (S-5) 0.1 | Solv-1 0.01 Solv-2 0.01 | Example of the Invention |
| 107 | Solv-1 0.02 | Solv-1 0.2 | Solv-1 0.2 | Solv-1 0.1 | (S-7) 0.02 | Example of the Invention |
| 108 | Solv-1 0.02 | Solv-1 0.2 | (S-7) 0.2 | (S-7) 0.1 | Solv-1 0.01 Solv-2 0.01 | Example of the Invention |
| 109 | Solv-1 0.02 | Solv-1 0.2 | Solv-1 0.2 | Solv-1 0.1 | (S-6) 0.02 | Example of the Invention |
| 110 | Solv-1 0.02 | (S-5) 0.2 | (S-5) 0.1 | (S-5) 0.1 | (S-9) 0.3 | Example of the Invention |

After exposing the color photographic materials as described above they were processed using the method indicated below using a Color Negative Processor FP-350 made by the Fuji Photographic Film Co. (until the cumulative total liquid replenishment was equal to three times the capacity of the parent tank).

TABLE 7

| Processing Method | | | | |
|---|---|---|---|---|
| Process | Processing Time | Processing Temp. | Replenishment Rate | Tank Vol. |
| Color Dev. | 3 min. 15 sec. | 38° C. | 45 ml | 10 l |
| Bleach | 1 min. 00 sec. | 38° C. | 20 ml | 4 l |
| Bleach-Fix | 3 min. 15 sec. | 38° C. | 30 ml | 10 l |
| Wash (1) | 40 sec. | 35° C. | Counter-current pipework from (2) to (1) | 4 l |
| Wash (2) | 1 min. 00 sec. | 35° C. | 30 ml | 4 l |
| Stabilizer | 40 sec. | 38° C. | 20 ml | 4 l |
| Drying | 1 min. 15 sec. | 55° C. | | |

Replenishment rates per 1 meter length×35 mm wide.

Moreover, the amount of carry-over of bleach-fix bath into the water washing process in the processing operation outlined above was 2 ml per meter of photosensitive material of width 35 mm.

The compositions of the processing baths were as follows:

| (Color Development Bath) | Parent Bath (grams) | Replenisher (grams) |
|---|---|---|
| Diethylenetriamine penta-acetic acid | 1.0 | 1.1 |
| 1-Hydroxyethylidene-1,1-di-phosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-(N-Ethyl-N-β-hydroxyethylamino)-2-methylaniline sulfate | 4.5 | 5.5 |
| Water | | |
| to make up to | 1.0 l | |
| to make up to | | 1.0 l |
| pH | 10.05 | 10.10 |

| (Bleach Bath) Parent Bath = Replenisher (units: grams) | |
|---|---|
| Ammonium ethylenediaminetetraacetato ferrate | 120.0 |
| Di-sodium ethylenediaminetetraacetate | 10.0 |
| Ammonium bromide | 100.0 |
| Ammonium nitrate | 10.0 |
| Bleach accelerator: | |

-continued

| | |
|---|---|
| 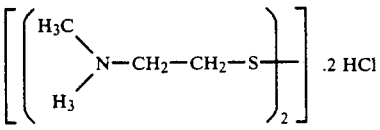 .2 HCl | 0.005 mol |
| Aqueous ammonia (27%) | 15.0 ml |
| Water to make up to | 1.0 liter |
| pH | 6.0 |

| (Bleach-Fix Bath) Parent Bath = Replenisher (units: grams) | |
|---|---|
| Ammonium ethylenediaminetetraacetato ferrate | 50.0 |
| Di-sodium ethylenediaminetetraacetate | 5.0 |
| Sodium sulfite | 12.0 |
| Aqueous ammonium thiosulfate solution (70%) | 240.0 ml |
| Aqueous ammonia (27%) | 6.0 ml |
| Water to make up to | 1.0 liter |
| pH | 7.2 |

Water Wash Bath Parent Bath=Replenisher

Town water was treated in such a way that the calcium and magnesium ion concentrations were at most 3 mg/liter by passing the water through a mixed bed type column which had been packed with an H-type strongly acidic cation exchange resin (Amberlite IR-120B, made by the Rohm and Haas Co.) and an OH-type anion exchange resin (Amberlite IR-400, also made by the Rohm and Haas Co.) and then 20 mg/liter of sodium di-chlorinated isocyanurate and 150 mg/liter of sodium sulfate were added.

The pH of this liquid was within the range from 6.5 to 7.5.

| (Stabilizing Bath) Parent Bath Replenisher = (units:grams) | |
|---|---|
| Formalin (37%) | 2.0 ml |
| Polyoxyethylene-p-monononylphenyl ether (average degree of polymerization 10) | 0.3 |
| Di-sodium ethylenediaminetetraacetate | 0.05 |
| Water to make up to | 1.0 liter |
| pH | 5.0–8.0 |

In the preparation of the aforementioned samples 102~110, the polymers of this invention exhibited excellently the capacity to dissolve and disperse photographically useful reagents such as couplers, etc., and on evaluating the photographic characteristics in the same way as in examples 1 to 3 it was observed that they were effective for suppressing staining during the development process and for suppressing the development of stains and fading of the colored image due to heat, light and moisture, etc.

As is clear from examples 1 to 4, the dissolution properties and dispersion stabilities of photographically useful reagents can be improved, the occurrence of staining during the development process can be suppressed and the occurrence of stains and color fading of the colored image due to light, heat and moisture can be suppressed by using polymers of this invention.

While the invention has been described in detail and with reference to specific embodiments thereof, it will be apparent to one skilled in the art that various changes and modifications can be made therein without departing from the spirit and scope thereof.

We claim:

1. Silver halide photographic materials comprising a support carrying at least one hydrophilic organic colloid layer in which at least one photographically useful reagent which is sparingly soluble in water is dispersed with at least one ethylenic addition polymerized polymer which contains at least 50% by weight of trifluorochloroethylene units as fine lipophilic particles, said photographically useful reagent being selected from photographically useful couplers, anti-fogging agents, anti-color fading agents, film hardening agents, oil soluble filter dyes, oil soluble anti-halation dyes, oil soluble ultraviolet absorbents, brightening agents, DIR compounds, developing agents, DDR couplers, DRR compounds, dye developing agents, development inhibitors and precursors thereof, development accelerators and precursors thereof.

2. Silver halide photographic materials as claimed in claim 1, wherein the ethylenic addition polymerized polymer is a poly(trifluorochloroethylene) homopolymer.

3. Silver halide photographic materials as claimed in claim 1, wherein the photographically useful reagent is a yellow coupler, a magenta coupler or a cyan coupler.

4. Silver halide photographic material as claimed in claim 1, wherein the average molecular weight of the ethylenic addition polymerized polymer is from 300 to 5,000.

5. Silver halide photographic materials as claimed in claim 1, wherein the average molecular weight of the ethylenic addition polymerized polymer is from 400 to 1,500.

6. Silver halide photographic materials as claimed in claim 1, wherein the average molecular weight of the ethylenic addition polymerized polymer is from 500 to 1,100.

7. Silver halide photographic materials as claimed in claim 1, wherein the amount of the ethylenic addition polymerized polymer used is from 1 to 200 wt. % based on the amount of the photographically useful reagent.

8. Silver halide photographic materials as claimed in claim 3, wherein the yellow coupler is represented by the general formula [II]:

General Formula [II]

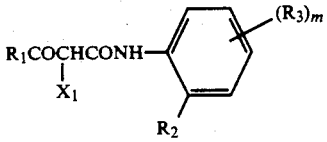

wherein $R_1$ represents a tertiary alkyl group or an aryl group, $R_2$ represents a hydrogen atom, halogen atom, amino group, alkoxy group or an alkyl group, $R_3$ represents a halogen atom, alkoxy group, alkyl group, carbonamido group, sulfonamido group, alkoxycarbonyl group, carbamoyl group, sulfamoyl group or a cyano group, m represents an integer of value from 0 to 4, and $X_1$ represents a hydrogen atom or group which can be eliminated by a coupling reaction with the oxidation product of a primary aromatic amine developing agent.

9. Silver halide photographic materials as claimed in claim 3, wherein the magenta coupler is represented by the general formula [III]:

General Formula [III]

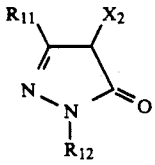

wherein $R_{11}$ represents a carbonylamido group, an anilino group or a ureido group, $R_{12}$ represents a phenyl group or a substituted phenyl group and $X_2$ represents a hydrogen atom or an elimination group.

10. Silver halide photographic materials as claimed in claim 3, wherein the magenta coupler is represented by the general formula [IV]:

General Formula [IV]

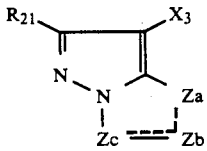

wherein $R_{21}$ represents a hydrogen atom or a substituent group, $X_3$ represents a hydrogen atom or an elimination group, Za, Zb and Zc represent methine groups, substituted methine groups, =N— groups or —NH— groups and Zb can form a condensed ring with Zc.

11. Silver halide photographic materials as claimed in claim 3, wherein the cyan coupler is represented by the general formula [V]:

General Formula [V]

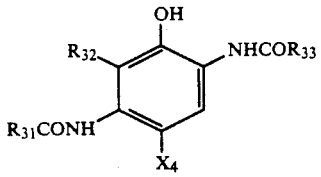

wherein $R_{31}$ represents an alkyl group, an aryl group or a heterocyclic group, $R_{32}$ represents a hydrogen atom, a halogen atom or an alkyl group, $R_{33}$ represents an alkyl group, an aryl group, an anilino group or a heterocyclic group, $X_4$ represents a hydrogen atom or an elimination group, and $R_{31}$ and $R_{32}$ may be joined together to form a five to seven membered ring.

12. Silver halide photographic materials as claimed in claim 3, wherein the cyan coupler is represented by the general formula [VI]:

General Formula [VI]

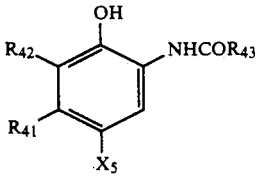

wherein $R_{41}$ represents an alkyl group or an alkoxy group, $R_{42}$ represents a halogen atom or an alkyl group, $R_{43}$ represents an alkyl group, an aryl group or a heterocyclic group, and $X_5$ represents a hydrogen atom or an elimination group.

13. Silver halide photographic materials as claimed in claim 3, wherein the cyan coupler is represented by the general formula [VII]:

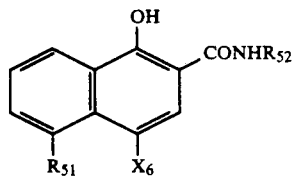

General Formula [VII]

wherein $R_{51}$ represents a hydrogen atom, a hydroxyl group, an amino group, an amido group, a sulfonamido group, a ureido group, a sulfamoylamino group, an alkoxycarbonylamino group or an alkoxysulfonylamino group, $R_{52}$ represents an alkyl group, an aryl group or a heterocyclic group, and $X_6$ represents a hydrogen atom or an elimination group.

14. Silver halide photographic materials as claimed in claim 1, wherein the refractive index of the ethylenic addition polymerized polymer is from 1.39 to 1.42.

15. Silver halide photographic materials as claimed in claim 1, wherein the ethylenic addition polymerized polymer contains at least 65% by weight of trifluorochloroethylene units.

16. Silver halide photographic materials as claimed in claim 1, wherein the ethylenic addition polymerized polymer contains at least 80% by weight of trifluorochloroethylene units.

17. Silver halide photographic materials as claimed in claim 1, wherein the hydrophilic organic colloid layer is a silver halide emulsion layer.

18. Silver halide photographic materials as claimed in claim 17, wherein the silver halide emulsion in the silver halide emulsion layer is a silver chloride emulsion or a silver chlorobromide emulsion wherein the silver chlorobromide contains at least 90 mol % of silver chloride.

19. Silver halide photographic materials as claimed in claim 1, wherein the support is a reflective support.

20. Silver halide color photographic materials comprising a support carrying at least three silver halide emulsion layers each having different color sensitivity, at least one of said silver halide emulsion layers being a hydrophilic organic colloid layer in which at least one photographically useful reagent is dispersed with at least one ethylenic addition polymerized polymer which contains at least 50% by weight of trifluorochloroethylene units as fine lipophilic particles.

* * * * *